US007399918B2

(12) United States Patent
Juszkiewicz et al.

(10) Patent No.: US 7,399,918 B2
(45) Date of Patent: Jul. 15, 2008

(54) DIGITAL GUITAR SYSTEM

(75) Inventors: Henry E. Juszkiewicz, Nashville, TN (US); Nathan W. Yeakel, Sunnyvale, CA (US)

(73) Assignee: Gibson Guitar Corp., Nashville, TN (US)

( * ) Notice: Subject to any disclaimer, the term of this patent is extended or adjusted under 35 U.S.C. 154(b) by 0 days.

(21) Appl. No.: 11/546,059

(22) Filed: Oct. 11, 2006

(65) Prior Publication Data

US 2007/0089594 A1 Apr. 26, 2007

Related U.S. Application Data

(63) Continuation of application No. 10/657,462, filed on Sep. 8, 2003, now Pat. No. 7,220,912, and a continuation-in-part of application No. 09/995,405, filed on Nov. 27, 2001, now Pat. No. 6,686,530, which is a continuation-in-part of application No. 09/557,560, filed on Apr. 25, 2000, now Pat. No. 6,353,169.

(60) Provisional application No. 60/478,725, filed on Jun. 13, 2003, provisional application No. 60/438,898, filed on Jan. 9, 2003, provisional application No. 60/131,031, filed on Apr. 26, 1999, provisional application No. 60/156,003, filed on Sep. 23, 1999.

(51) Int. Cl.
*G10H 1/18* (2006.01)
*G10H 3/12* (2006.01)

(52) U.S. Cl. ..... 84/742; 84/728; 84/743

(58) Field of Classification Search ..... 84/723, 84/728, 735, 741–743
See application file for complete search history.

(56) References Cited

U.S. PATENT DOCUMENTS

| | | | | |
|---|---|---|---|---|
| 2,968,204 | A | 1/1961 | Fender | 84/1.16 |
| 3,066,567 | A | 12/1962 | Kelley, Jr. | 84/1.16 |
| 3,073,202 | A | 1/1963 | Evans | 84/1.14 |

(Continued)

FOREIGN PATENT DOCUMENTS

WO WO 00/65571 11/2000

OTHER PUBLICATIONS

Exhibit A. Printout from www.helpwantedproductions.com/guitsyn.htm, dated Jun. 4, 2004 entitled "The Roland GR Series Analog Bass and Guitar Synthesizers".

(Continued)

*Primary Examiner*—Jeffrey Donels
(74) *Attorney, Agent, or Firm*—Stroock & Stroock & Lavan LLP

(57) ABSTRACT

A digital guitar system and method includes a digital guitar and a digital guitar interface device, and a method of converting a conventional guitar into a digital guitar. The guitar is adapted to generate analog audio signals, convert those signals into digital signals, format the digital signals according to a digital communication protocol, and to output the formatted signals. The guitar may include a novel multi-signal guitar pickup that generates some of the analog audio signals. The guitar is further adapted to receive digital signals, convert those signals into analog signals, and output the analog signals. The interface device is adapted to receive digital signals, convert those signals into analog signals, and output the analog signals.

22 Claims, 57 Drawing Sheets

U.S. PATENT DOCUMENTS

| | | | | | |
|---|---|---|---|---|---|
| 3,073,203 | A | | 1/1963 | Evans | 84/1.16 |
| 3,080,785 | A | | 3/1963 | Evans | 84/1.16 |
| 3,249,677 | A | | 5/1966 | Burns et al. | 84/1.16 |
| 3,453,920 | A | | 7/1969 | Scherer | 84/1.16 |
| 3,530,228 | A | | 9/1970 | Scherer | 84/1.16 |
| 3,539,700 | A | | 11/1970 | Johnson | 84/1.16 |
| 3,571,483 | A | | 3/1971 | Davidson | 84/1.16 |
| 3,712,951 | A | | 1/1973 | Rickard | 84/1.14 |
| 3,983,778 | A | | 10/1976 | Bartolini | 84/1.15 |
| 4,026,178 | A | | 5/1977 | Fuller | 84/1.16 |
| 4,160,401 | A | | 7/1979 | Tomioka | 84/1.16 |
| 4,182,213 | A | | 1/1980 | Iodice | 84/1.15 |
| 4,189,969 | A | | 2/1980 | Katayama et al. | 84/1.14 |
| 4,211,139 | A | | 7/1980 | Murakami | 84/1.14 |
| 4,236,433 | A | | 12/1980 | Holland | 84/1.16 |
| 4,248,120 | A | | 2/1981 | Dickson | 84/1.16 |
| 4,336,734 | A | | 6/1982 | Polson | 84/1.01 |
| 4,348,930 | A | | 9/1982 | Chobanian et al. | 84/726 |
| 4,378,721 | A | | 4/1983 | Kaneko et al. | 84/1.14 |
| 4,378,722 | A | | 4/1983 | Isakson | 84/1.15 |
| 4,437,377 | A | | 3/1984 | Mitarai et al. | 84/1.01 |
| 4,450,744 | A | | 5/1984 | Shubb | 84/1.16 |
| 4,534,258 | A | | 8/1985 | Anderson | 84/728 |
| 4,535,668 | A | | 8/1985 | Schaller | 84/1.15 |
| 4,567,805 | A | | 2/1986 | Clevinger | 84/731 |
| 4,603,321 | A | | 7/1986 | Gutman et al. | 340/347 |
| 4,624,172 | A | | 11/1986 | McDougall | 84/726 |
| 4,630,520 | A | | 12/1986 | Bonanno | 84/1.16 |
| 4,686,881 | A | | 8/1987 | Fender | 84/1.15 |
| 4,702,141 | A | | 10/1987 | Bonanno | 84/1.16 |
| 4,730,530 | A | | 3/1988 | Bonanno | 84/1.16 |
| 4,748,887 | A | | 6/1988 | Marshall | 84/1.15 |
| 4,794,838 | A | | 1/1989 | Corrigau, III | 84/1.01 |
| 4,805,510 | A | | 2/1989 | De Dianous | 84/1.16 |
| 4,817,484 | A | | 4/1989 | Iba et al. | 84/735 |
| 4,823,667 | A | | 4/1989 | Deutsch et al. | 84/1.16 |
| 4,858,509 | A | | 8/1989 | Marshall | 84/1.16 |
| 4,860,625 | A | | 8/1989 | Mathews | 84/1.16 |
| 4,867,027 | A | | 9/1989 | Barbera | 84/731 |
| 4,911,054 | A | | 3/1990 | McClish | 84/725 |
| 4,991,488 | A | * | 2/1991 | Fala et al. | 84/731 |
| 5,024,134 | A | | 6/1991 | Uchiyama | 84/654 |
| 5,065,659 | A | | 11/1991 | Uchiyama et al. | 84/723 |
| 5,078,041 | A | | 1/1992 | Schmued | 84/731 |
| 5,079,984 | A | | 1/1992 | Kosugi et al. | 84/645 |
| 5,085,119 | A | | 2/1992 | Cole | 84/724 |
| 5,109,747 | A | | 5/1992 | Spuler | 84/731 |
| 5,136,919 | A | | 8/1992 | Wolstein | 84/742 |
| 5,140,890 | A | | 8/1992 | Elion | 84/736 |
| 5,148,733 | A | | 9/1992 | Beller | 84/726 |
| 5,153,363 | A | | 10/1992 | Fishman et al. | 84/731 |
| 5,155,285 | A | | 10/1992 | Fishman | 84/731 |
| 5,204,487 | A | | 4/1993 | Turner | 84/731 |
| 5,223,660 | A | | 6/1993 | Wahlgreen | 84/731 |
| 5,233,123 | A | | 8/1993 | Rose et al. | 84/726 |
| 5,237,126 | A | | 8/1993 | Curtis et al. | 84/724 |
| 5,270,475 | A | * | 12/1993 | Weiss et al. | 84/603 |
| 5,308,916 | A | | 5/1994 | Murata et al. | 84/603 |
| 5,322,969 | A | | 6/1994 | Aaroe et al. | 84/731 |
| 5,354,949 | A | | 10/1994 | Zwaan | 84/727 |
| 5,367,117 | A | | 11/1994 | Kikuchi | 84/603 |
| 5,393,926 | A | * | 2/1995 | Johnson | 84/610 |
| 5,399,802 | A | | 3/1995 | Blucher | 84/726 |
| 5,410,101 | A | | 4/1995 | Sakurai | 84/731 |
| 5,455,381 | A | | 10/1995 | Juszkiewicz et al. | 84/731 |
| 5,463,185 | A | | 10/1995 | Fishman | 84/731 |
| 5,525,750 | A | | 6/1996 | Beller | 84/726 |
| 5,530,199 | A | | 6/1996 | Blucher | 84/728 |
| 5,539,147 | A | | 7/1996 | Hoshino | 84/723 |
| 5,567,903 | A | * | 10/1996 | Coopersmith et al. | 84/723 |
| 5,591,931 | A | | 1/1997 | Dame | 84/726 |
| 5,602,353 | A | | 2/1997 | Juszkiewicz et al. | 84/298 |
| 5,610,357 | A | | 3/1997 | Frank-Braun | 84/726 |
| 5,668,520 | A | | 9/1997 | Kinman | 336/84 R |
| 5,670,729 | A | * | 9/1997 | Miller et al. | 84/609 |
| 5,670,733 | A | | 9/1997 | Fishman | 84/731 |
| 5,723,805 | A | | 3/1998 | Lacombe | 84/727 |
| 5,744,744 | A | | 4/1998 | Wakuda | 84/650 |
| 5,789,689 | A | | 8/1998 | Doidic et al. | 84/603 |
| 5,837,912 | A | | 11/1998 | Eagen | 84/267 |
| 5,866,834 | A | | 2/1999 | Burke et al. | 84/622 |
| 5,877,444 | A | | 3/1999 | Hine et al. | 84/454 |
| 6,043,422 | A | | 3/2000 | Chapman | 84/723 |
| 6,111,184 | A | * | 8/2000 | Cloud et al. | 84/723 |
| 6,175,070 | B1 | * | 1/2001 | Naples et al. | 84/609 |
| 6,191,350 | B1 | | 2/2001 | Okulov et al. | 84/646 |
| 6,281,830 | B1 | | 8/2001 | Flety | 341/155 |
| 6,316,713 | B1 | | 11/2001 | Furst et al. | 84/726 |
| 6,353,169 | B1 | | 3/2002 | Juszkiewicz et al. | 84/600 |
| 6,392,137 | B1 | | 5/2002 | Isvan | 84/726 |
| 6,686,530 | B2 | | 2/2004 | Juszkiewicz et al. | 84/600 |
| 6,787,690 | B1 | | 9/2004 | Celi et al. | 84/723 |
| 2003/0159570 | A1 | | 8/2003 | Toshitani | 84/645 |

OTHER PUBLICATIONS

Exhibit B. Printout from www.helpwantedproductions.com/guitsyn.htm, dated Jan. 2, 2003 entitled "The Roland GR Series Analog Bass and Guitar Synthesizers".

Exhibit C. Printout from www.godguitars.com/grquickstart.htm, dated Jun. 4, 2004 entitled "Godin 13-Pin synth access (SA) guitars and the Roland GR-33", 5 pages.

Exhibit D. Article from Jul. 2003 Guitar Player Magazine, pp. 63-68 entitled "Tech Breakout! Line 6's Variax is the Ultimate Schizophonic Multitasking Guitar".

Exhibit E. Website printout dated May 23, 2003 from RiksMusic.com entitled "Line 6 Variax The world's first Digital Modeling Guitar".

Exhibit A. Printout from www.line6.com/variax/US/FAQ.asp dated Jun. 4, 2004 regarding Variax entitled "Frequently Asked Questions".

* cited by examiner

| | |
|---|---|
| FIG. 33A | FIG. 33B |
| FIG. 33C | FIG. 33D |

Title: GUITAR PRE (Inputs 5 "A string, 6 "Low E string")

FIG. 33

DIGITAL GUITAR SYSTEM

This application claims benefit of each of the following noted applications, and the relationship of this application to each prior application is noted below:

(1) this application is a continuation of copending U.S. patent application Ser. No. 10/657,462, filed Sep. 8, 2003 now U.S. Pat. No. 7,220,912, entitled "Digital Guitar System";

(2) the '462 application claims benefit of co-pending provisional U.S. patent application Ser. No. 60/478,725, filed Jun. 13, 2003, entitled "Digital Guitar System and Method";

(3) the '462 application claims benefit of co-pending provisional U.S. patent application Ser. No. 60/438,898, filed Jan. 9, 2003, entitled "Digital Guitar System"; and (4) the '462 application was a continuation-in-part of U.S. patent application Ser. No. 09/995,405, filed Nov. 27, 2001, entitled "Universal Communications and Control System For Amplified Musical Instruments";

(5) which was a continuation-in-part of U.S. patent application Ser. No. 09/557,560 filed Apr. 25, 2000, entitled "Universal Communications and Control System For Amplified Musical Instruments", now U.S. Pat. No. 6,353,169;

(6) which claimed benefit of provisional applications Ser. No. 60/131,031, filed Apr. 26, 1999, entitled "Universal Communications and Control System For Amplified Musical Instrument", and Ser. No. 60/156,003 filed Sep. 23, 1999, entitled "Universal Communications and Control System For Amplified Musical Instrument".

All of the above referenced applications and patents are incorporated herein by reference.

BACKGROUND OF THE INVENTION

The present invention relates generally to guitars, guitar pickups, and guitar equipment. More particularly, this invention pertains to digital guitars, multi-signal guitar pickups, and digital guitar interface devices.

Guitars are well known in the art and include a wide variety of different types and designs. For example, the prior art includes various types of acoustic and electric guitars. These guitars are typically adapted to receive analog audio signals, such as analog microphone signals, and to output analog audio signals, such as analog string signals (analog audio signals generated by guitar pickups when guitar strings are strummed) and analog headphone signals.

The prior art includes monophonic guitars, i.e., guitars that output a single string signal when one or more of the guitar strings mounted on the guitar are strummed. The prior art also includes guitars that output a single string signal for each string mounted on a guitar. The latter type of guitar is generally referred to as a polyphonic guitar.

All of these guitars have a common disadvantage—they all receive and output analog audio signals. Analog audio signals are susceptible to various kinds of electrical and environmental noise that can degrade the quality of the analog audio signal. This is particularly true in environments where the analog audio signals are transmitted through cables exposed to electrical power cables or other cables that are also carrying analog audio signals. Regardless of the cause, degraded analog audio signals are undesirable because they are unpleasant to listen to and do not accurately reflect the audio output of the guitar.

Although conventional guitars, and the associated noise problems discussed above, have been around for years, no one appears to have addressed this problem in the prior art. Thus, there is a need for a guitar that can receive and output audio signals that are less susceptible to electrical and environmental noise.

SUMMARY OF THE INVENTION

As described in detail in this application, this problem can be solved by using a guitar that is capable of receiving and outputting digital audio signals rather then analog audio signals, i.e., a digital guitar. Digital audio signals are less susceptible to electrical and environmental noise because they can only take on discrete values and a system can be designed to ignore noise signal values that are not within a certain range of the discrete values. The benefits of digital signals with regard to noise resistance are well known in the art and will not be repeated here. It is sufficient to point out that digital signals have a discrete nature and it is that discreteness that provides the noise resistance.

The development of a digital guitar and the adoption of that guitar in the consumer marketplace, however, creates an additional series of problems. First, a guitar that receives and outputs digital audio signals is incompatible with conventional guitar equipment, such as amplifiers, effects boxes, and synthesizers. These devices are adapted to receive and output analog audio signals, not digital audio signals. They cannot process digital audio signals.

This incompatibility creates a serious problem with regard to the adoption of a digital guitar in the consumer marketplace. Many consumers have invested a substantial amount of money in conventional guitar equipment and are unlikely to purchase a digital guitar that is incompatible with the conventional guitar equipment that they already own—even if that guitar outputs audio signals that are less susceptible to noise. Thus, in addition to the need for a digital guitar, there is a need for a digital guitar that is compatible with conventional guitar equipment.

Second, many consumers may be unwilling to purchase a digital guitar because they are unwilling to give up their conventional analog guitar. For example, many consumers have used their conventional analog guitars for years and have become accustomed to the way those guitars look and feel. These consumers may be unwilling to begin using a digital guitar regardless of its benefits. While this problem might be overcome to some extent by fashioning the digital guitar to have an appearance similar to that of conventional analog guitars, this may not be sufficient for some consumers.

Furthermore, some consumers may be unwilling to replace their conventional analog guitar with a digital guitar because their guitar has significantly increased in value. Many conventional analog guitars have become very popular among consumers and, as a result, have increased in value. Consumers owning these types of guitars are very unlikely to sell these guitars in order to purchase a digital guitar or to use a digital guitar in place of their existing conventional analog guitar. Many of these consumers, however, still have a need for and would like to obtain the benefits provided by a digital guitar. As explained in detail in this application, one way to address this problem is to develop a method of modifying a conventional analog guitar so that it can receive and output digital audio signals.

In addition to the problems addressed above, the present invention is also directed to solving two problems common to conventional guitar pickups. The first relates to the fact that these pickups typically generate analog audio signals that contain noise signals and the second relates to the fact that these pickups typically generate mixed analog string signals.

Although the prior art has addressed both of these problems in part, as explained below the prior art solutions are not suitable for some applications.

With regard to the first issue, the assignee of the present application has recognized that conventional guitar pickups, in addition to generating analog audio signals in response to guitar string vibrations, also pick up electrical or environmental noise and generate analog noise signals. Conventional guitar pickups cannot separate these noise signals from the desired analog audio signals and, as a result, mix the noise signals with the analog audio signals. The resulting output is an analog audio signal contaminated with noise.

The prior art has addressed this issue using, most notably, conventional humbucker guitar pickups. As is well known in the art, a monophonic humbucker guitar pickup generates two analog string signals when guitar strings are strummed, both of which include the same noise signal. The humbucker pickup is designed so that one of the analog string signals includes an analog string component that is inverted with respect to the analog string component in the second analog string signal. The noise signal has the same polarity in each signal. By subtracting the two analog string signals from one another, the noise signal can be cancelled out, leaving only the desired analog string signal. Polyphonic humbucker pickups operate in a similar manner.

While analog string signals generated by prior art humbucker guitar pickups can be used to cancel out the effects of noise, the pickups themselves can be complicated. Monophonic humbucker guitar pickups essentially require two monophonic guitar pickups arranged so that one of the pickups generates an inverted analog string signal. Polyphonic humbuckers operate in a similar manner and require two monophonic pickups for each string on a guitar. The requirement for duplicate pickups increases the complexity of these humbucker pickups and, in some cases, makes these pickups unsuitable for use.

The prior art does not appear to have addressed this limitation in a suitable manner and, accordingly, there is a need for a guitar pickup that does so. In other words, there is a need for a less complicated guitar pickup that generates a noise signal that can be used to cancel out the effects of noise in analog string signals generated by the pickup.

Moving to the second issue, the assignee of the present application has recognized that conventional guitar pickups generate mixed analog string signals that include horizontal and vertical string components. When a guitar string is strummed, it vibrates in an elliptical or oval-shaped pattern. This pattern can be broken down into movement in two different planes—the horizontal string plane, which is defined as the plane that passes through the guitar strings and is parallel to the upper surface or face of the guitar, and the vertical string plane, which is defined as the plane that is perpendicular to the horizontal string plane. When a guitar string vibrates, it moves in both of these planes. Conventional guitar pickups, in turn, generate an analog string signal based on this elliptical type vibration pattern, but cannot separate that signal into the appropriate horizontal and vertical string signal components.

The assignee has further recognized that, by separating these mixed analog string signals into their respective string component signals, new and different sounds, not currently available using conventional pickups, can be generated. The sound associated with a mixed analog string signal is different from the sounds associated with the horizontal and vertical string signal components of that mixed signal. In addition, the sounds associated with horizontal and vertical string vibrations are different from one another. This is true because guitar strings do not vibrate in the horizontal and vertical planes in the same manner. In many cases, vibrations of a guitar string in the horizontal plane are much greater than vibrations of the guitar string in the vertical plane.

This problem has been addressed, in part, by the assignee in U.S. Pat. No. 6,392,137, issued to Isvan on May 21, 2002 and assigned to the assignee, and entitled "Polyphonic Guitar Pickup For Sensing String Vibrations In Two Mutually Perpendicular Planes." The '137 patent is hereby incorporated by reference into this application.

The digital guitar system includes a digital guitar and a digital guitar interface device, and the method includes the steps necessary to convert a conventional analog guitar into a digital guitar. The digital guitar outputs digital audio signals, which are less susceptible to noise, and the interface device allows the digital guitar to be compatible with conventional analog guitar equipment by converting the digital audio signals into analog audio signals.

The digital guitar is adapted to generate a plurality of different types of analog audio signals, convert those audio signals into digital audio signals, format the digital audio signals according to a predetermined digital communication protocol, and to output the formatted signals. The digital guitar is also adapted to receive digital audio signals, convert those digital audio signals into analog audio signals, and to output the analog audio signals. The guitar is further adapted to receive external analog audio signals, such as microphone signals, convert those signals into digital audio signals, and to output the digital microphone signals.

To facilitate the above-referenced functions, the digital guitar includes a guitar pickup assembly, a digital guitar processing circuit, a guitar digital input/output assembly, a guitar analog input/output assembly, and a guitar control assembly. The guitar pickup assembly includes a novel multi-signal hexaphonic guitar pickup that is adapted to generate two or more mixed analog audio signals for each guitar string, and, is further adapted to generate an analog noise signal, which can be used to cancel out the effects of noise in the mixed analog audio signals. The mixed analog audio signals, in turn, can be processed to generate the horizontal and vertical string signal components associated with each vibrating guitar string.

The digital guitar interface device is adapted to receive a plurality of different types of digital audio signals, to convert those signals into analog audio signals, and to output the analog audio signals. The interface device is also adapted to receive digital control signals and to use those signals to control the outputs of the interface device. The interface device is still further adapted to receive external analog audio signals, convert those signals into digital signals, format the digital signals according to a predetermined digital communication protocol, and to output the formatted digital signals.

The interface device includes the following components: an interface device digital input/output assembly, an interface device analog input/output assembly, and an interface device processing circuit. These components work together to allow the interface device to perform its required functions.

The method includes the steps of removing a conventional guitar output assembly from a conventional analog guitar, inserting and mounting the digital guitar processing circuit inside the guitar, connecting the digital guitar processing circuit to the guitar pickup assembly mounted on the guitar and to a guitar digital input/output assembly, and replacing the conventional guitar output assembly with the guitar digital input/output assembly.

Accordingly, one object of the present invention is a guitar that is capable of outputting digital signals, i.e., a digital guitar.

Another object is to provide a guitar processing circuit for a guitar that is capable of receiving analog signals, converting those signals into digital signals, formatting the digital signals according to a digital communication protocol, and outputting the formatted digital signals.

A third object is to provide a digital guitar that is compatible with conventional guitar equipment.

Another object is to provide a digital guitar operable to output analog signals.

Still another object of the present invention is to provide a digital guitar interface device capable of receiving digital signals and converting them into analog signals.

A sixth object of the present invention is to provide an interface device processing circuit that is adapted to receive digital signals, convert those signals into analog signals, and to output the analog signals.

Yet another object is to provide a novel multi-signal guitar pickup that is adapted to generate a noise signal that can be used to reduce or eliminate noise signals in the guitar pickup and to generate mixed analog string signals that can be used to calculate the horizontal and vertical string signal components for a vibrating guitar string.

These and other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Digital Guitar in an All Digital System

The digital guitar of the present invention will first be described in an all digital system. Later sections describe the digital guitar with a breakout box that allows for use of the digital guitar with legacy analog components.

The digital guitar is designed for use with a predetermined digital audio communication protocol. The following description refers to the use of a preferred protocol which is the MaGIC protocol developed by the assignee of the present invention, Gibson Guitar Corp. It will be understood, however, that the digital guitar as described herein could be used with any suitable protocol.

MaGIC, which stands for Media-accelerated Global Information Carrier, is an open architecture digital connection system developed by Gibson Guitar Corp, the assignee of the present application. The operation of the MaGIC system is described in detail in an engineering specification dated May 3, 2003 and entitled Media-accelerated Global Information Carrier, Engineering Specification, Revision 3.0c. The disclosure contained in that specification is hereby incorporated by reference into this application. The specification may be accessed at the following web address, http://MaGIC.gibson-.com/specification.html. In addition, the MaGIC system is described in detail in U.S. Pat. No. 6,353,169, issued to Juszkiewicz et al. on Mar. 5, 2002 and entitled "Universal Audio Communications and Control System and Method." The disclosure of the '169 patent is also hereby incorporated by reference into this application.

Figure 1:
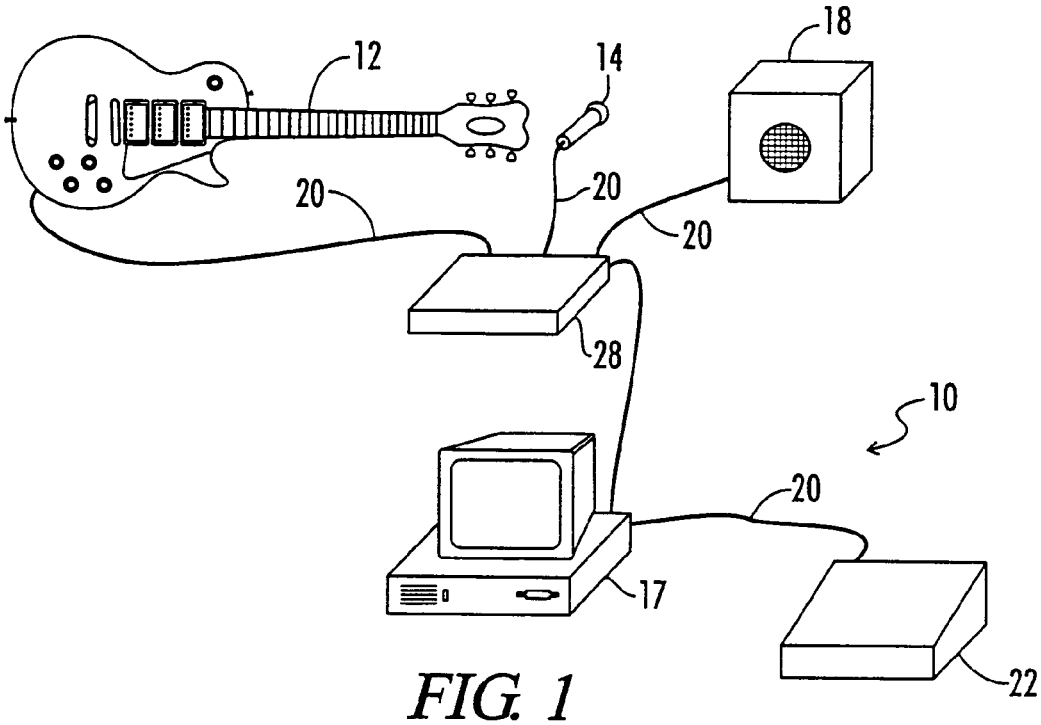
FIG. 1 is a block diagram of the system of this invention showing a typical arrangement that interconnects instrument devices with various control devices.
Figure 2:
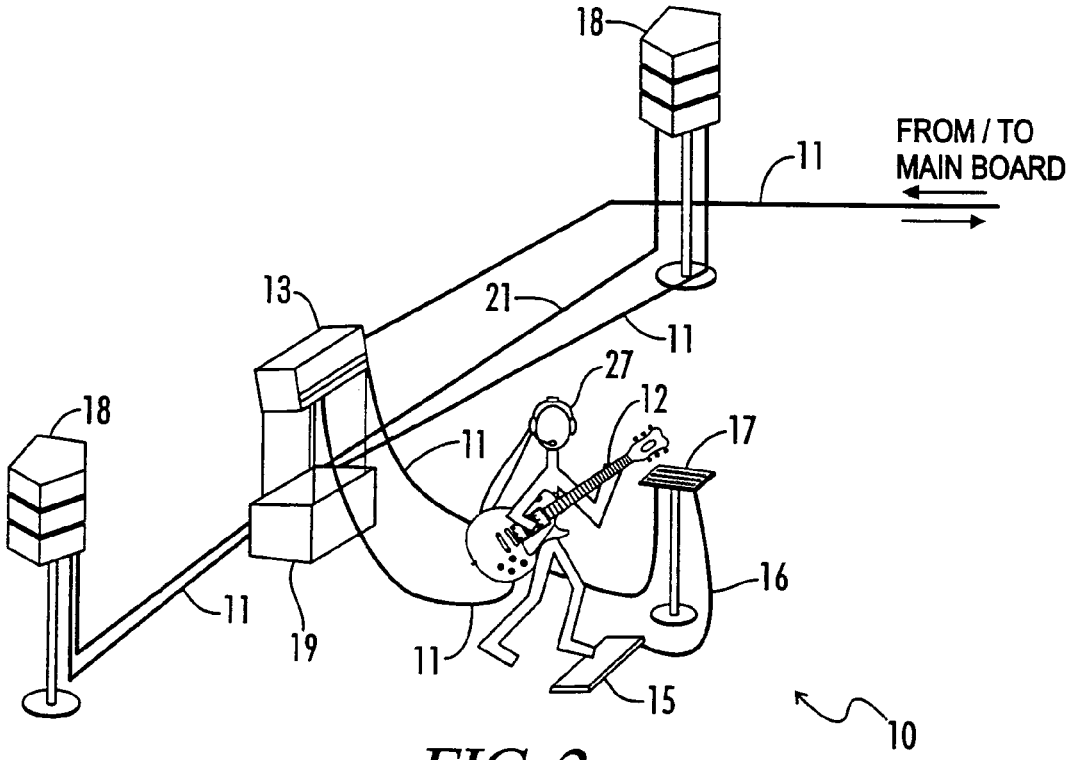
FIG. 2 is a schematic diagram of an embodiment of the system of this invention showing a physical implementation and interconnection of devices in an on-stage performance audio environment.

Typical arrangements of the digital guitar and related audio and control hardware in a MaGIC system are shown in FIGS. 1 and 2.

Each of the instruments and the microphones are digital. In alternative embodiments, the microphones may be analog as well. Each of the amplifiers, preamplifiers and the soundboard are connected using the MaGIC data link. The stage has a hub 28 with a single cable (perhaps an optical fiber) running to the control board 22. A gigabit MaGIC data link will allow over a hundred channels of sound with a 32 bit-192 kHz digital fidelity, and video on top of that.

As each instrument and amplifier are connected into a hub 28 on the stage via simple RJ-45 network connectors, they are immediately identified by the sound board 22 which is really a PC computer with a Universal Control Surface (FIG. 3) giving the sound professional complete control of the room. Microphones are actually placed at critical areas throughout the room to audit sound during the performance. The relative levels of all instruments and microphones are stored on a RW CD ROM disc or other digital storage medium, as are all effects the band requires. These presets are worked on until they are optimized in studio rehearsals, and fine tuning corrections are recorded during every performance.

The guitar player puts on his headset 27, which contains both a stereo (each ear) monitor and an unobtrusive microphone. In addition, each earpiece has an outward facing mike allowing sophisticated noise canceling and other sound processing. The player simply plugs this personal gear directly into his guitar 12 and the other players do the same with their respective instruments. The monitor mix is automated and fed from different channels per the presets on the CD-ROM at the board. The monitor sound level is of the artists choosing (guitar player is loud).

The guitar player has a small stand-mounted laptop 17 (FIG. 2) that is MaGIC enabled. This allows sophisticated visual cues concerning his instrument, vocal effects and even lyrics. The laptop 17 connects to a pedal board 15 that is a relatively standard controller via a USB cable 16 to a connector on the laptop 17. Another USB cable is run to the amplifier 13, which is really as much of a specialized digital processor as it is a device to make loud music. This guitar 12 is plugged into this amplifier 13, and then the amplifier 13 is plugged into the hub 28 using the MaGIC RJ-45 cables 11.

The laptop 17 contains not only presets, but stores some of the proprietary sound effects programs that will be fed to the DSP in the amplifier, as well as some sound files that can be played back. Should the drummer not show up, the laptop could be used.

The guitar player strums his instrument once. The laptop 17 shows all six strings with instructions on how many turns of the tuner are required to bring the instrument in tune, plus a meter showing the degree of tone the strings have (i.e., do they need to be replaced). The DSP amplifier can adjust the guitar strings on the fly to tune, even though they are out of tune, or it can place the guitar into different tunings. This player, however, prefers the "real" sound so he turns off the auto-tune function.

The best part of these new guitars is the additional nuance achieved by squeezing the neck and the touch surfaces that are not part of the older instruments. They give you the ability to do so much more musically.

The sound technician, for his part is already prepared. The room acoustics are present in the "board/PC". The band's RW CD-ROM or other digital storage medium contains a program that takes this info and adjusts their entire equipment setup through out the evening. The technician just needs to put a limit on total sound pressure in the house, still and always a problem with bands, and he is done except for monitoring potential problems.

The complexity of sound and room acoustic modeling could not have been addressed using prior art manual audio consoles. Now, there is sophisticated panning and imaging in three dimensions. Phase and echo, constant compromises in the past, are corrected for digitally. The room can sound like a cathedral, opera house, or even a small club.

The new scheme of powered speakers 18 throughout is also valuable. Each speaker has a digital MaGIC input and a 48 VDC power input. These all terminate in a power hub 19 and a hub at the board 22. In larger rooms, there are hubs throughout the room, minimizing cable needs. Each amplifier component is replaceable easily and each speaker is as well. The musician has the added components and can switch them out between sets if necessary.

The MaGIC system dispenses with the need for walls of rack effects and patch bays. All of the functionality of these prior art devices now resides in software plug-ins in either the board-PC or the attached DSP computer. Most musicians will bring these plug-ins with them, preferring total control over the performance environment.

The band can record their act. All the individual tracks will be stored on the board-PC system and downloaded to a DVD-ROM for future editing in the studio.

To set up the MaGIC system, the players put their gear on stage. They plug their instruments into their amplifiers, laptops, etc. These are, in turn, plugged into the MaGIC Hub. The band presets are loaded and cued to song 1. The house system goes through a 30-second burst of adjustment soundtrack, and then the band can be introduced.

The keyboard business several years ago went to a workstation approach where the keyboard product became more than a controller (keys) with sounds. It became a digital control center with ability to control other electronic boxes via midi, a sequencer and included very sophisticated (editing) tools to sculpt the sounds in the box. It included a basic amount of reverb and other sound effects that had been external previously.

In the MaGIC system, the guitar amplifier can be a workstation for the guitar player, encompassing many effects that were previously external. In effect, the amplifier is actually become part of the player's control system, allowing control via the only appendage the player has that is not occupied playing, his foot. Additionally, a small stand mounted laptop will be right by the player where he can make more sophisticated control changes and visually see how his system is functioning. The view screen can even allow the lyrics and chord changes to be displayed in a set list.

The amplifier in the new MaGIC system will allow flexible real time control of other enhancements and integration into the computer and future studio world.

The amplifier can be separated into its constituent parts:

The preamplifier 1 (the controls, or the knobs);

The preamplifier 2 (the sound modifier);

The power stage (simple amplification);

The speakers (create the sound wave envelope).

The cabinet (esthetics and durability);

This is a lot of functionality when you look at the constituent components. The MaGIC system introduces a novel technology and a whole new way of looking at a musical instrument amplifier. Many designers and companies have already identified the constituents of the whole and marketed one of them as a single purpose product with modest success. But, just as a controller keyboard (one without the sounds) has not made a major market penetration, the single purpose constituent is not satisfying to the player. The MaGIC Workstation encompasses all of the constituents in an easy to use form.

As described above, the MaGIC Link uses currently available components, the Ethernet standard (the communications protocol), a commonly used RJ-45 connector and a new communications protocol utilizing Internet type formatting. This allows the system to send ten channels of digital musical sound over standard cables directly from the instrument for further processing and amplification. A new upgraded MIDI standard signal along with a music description language can also travel over this cable. This scheme allows for up to phantom instrument power as described over that same cable to power circuits in the instrument, including D/A conversion. In one embodiment, phantom power is supplied using the industry standard 802.3af "power over Ethernet" method.

The MaGIC circuit board is very small and uses custom application specific integrated circuits (ASIC) and surface mount technology. It will connect to standard pick-ups and CPA's in classic guitars and is particularly suited for new hexaphonic pick-ups that provide an individual transducer for every string.

The MaGIC Enabled Musical Instrument

The only noticeable hardware difference in MaGIC enabled traditional instruments will be the addition of a RJ-45 female connector, and a small stereo headphone out. Of course, this innovation makes a host of new possibilities possible in the design of new modern instruments. Older instruments will be able to access most of the new functionality by simply replacing the commonly used monophonic audio connector with a new RJ-45 connector and a tiny retrofit circuit board. Vintage values can be retained.

The original analog output will be available as always with no impact on sound, and the digital features need never be used. The MaGIC system will allow access to both the digital signal and the unadulterated analog signal.

Having eight digital channels available for output, six of these will be used by each string in a six-string instrument. Two channels will be available to be input directly into the instrument for further routing. In a typical set up, one input will be a microphone from the performer's headset and the other input is a monitor mix fed from the main board. The headphones would then be the stereo monitor adjusted to the musicians liking without impacting the sound of the room.

The physical connector will be a simple, inexpensive and highly reliable RJ-45 locking connector, and category 5 stranded 8-conductor cable.

A new hex pickup/transducer will send 6 independent signals to be processed. The transducer is located in the stop bar saddles on the guitar bridge. Alternatively, the classic analog signal can be converted post CPA to a digital signal from the classic original electromagnetic pick-ups. There are also two analog signal inputs that are immediately converted into a digital signal (A/D converter) and introduced into the MaGIC data stream.

This MaGIC ASIC and the MaGIC technology can be applied to virtually every instrument, not just guitars.

1. The Preamplifier 1 (The Controls, or the Knobs);

The Control Surface

The knobs or controls for the current generation of amplifiers are unusable in a performance setting, and practically in virtually every other setting. It is very difficult to adjust the control knobs in the presence of 110 dB of ambient sound level. Utilizing both the MaGIC and USB protocols, a communication link is available with all components of the performance/studio system. Any component can be anywhere without degrading the sound. The MaGIC standard includes a channel for high-speed control information using the MIDI format but with approximately one-hundred times the bandwidth. Thus, the MaGIC system is backward compatible with the current instruments utilizing MIDI (most keyboards and sound synthesizers).

The display and knobs will be a separate unit. In the MaGIC system, this is referred to as the physical control surface that will be plugged into either the Master Rack directly, or into a laptop computer via a USB connector. When using the laptop, it will function as the visual information screen showing various settings, parameters, etc. Software resident on the laptop will be the music editor allowing control over infinite parameters.

This laptop will be unobtrusive but highly functional and the settings can be displayed on this screen visible from a distance of 12 feet to a player with normal vision. It will have a USB connection. There will also be a pedal controller with a USB or MaGIC out to the Master Rack where processing shall take place. Because both MaGIC and USB have phantom power, both the Control Surface and the Foot Controller have power supplied via their connectors. Software drivers for major digital mixers and music editors will allow the controller function to be duplicated in virtually any environment.

The foot controller will have one continuous controller pedal, one two-dimensional continuous controller pedal, and eleven-foot switches clustered as above.

2. The Preamplifier 2 (The Sound Modifier);

The Master Rack Unit

The Master Rack unit is a computer taking the digital MaGIC unprocessed signals in and outputting the MaGIC processed digital signals out for distribution (routing). The Master Rack will be in a cabinet enclosure that will allow five-rack unit. The Global Amplification System will use two of these, and the other three will allow any rack-mounted units to be added.

The Master Rack enclosure is rugged with covers and replaceable Cordura™ gig bag covering. It will meet UPS size requirements and is extremely light. The three empty racks are on slide-in trays (which come with the unit) but will allow the effects devices to be removed easily, substituted and carried separately. The rack trays will make electrical contact with the motherboard unit, so that stereo input, stereo output, two-foot switch inputs, and digital input and output are available so that no connections are necessary once the effects device is docked.

The Master Rack enclosure has several unconventional features that will be highly useful for the performer/player. There are power outlets, four on each side that will allow for power to the three empty rack bays, plus others. The power outlets will allow wall plug power supplies (wall worts) both in terms of distance between outlets and allowing space for these unlikable supplies. The supplies are nested inside the enclosure (protected and unobtrusive) and will never have to be dealt with again. Loops will allow these supplies to be anchored in using simple tie wraps.

All rack units mount to a sliding plate on which they will rest. The effects devices can thus slide out and be replaced, similar to "hot swap" computer peripherals. A set of patch bay inputs and outputs is installed on the back plane, accessible via a hinged action from the backside of the Master Rack. The other side of the patch bay will be accessible from the top of the enclosure, which will be recessed and unobtrusive when not needed. All I/O to the integral Global Amplification System will be on the bay for flexible yet semi permanent set-ups.

The Global Amp rack units can also slide out for maintenance and replacement. One of the rack units is the control computer for the MaGIC system, including a "hot swappable" hard disk, a "hot swappable" CD-RW unit, and the digital processing and signal routing and control circuits. The control unit takes the digital MaGIC signals in and out and 2 USB connectors, coupled to a general purpose processing section. The processor section processes multiple digital signals intensively on a real time basis and handles all the MaGIC control functions.

The rack unit uses an internal SCSI interface to communicate with outboard storage devices. This allows not only modification of the sound, but the ability to record and store musical signals for real time play back. The unit has a built in Echoplex™, plus the ability to store large programs to load from cheap hard media. Using the SCSI protocol allows the use of hard disks, ZIP drives, CD drives, etc. to minimize use of expensive RAM.

The other rack units include a power supply and other "high voltage" relays, etc. The power supply is preferably a switching supply that can be used throughout the world. The power outlets for the rack bays are connected to a transformer, which can be switched in or out to accommodate worldwide use even for these effects.

The Master Rack will nest on top of the Base Unit/Sub Woofer and will extend from the Base via microphone type locking extension rods. Thus, the unit can be raised to a level to be easily accessed and view by the performer/player.

A 48 VDC power bus will be provided. Modules stepping this down to common voltages for non-AC boxes will be available (i.e. 12 VDC, 9 VDC). This will eliminate ground loops and heavy wall plug power supplies.

3. The Power Stage (Simple Amplification);

The major effort in amplification of a signal deals with the power supply section, particularly when the amplification is at high levels. The MaGIC system devices use conventional switching power supplies to supply standard 48 VDC. This will address issues of certification in various countries, will allow the "amplifier" to work in any country around the world, reduce weight, insure safety and increase reliability and serviceability.

4. The Speakers (Sound Modifier, Create the Sound Envelope).

The speakers have both a digital MaGIC signal and 48 VDC power input. Optionally, the speaker can have a built in power supply and thus could take AC in.

The speaker cabinet can have a built in monitoring transducer that sends information back to the Master Rack via the MaGIC Link, allowing sophisticated feedback control algorithms. Thus, with adjustments digitally on the fly by the DSP amplifier, even poor speakers can be made to sound flat or contoured to suit personal taste.

Additionally, multi-speaker arrays can be used, where individual speakers are used per guitar string in a single cabinet, giving a more spacious sound.

5. The Cabinet (Esthetics and Durability);

By "packetizing" speaker cabinets, they can be made small and scalable. In other words, the can be stacked to get increased sound levels, or even better, distributed on stage, in the studio, or throughout the performance arena. Sophisticated panning and spatialization effects can be used even in live performance. The speakers can be UPS shippable, and plane worthy.

The Universal Control Surface

Figure 3:
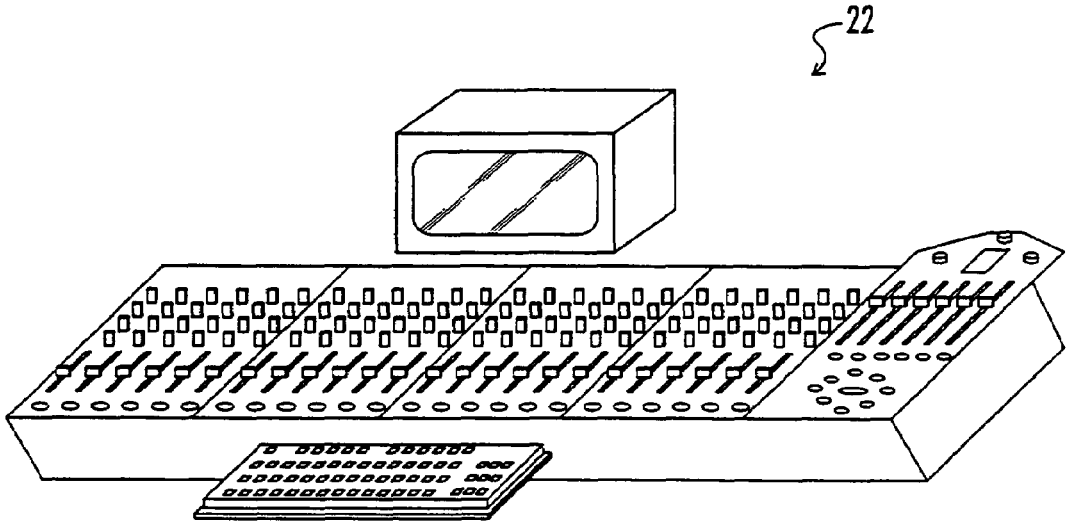
FIG. 3 is a front perspective view of a music editing control device usable in the system of this invention.

One embodiment of a universal control surface usable in the MaGIC system is shown in FIG. 3.

24 Slider Port Controls.

Each slider has LED's acting as VU meters (or reflecting other parameters) on the left of the slider. A single switch with an adjacent LED is at the bottom of the slider. Four rotary controls are at the top of each slider. Preferably, a full recording Jog Shuttle, recording type buttons, and "go to" buttons are included.

Standard control position templates can be printed or published that can be applied to the control surface for specific uses.

The control surface shown in FIG. 3 does not represent a true mixing console. The controls are simply reduced to a digital representation of the position of knobs, etc., and are then sent to a computer via USB, MIDI or MaGIC where any real work takes place, such as mixing, editing, etc. The control surface can connect via USB to a remote PC.

Thus, a system and method has been described that allows for the universal interconnection, communication and control of musical instruments and related audio components in the digital domain.

Digital Guitar in a Legacy System

The digital guitar 12 is also completely compatible with traditional analog equipment such as analog amplifiers, speakers, effects boxes etc. One route to use of the digital guitar 12 with analog equipment is to simply connect the traditional analog output from the guitar to the analog equipment. But it is also desirable to connect the digital output to the analog equipment in order to take advantage of the flexibility of manipulating the digital signals from the individual strings. This can be done via an interface device referred to herein as a digital guitar interface device, or breakout box, 102.

Figure 4:
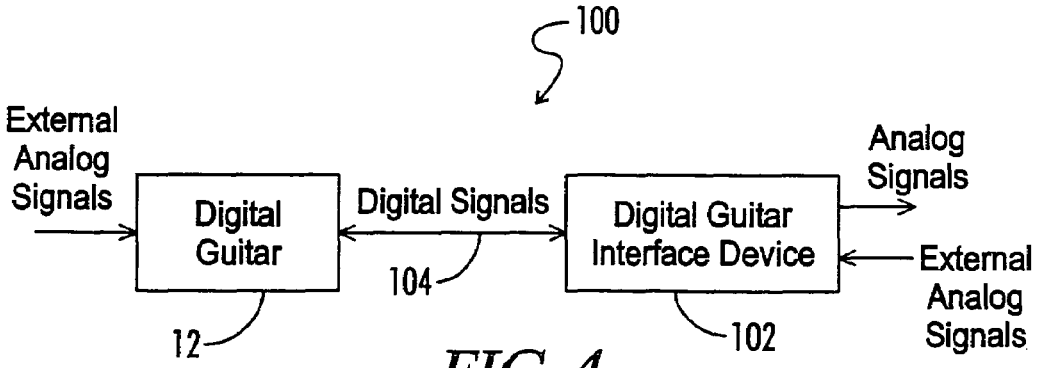
FIG. 4 is a block diagram showing the digital guitar and interface device of the present invention.

Referring to FIG. 4, the digital guitar system 100 of the present invention includes the digital guitar 12, discussed previously, and the digital guitar interface device 102. The guitar 12 is connected to the interface device 102 using a MaGIC connection cable 104. The guitar 12 is adapted to output a variety of different digital audio and control signals and the interface device 102 is adapted to convert the digital audio signals into analog audio signals and to use the digital control signals to control the analog outputs of the interface device 102. The guitar 12 is also adapted to receive both external digital and analog audio signals. The external digital audio signals are received from the interface device 102 and the external analog audio signals are received from any one of a variety of external audio devices, such as a microphone. The interface device 102 is also adapted to receive external analog audio signals from any one of a variety of external audio devices. In this case, however, the external analog audio signal may be from a CD player or a monitor mixer. Regardless of the source, the interface device 102 converts these external audio signals into the external digital audio signals that are sent to the guitar 12.

Figure 5:
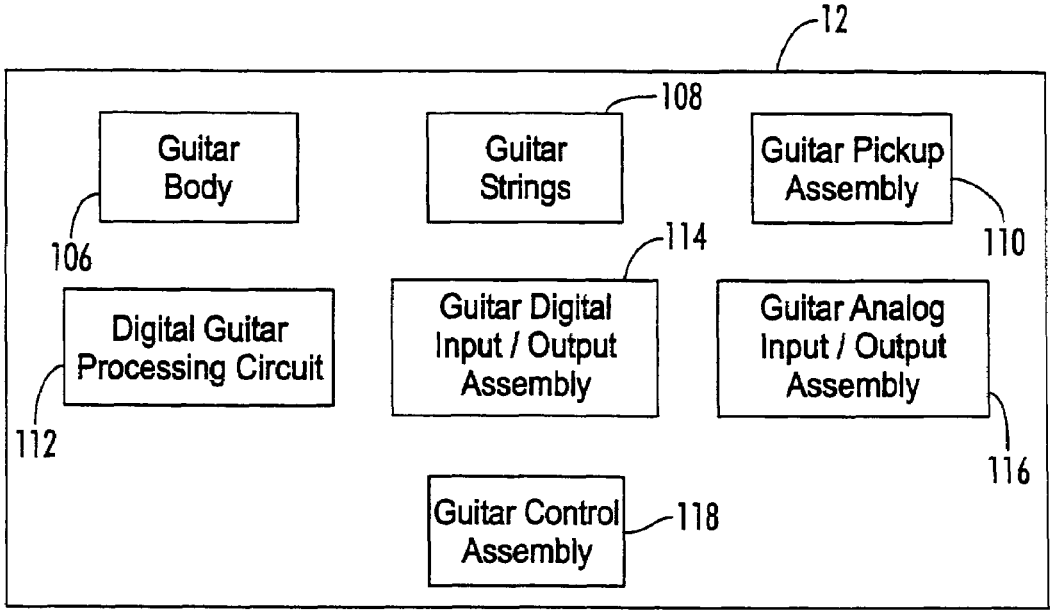
FIG. 5 is a block diagram showing the various components included in the digital guitar.
Figure 6:
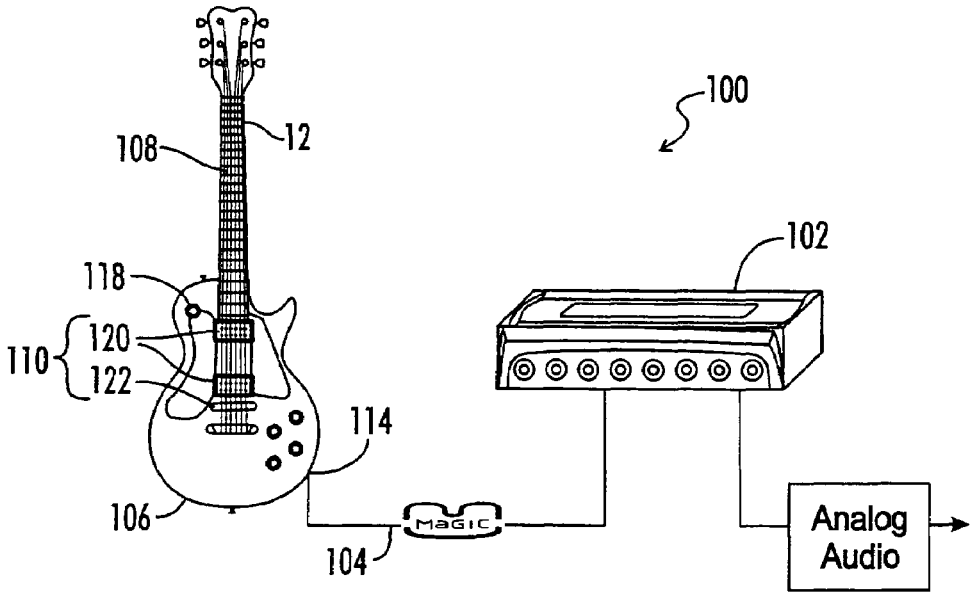
FIG. 6 shows schematically a digital guitar with a breakout box for use with a traditional analog amplifier and speaker components.

Referring to FIGS. 5 and 6, the digital guitar 12 (also referred to as the MaGIC guitar) includes a guitar body 106, six (6) guitar strings 108 mounted on the guitar body 106, a guitar pickup assembly 110, a digital guitar processing circuit 112, a guitar digital input/output assembly 114, a guitar analog input/output assembly 116, and a guitar control assembly 118. The guitar pickup assembly 110 includes two humbucker guitar pickups 120 adapted to generate two (2) analog humbucker string signals. The guitar pickup assembly 110 also includes a novel multi-signal hexaphonic guitar pickup 122 adapted to generate two analog mixed string signals for each of the six guitar strings 108 mounted on the guitar 12 and an analog noise signal representative of noise in the analog mixed string signals. Each analog mixed string signal is a signal that includes an x-plane signal component (i.e., an analog string signal representative of horizontal string vibrations relative to the guitar body) and analog y-plane signal component (i.e., an analog string signal representative of vertical string vibrations relative to the guitar body). In addition, each pair of analog mixed string signals for a particular string includes inverted x-plane signal components. In other words, the analog mixed string signals in each pair include x-plane signal components that have inverted, or opposite, polarities.

The MaGIC guitar 12 is 100% backward compatible with all traditional gear. The signal path from the 2 humbucker pickups 120, humbucker volume/tone control knobs 182 (FIG. 14), pickup selector switch 178 (FIG. 15), and ¼" output 186 (FIG. 15) is electrically identical to existing Gibson guitars. Physically, the traditional point-to-point wiring is replaced by a passive system inside the guitar digital processing circuit, or T2 module, 112 (FIG. 15).

The guitar 12 can be operated in two different modes: traditional and MaGIC. The traditional output is available regardless of whether there is a MaGIC connection.

The guitar pickup assembly 110 may vary from application to application. For example, in some embodiments, the pickup assembly 110 may only include a single monophonic guitar pickup. In others, the pickup assembly 110 may only include a polyphonic guitar pickup or one of the novel multi-signal guitar pickups 122. In short, any type of guitar pickup that generates one or more analog string signals can be used with the digital guitar 12 of the present invention.

Figure 7:
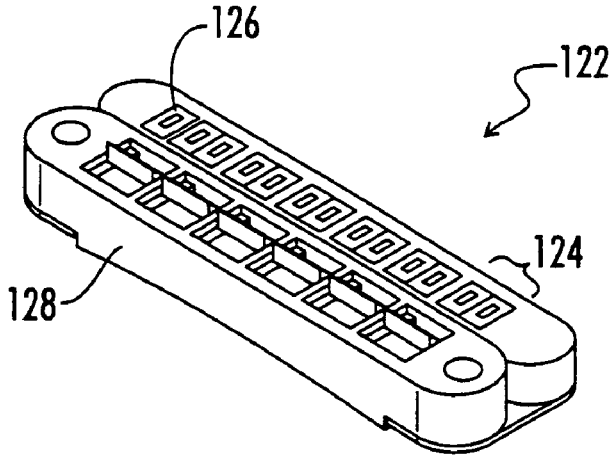
FIG. 7 is perspective view of the novel multi-signal hexaphonic guitar pickup of the present invention.
Figure 8:
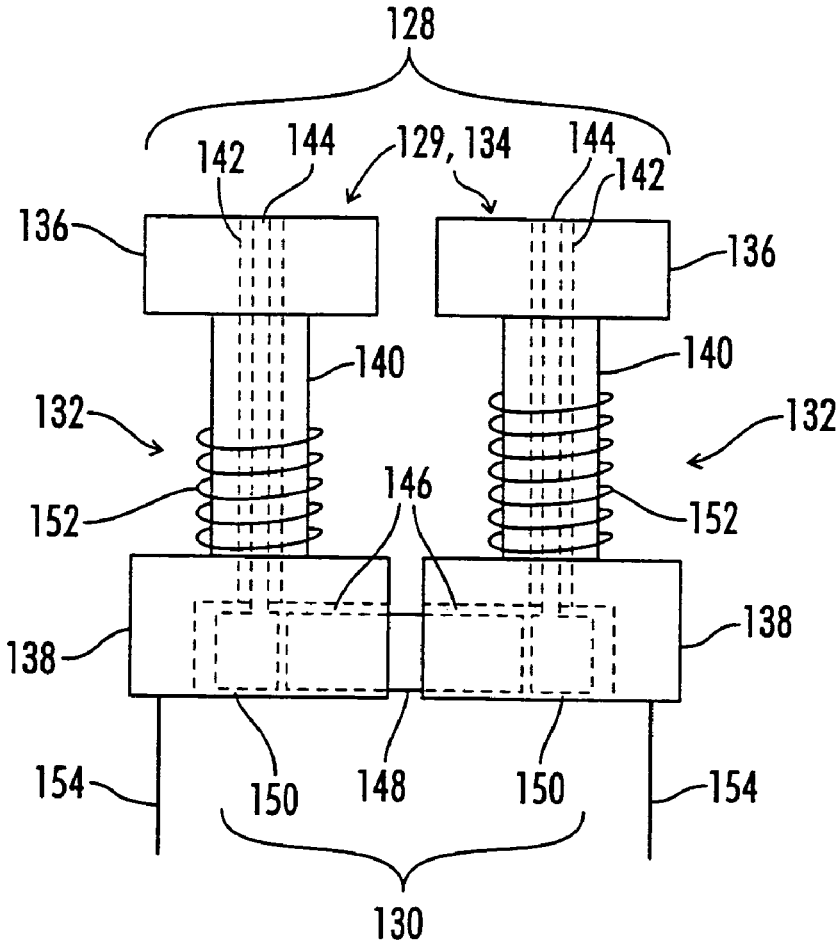
FIG. 8 is a front view of one of the novel guitar string pickup subassemblies of the present invention.

As shown in FIGS. 7-8, the novel multi-signal hexaphonic guitar pickup 122 is a 13 coil electromagnetic array and includes six (6) string pickup subassemblies 124 (i.e., electrical transducers) and one (1) noise pickup subassembly 126 mounted on a bridge 128. Each string pickup subassembly 124 includes a bobbin-shaped support structure 129, a magnetic assembly 130 inside the support structure 129, and a coil assembly 132 mounted on the support structure 129 so that the magnetic assembly passes through the coil assembly 132. The bobbin-shaped support structure 129 in each string pickup subassembly 124 includes two support structure subassemblies 134 that have identical shapes. Each support structure subassembly 134 includes a flanged top 136, a base 138, and a core 140 between the flanged top 136 and the base 138. Each core 140 includes a core opening 142 that is adapted to receive pole pieces 144 used with the magnetic assembly 130. Each base 138 includes a base opening 146 that allows the pole pieces 144 of the magnetic assembly 130 to be easily inserted into the cores 140 of the support structure subassemblies 134 and a magnet 148 used with the magnetic assembly 130 to be inserted into the bases 138 and into contact with the pole pieces 144. Each pole piece 144 is T-shaped and includes a flanged portion 150 on one end. Each coil assembly 132 includes two (2) coils 152, which are wrapped around the cores 140 of the support structure subassemblies 134 so that they pass around the pole pieces 144 of the magnetic assembly 130 and are out of phase with one another. Each coil assembly 132 also includes a four (4) pin output assembly 154 connected to the two (2) coils and mounted on the support structure subassemblies 134.

The hex pickup 122 is designed to have a 95 dB signal to noise ratio and 45 dB inter-string isolation built into the bridge. In addition, the bridge to body and string to body connections through the neck can be mechanically isolated. In certain applications, the use of the hex pickup 122 may require the addition of magnetic structure to the bridge of the guitar 12. The guitar 12 also may include internal shielding between the digital and analog sections.

For clarity, the coils 152 are shown only partially covering the cores 140 in FIG. 8. In practice, the coils 152 would completely cover the cores 140 and include thousands of turns as is well known in the art.

Each string pickup subassembly 124 is adapted to be positioned adjacent to a guitar string 108 on the digital guitar 12 and to generate a predetermined number of analog string signals in the coils when that string is strummed. The magnet assembly 130 generates two parallel magnetic fields (not shown) that extend a predetermined distance outward from the magnet 148, through the magnet pole pieces 144, through the cores 140 in the support structure subassemblies 134, and through the coils 152 wrapped around the cores 140. The distance that the magnetic fields extend outward from the magnet 148 may vary from application to application. In general, however, they should extend outward far enough that one of the magnetically permeable guitar strings 108 may be positioned in the magnetic fields and can vary the magnetic fields by vibrating when it is strummed. When each string pickup assembly 124 is properly positioned on the digital guitar 12 adjacent to a guitar string 108, the change in the magnetic fields caused by the vibrating guitar string generates mixed analog string signals in the coils 152.

The coils 152 wrapped around one core 140 are adapted to be connected to the digital guitar processing circuit 112 so that the mixed analog string signals generated by these coils are out of phase with the mixed analog string signals generated by the coils 152 wrapped around the other core 140.

The features of the string pickup subassembly 124 (also referred to simply as the novel audio transducer 124) may vary depending on a particular application. For example, in some embodiments, the audio transducer 124 includes only two coils 152 and is adapted to generate only two analog audio signals using these coils when a guitar string 108 is strummed. In other embodiments, the audio transducer 124 is adapted so that the coils 152 and magnet 148 are completely enclosed by the support structure 129. In still other embodiments, the support structure 129 is manufactured using plastic, the wire used to form the coils 152 has a gauge of 58 according to the American Wire Gauge standard, the pole pieces 144 are steel, and the magnet 148 is neodymium boron and generates a magnetic field strength of approximately 50 oersted. In yet another series of embodiments, the coil assemblies 132 are adapted to output the mixed analog string signals differentially in order to improve the signal to noise ratio of the signals, i.e., each coil 152 has two ends and both ends are used to output the mixed analog string signal associated with that coil.

The noise pickup subassembly 126 includes one of the bobbin-shaped support structures subassemblies 134 and one of the coil assemblies 132 used with the string pickup subassemblies 124. The noise pickup subassembly 126 does not include a magnetic assembly 130 like the string pickup subassemblies 124. The noise pickup subassembly 126 receives electrical and environmental noise from the air surrounding the pickup, i.e., low frequency planar waves that create the well known "hum" associated with conventional guitar pickups, and generates a noise signal that can be used to cancel out this noise in the analog string signals generated by the string pickup subassemblies 124.

Figure 9:
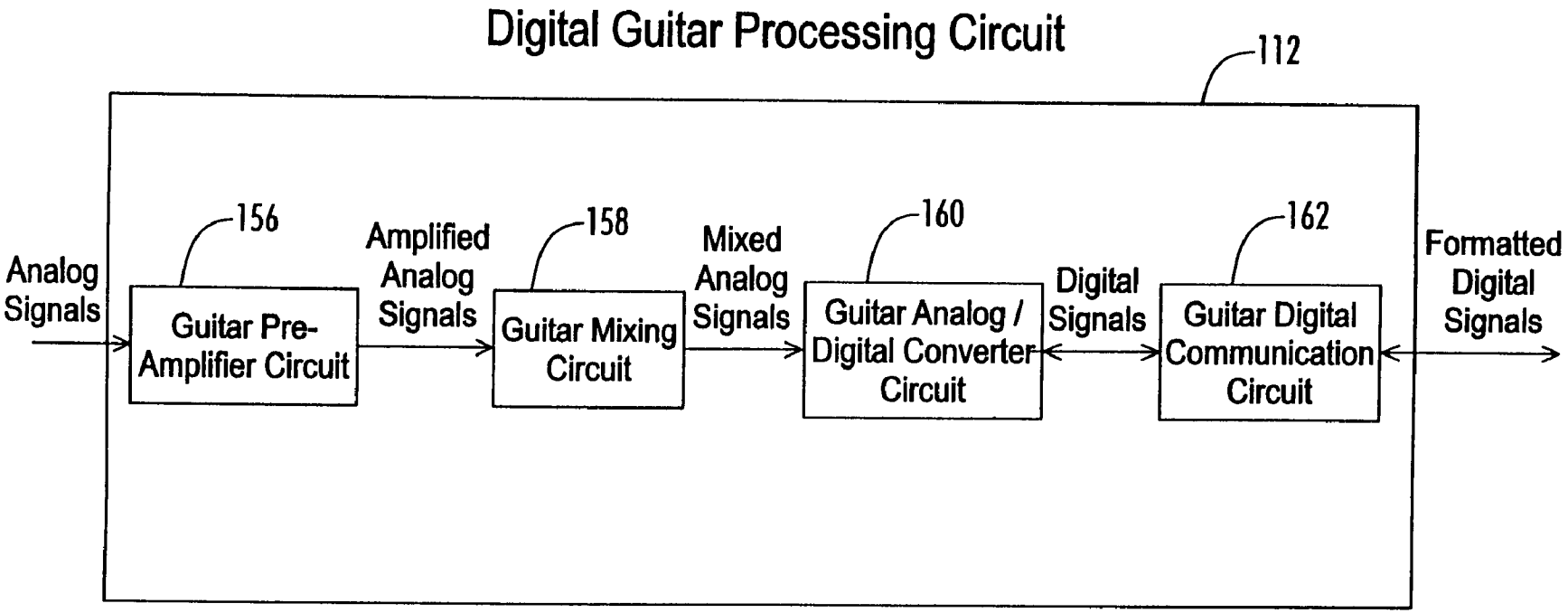
FIG. 9 is a block diagram of the digital guitar processing circuit of the present invention.

Referring to FIG. 9, the digital guitar processing circuit 112 includes a guitar preamplifier circuit 156, a guitar mixing circuit 158, an guitar analog/digital converter circuit 160, and a guitar digital communication circuit 162. The preamplifier circuit 156 is adapted to amplify the analog string signals generated by the humbucker 120 and multi-signal hexaphonic guitar pickups 122 to increase perceived sound quality. The preamplifier circuit 156 is also adapted to amplify an analog microphone signal and an analog headphone signal, both of which will be discussed in more detail below. Schematics showing one embodiment of the preamplifier circuit 156 of the present invention are shown in FIGS. 29-36.

The guitar mixing circuit 158 is adapted to combine the two analog mixed string signals for each string to generate the analog x-plane and y-plane string signal components for each string, and then to combine the x-plane and y-plane string signal components to generate a single analog combined string signal for each guitar string. The mixing circuit 158 includes a summing circuit 164, a subtracting circuit 166, and a combining circuit 168. The summing circuit 164 is adapted to generate an analog summed string signal for each string by summing the two analog mixed string signals for each string. The subtracting circuit 166 is adapted to generate an analog subtracted string signal for each string by subtracting the two analog mixed string signals for each string. The combining circuit 168 is adapted to combine the analog summed and subtracted string signals to generate the single analog combined string signal for each string.

The mixing circuit 158 may also optionally include a noise subtracting circuit 170 that is adapted to subtract the noise signal generated by the noise pickup subassembly 126 from the summed string signal before it is combined with the subtracted string signal.

Figure 10:
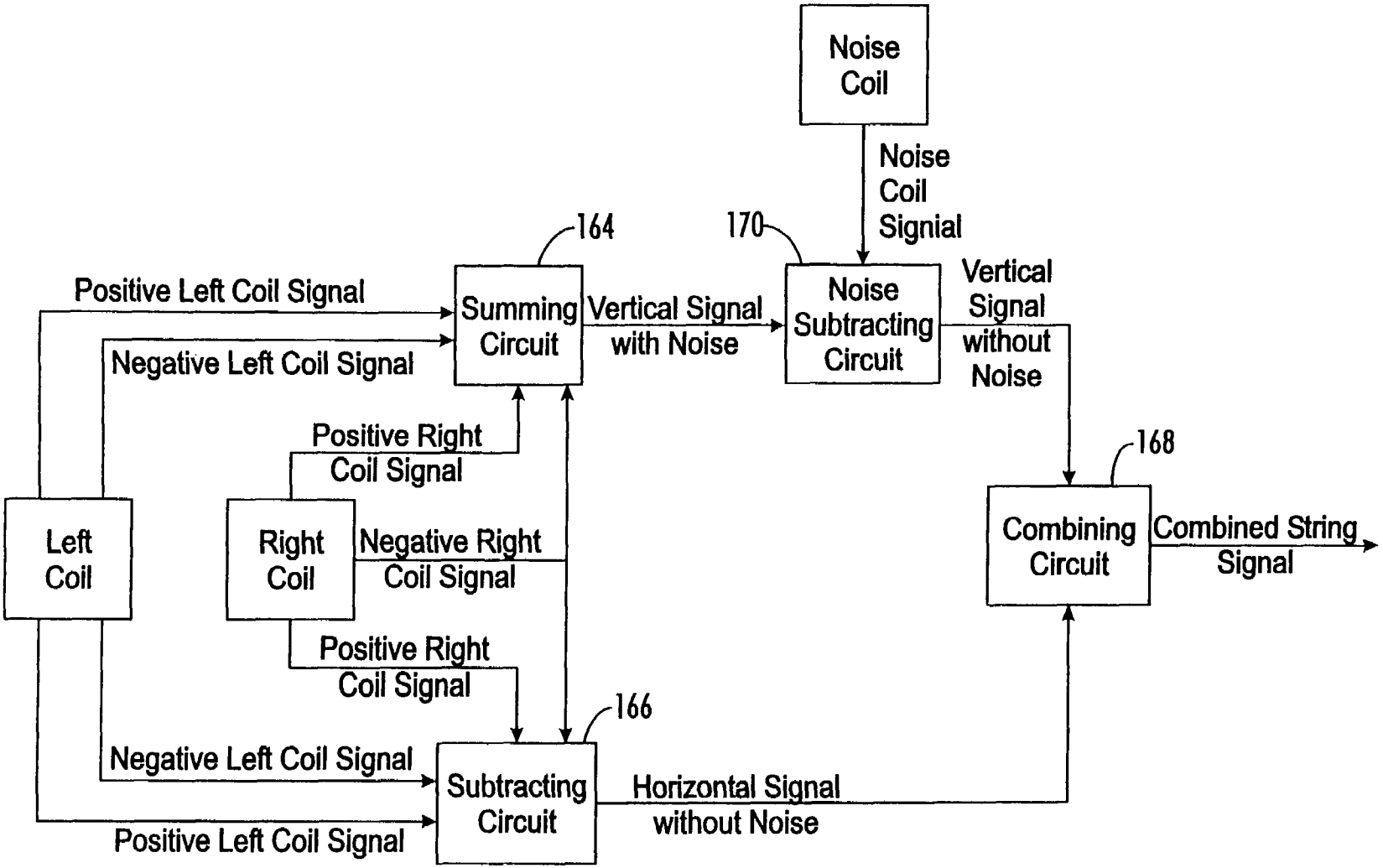
FIG. 10 is a block diagram showing one embodiment of the mixing circuit included in the digital guitar processing circuit.
Figure 11:
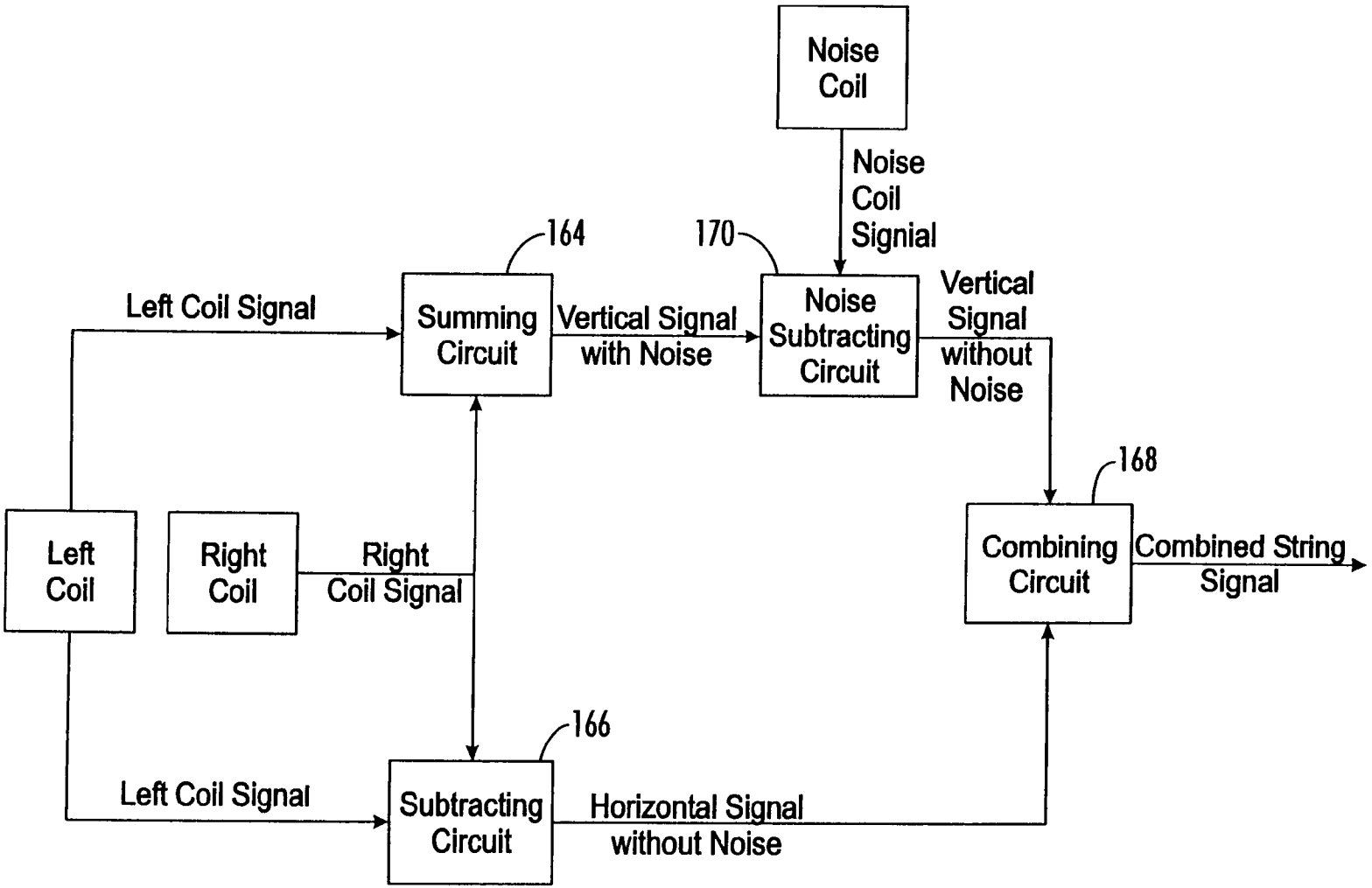
FIG. 11 is a block diagram showing a second embodiment of the mixing circuit included in the digital guitar processing circuit.

Two different implementations of the guitar mixing circuit 158 are shown in FIGS. 10 and 11. In FIG. 10, the mixing circuit 158 is shown with differential coil signal outputs, while in FIG. 11, the mixing circuit 158 is shown with single coil signal outputs. The use of differential outputs improves the signal to noise ratio of the mixed analog string signals generated by the coils 152, but either implementation may be used.

The guitar analog/digital converter circuit 160 converts one of the analog humbucker string signals (which is selected as indicated below), the analog microphone signal, and the analog combined string signals for each string into digital combined string signals. This produces six (6) digital combined string signals, one (1) digital humbucker string signal, and one (1) digital microphone signal. The analog/digital converter circuit 160 is further operable to convert a digital headphone signal (discussed in more detail below) into an analog headphone signal.

Figure 12:
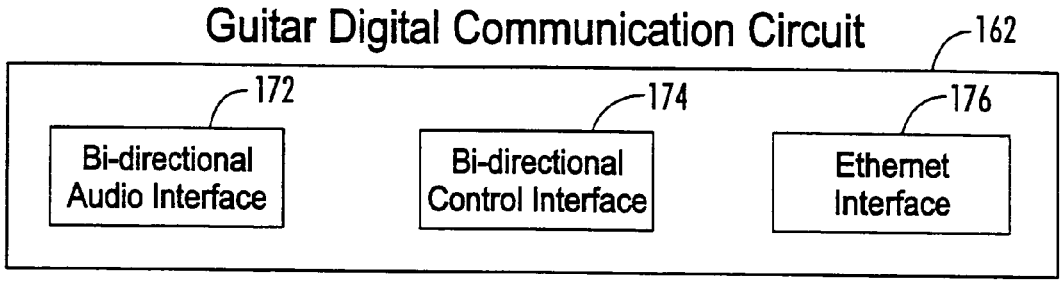
FIG. 12 is a block diagram showing one embodiment of the guitar digital communication circuit included in the digital guitar processing circuit.

The digital communication circuit 162 is operable to format all of the digital string signals generated by the analog/digital converter circuit 160, the digital microphone signal, and digital control signals, which will be discussed below, into a format that is compatible with the MaGIC digital communication protocol. Referring to FIG. 12, the digital communication circuit 162 includes a bi-directional audio interface 172, a bi-directional control interface 174, and an Ethernet interface 176. The bi-directional audio interface 172 is adapted to send and receive digital audio signals, such as the digital string and microphone signals, and the bi-directional control interface 174 is adapted to send and receive digital control signals. The Ethernet interface 174 is adapted to allow the digital communication circuit 162 to interface with an Ethernet physical layer, which forms part of the MaGIC digital communication system.

Figure 13:
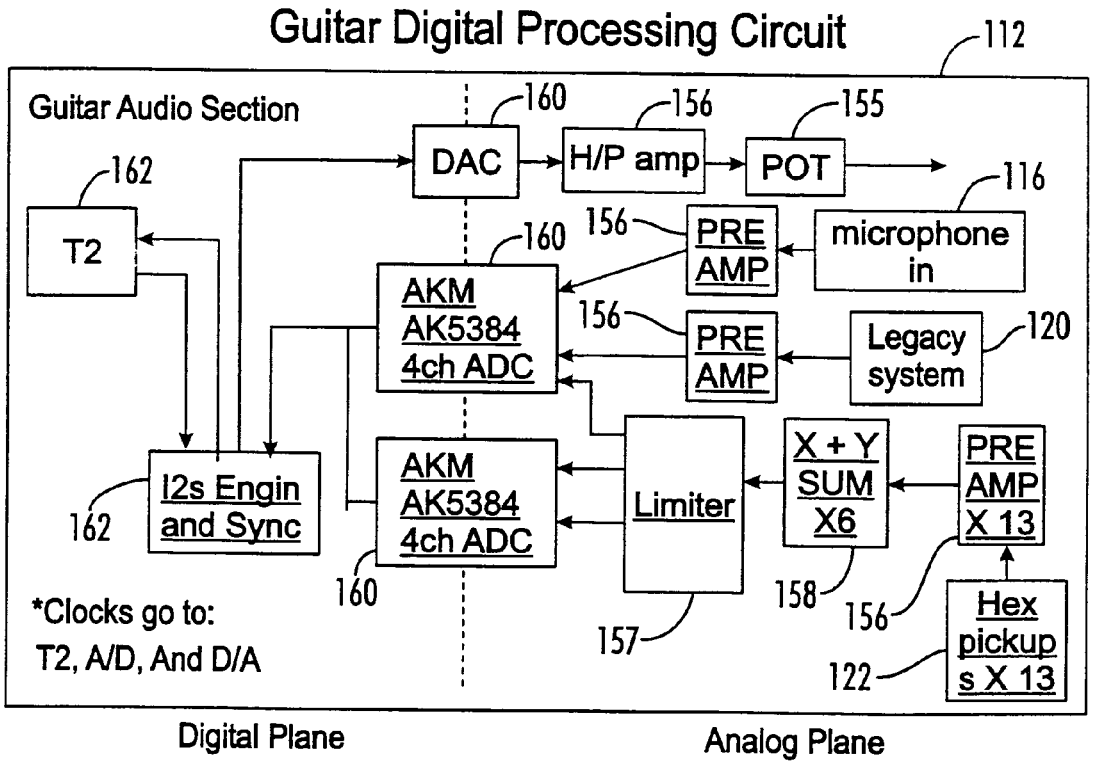
FIG. 13 is a block diagram showing one embodiment of the analog and digital sections of the digital guitar processing circuit.
Figure 16:
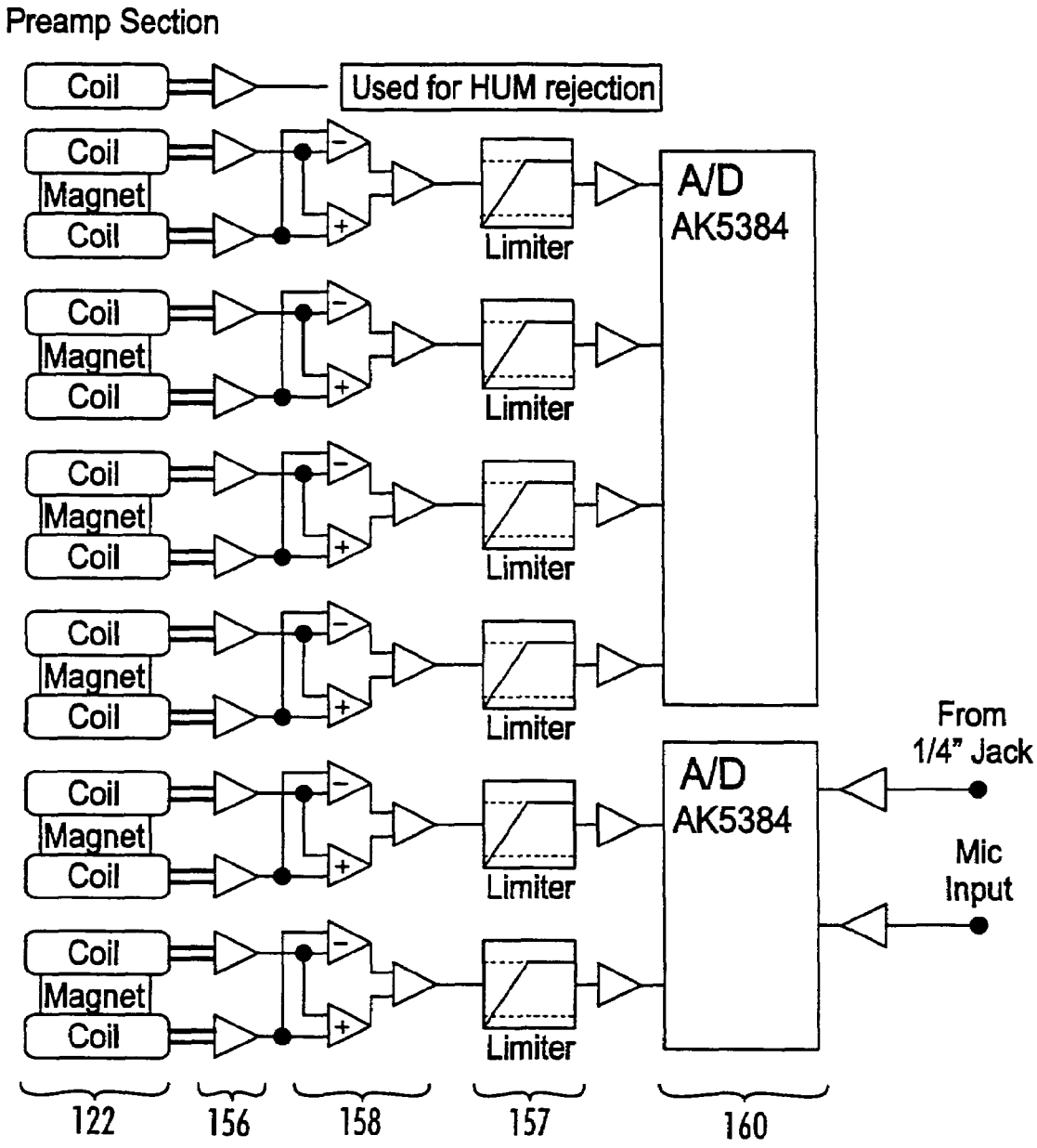
FIG. 16 is a block diagram of the preamp section of the analog section of the digital guitar T2 board.

One embodiment of the digital guitar processing circuit 112 is shown in FIG. 13 (see also, FIG. 16, which shows a similar embodiment of the circuit 112). In this embodiment, the guitar preamplifier circuit 156 is separated into a preamp (labeled preamp×13) for the 12 mixed analog string signals generated by the multi-signal pickup 122, a preamp (labeled simply preamp) for the humbucker pickup string signals, or legacy system string signals, a preamp (again labeled simply preamp) for the microphone signal, and a headphone preamp 156 for amplifying the analog headphone signal output by the DAC portion of the guitar analog/digital converter circuit 160. This embodiment also includes a potentiometer (Pot) 155, which is used to control the headphone signal volume, and limiter circuit 157, which is adapted to prevent any large analog audio signals generated by the multi-signal guitar pickup 122 from exceeding the design limits of the guitar analog/digital converter circuit 160. The guitar digital communication circuit 162 is shown including a T2 chip or module, and an I2s Engine and sync, both of which are used to process and format the digital audio signals generated by the guitar analog/digital converter circuit 160. Finally, the digital guitar processing circuit 112 is split into two sections: an analog section (or plane) 111 and a digital section 113, with the guitar analog/digital converter circuit 160 separating the two sections. Both the analog and digital sections can be combined onto a single circuit board.

As shown in FIG. 16, the outputs of the coils are fed into 13 preamps with differential inputs. Once sufficient signal conditioning is performed, the outputs of each pair of coils are added and subtracted from one another. The inverse of the 13th coil is applied to the added pairs to negate hum and noise. Both axes are combined to provide all possible harmonic content for processing on future products. Note that while there are 13 transducers, only 6 digital channels are actually digitized for later processing. In alternative embodiments, the signals from each axis may not be combined and can be digitized separately. In this case, 12 digital channels would be available for later processing.

Referring back to FIG. 5, the guitar digital input/output assembly 114 is adapted to output the digital string, microphone, and control signals to and receive a pair of digital audio signals from the digital guitar interface device 102. The guitar analog input/output assembly 116 is adapted to output one of the analog humbucker string signals selected using the guitar control assembly 118. The guitar analog input/output assembly 116 is also adapted to receive the analog microphone signal and to output the analog headphone signal. In one embodiment, the guitar digital input/output assembly 114 is a RJ-45 output port and is a MaGIC compatible output connector. The RJ-45 output 130 is a single bi-directional MaGIC Out port that provides six channels of digitized hex pickup output, 1 channel of digitized humbucker output, 1 channel of digitized microphone output, and two channels of digitized monitor mix input. The guitar 12 supports 24-bit audio at 48 and 96 kHz sample rates.

Figure 14:
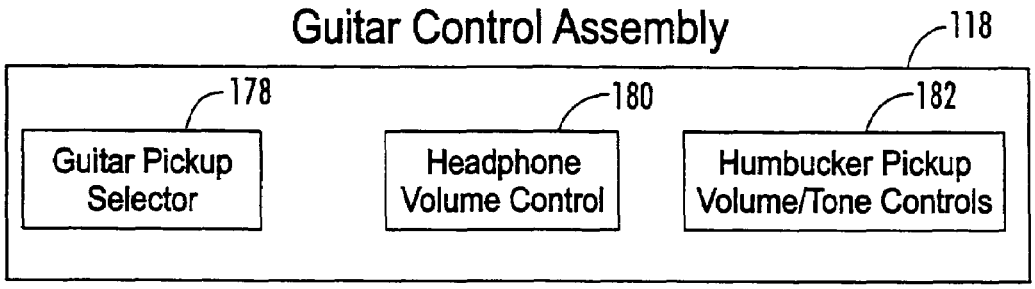
FIG. 14 is a block diagram showing the guitar control assembly of the present invention.
Figure 15:
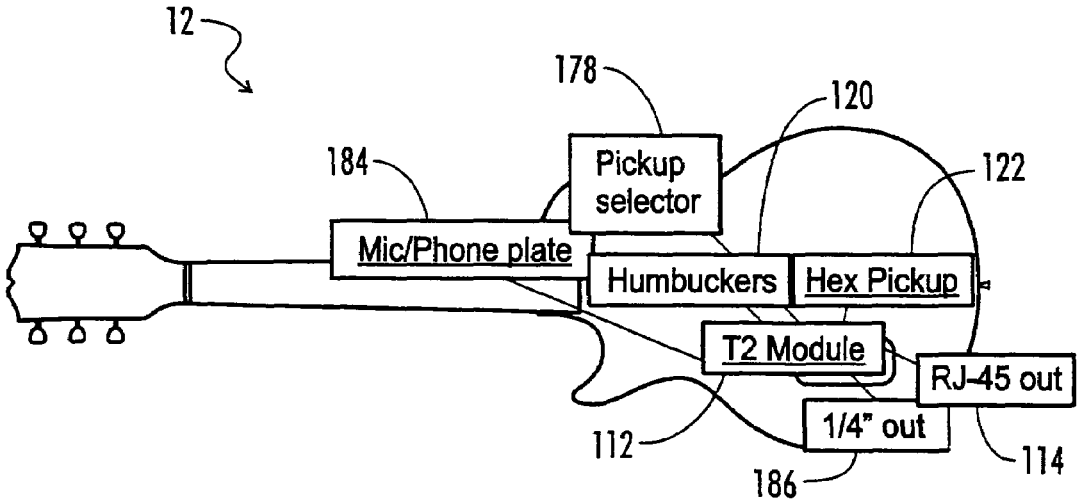
FIG. 15 illustrates schematically one embodiment of the digital guitar of the present invention.

Turning now to FIG. 14, the guitar control assembly 118 includes a guitar pickup selector 178, a headphone volume control 180, and two sets of humbucker guitar pickup volume and tone controls 182. The guitar pickup selector 178 is adapted to allow a user to select one of the humbucker guitar pickups 120 to be output on the guitar analog input/output assembly 116 and the headphone volume control 180 is adapted to control the volume of the analog headphone signal output. The humbucker guitar pickup volume and tone controls 182 are adapted to control the volume and tone of the humbucker guitar pickup outputs. The tone and volume knobs 182 include dual stacked potentiometers so they can simultaneously regulate analog output and generate MaGIC control packets. Each potentiometer includes an 8 bit analog to digital converter (ADC) that is used to sample the position of its associated knob. The digital data obtained from each potentiometer is then relayed to the digital guitar interface device 102, which is described in more detail below. This data may also be output to other digital devices as well.

One specific embodiment of the digital guitar 12 is shown in FIG. 15. In this embodiment, the guitar analog input/output assembly 116 has been split into two separate assemblies: a microphone/headphone assembly 184 and a ¼" output assembly 186. The microphone/headphone assembly 184 is adapted to receive the microphone audio signal and to output the headphone audio signal. The ¼" output assembly 186 is adapted to output one of the humbucker pickup string signals. In this figure, the digital guitar processing circuit 112 is referred to as a T2 module and the guitar digital input/output assembly 114 is implemented using an RJ-45 output connector. The headphone volume control 180 and humbucker guitar pickup volume and tone controls 182 are not shown in FIG. 15.

Figure 21A:
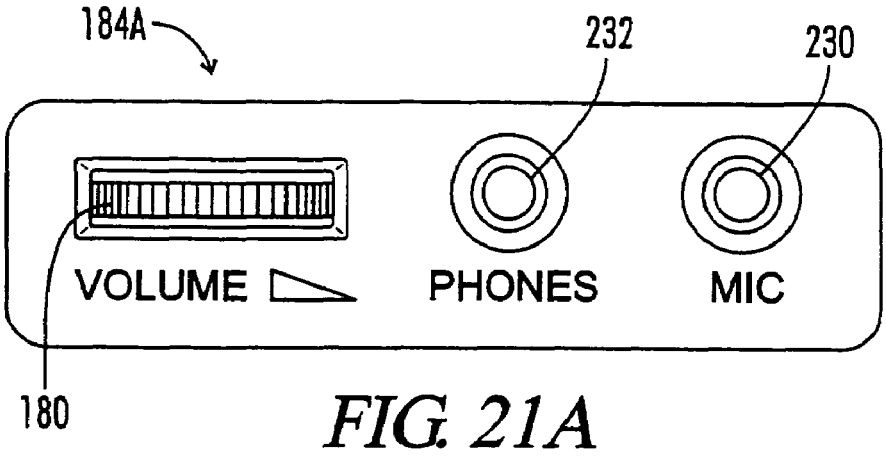
FIGS. 21 A and 21 B illustrate two alternative arrangements of the headphone and microphone connections on the digital guitar.
FIG. 21C illustrates an alternative arrangement for the headphone, microphone, and MaGIC connections on the digital guitar.
Figure 21B:
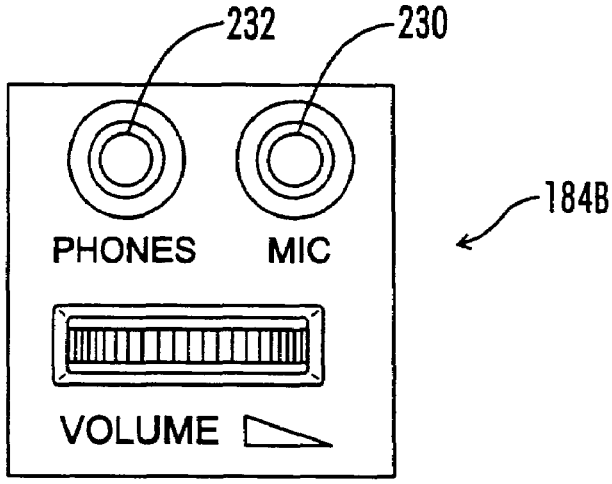
Figure 21C:
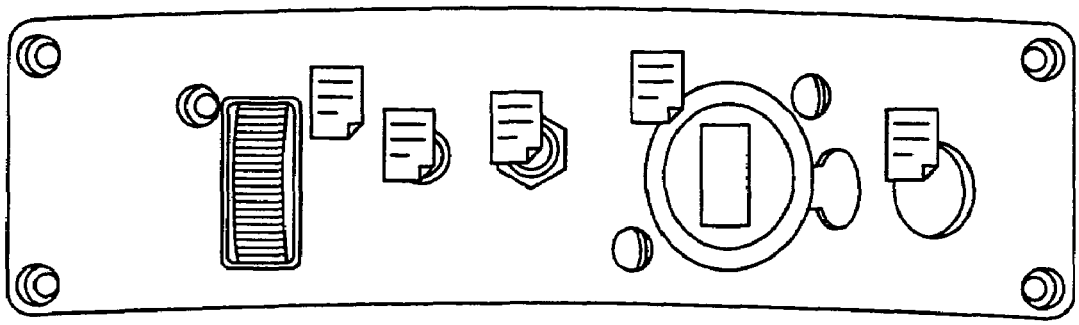

In another specific embodiment, shown in FIGS. 21A and 21B, the microphone/headphone (plate) assembly 184 includes a microphone input 230, a headphone output 232, and the headphone volume control 180, which is included for safety reasons. Two alternative versions of the microphone/headphone assembly 184, 184A and 184B, are also shown in FIGS. 21A and 21B. As shown, the assembly 184 may be in a side by side configuration or it may be in a stacked configuration. In addition, the assembly 184 may be located on the same panel as the RJ-45 output (digital input/output assembly 114) and the ¼" output assembly 186 (see FIG. 21C), on the side of the guitar, on the top of the guitar, hidden in the guitar so that it can be flipped out with a soft spring, or located in the strap shaft.

When the RJ-45 output port 130 is connected to a MaGIC network, power is applied to the active and digital electronics of the guitar 12 and analog signals from the hex pickup 122, the traditional ¼" output 186, and the microphone input 230 are all digitized and sent over the MaGIC connection cable 104. Regardless of whether the guitar 12 is connected to a MaGIC network, the ¼" output 186 operates in a conventional manner.

Figure 17:
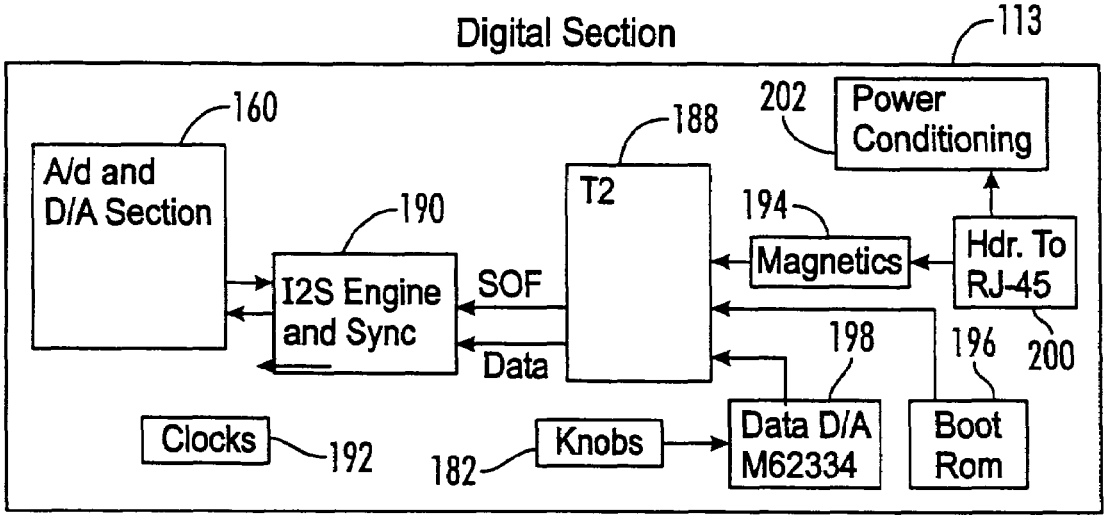
FIG. 17 is a block diagram of the digital section of the T2 board in the digital guitar.
Figure 18:
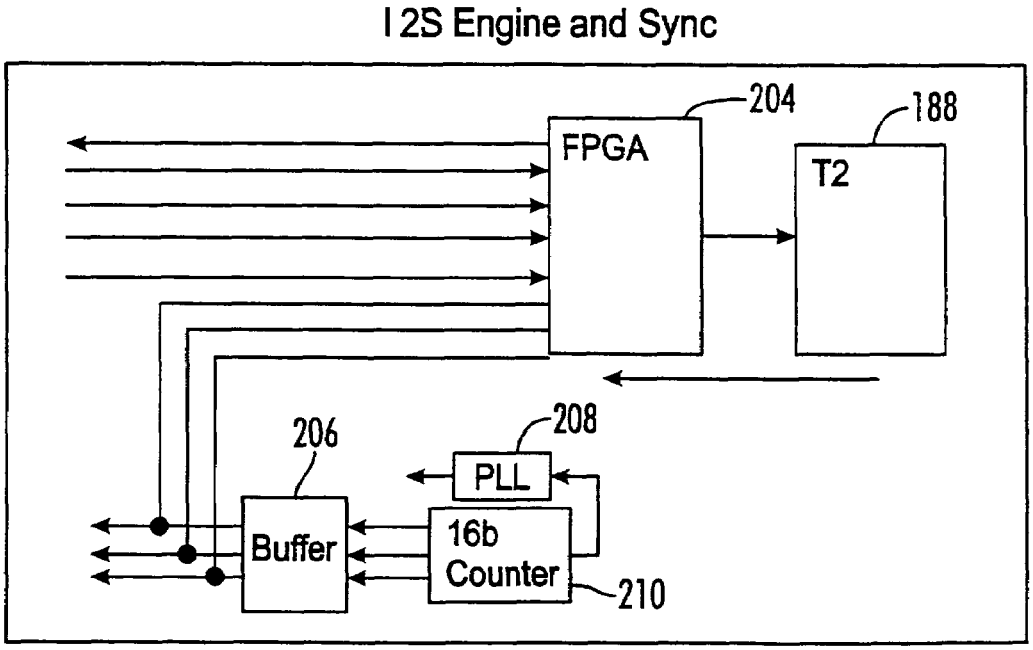
FIG. 18 is a block diagram of one implementation of the I2S Engine and Sync portion of the T2 board using a field programmable gate array.

FIGS. 17 and 18 show one particular embodiment of the digital guitar processing circuit 112, and more specifically, the digital section 113 of that circuit. As shown in FIG. 17, the digital section 113 includes a T2 chip 188, an I2S Engine and Sync 190, clocks 192, magnetics 194, boot ROM 196, an analog to digital converter 198 to convert the analog control signals generated by the humbucker volume/tone controls 182 into digital control signals, a header 200 for the RJ-45 connector, and a power conditioning circuit 202. FIG. 18 shows one specific implementation where the I2S Engine and Sync 190 is implemented using a field programmable gate array (FPGA) 204, a buffer 206, a phase locked loop 208, and a 16 bit counter 210. As mentioned previously, a detailed discussion of the operation of these components can be found in the MaGIC engineering specification and the '169 patent. In brief, however, it is sufficient to note that these components are responsible for formatting and outputting the digital audio and control signals generated by the digital guitar processing circuit 112. It also should be noted that the functions performed by these components may be implemented using other types of logic circuits as well.

The T2 module 112 is a single MaGIC OUT port device, and is therefore by definition always a sync slave device. It is powered by 802.3af over Ethernet power to ensure MaGIC compliance and supplies 8 output channels and accepts 2 input channels in $I^2S$ format audio. It includes a unique programmable MaGIC address and can store programmable parameters for different applications and manufacturers.

To ensure that the digital guitar is compatible with existing guitar equipment, the present invention includes the digital guitar interface device 102 (also referred to as the legacy box 102), which is adapted to convert digital audio signals output by the digital guitar into analog audio signals that are compatible with various types of conventional guitar equipment. In other words, it is a simple converter box that can be used to connect MaGIC compatible devices to traditional analog devices. It includes a single circuit board, which is a T2 module that is a variation of the T2 module (or digital guitar processing circuit) 112 used in the MaGIC guitar 12.

Figure 19:
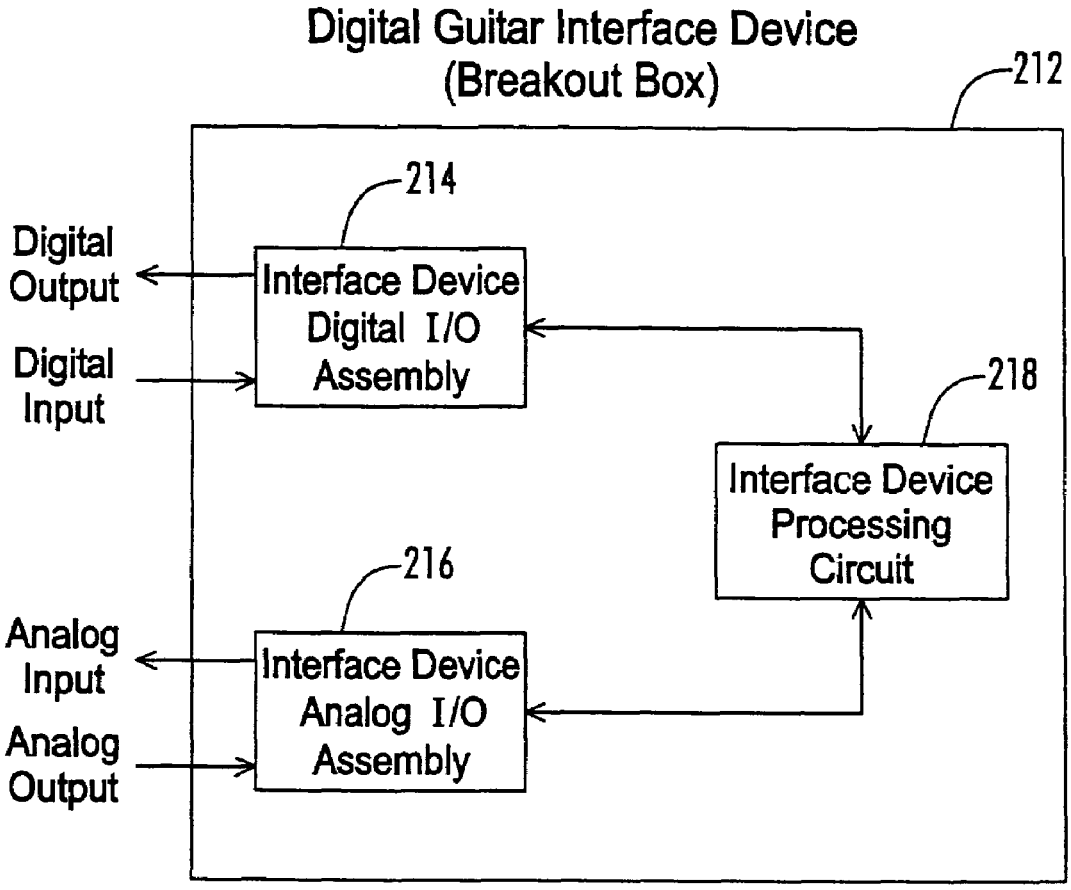
FIG. 19 is a block diagram showing the digital guitar interface device of the present invention.
Figure 22A:
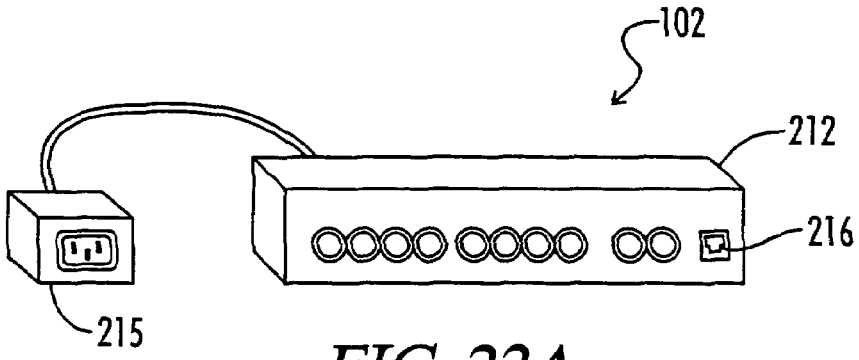
FIGS. 22A and 22B show two alternative arrangements for the breakout box.
Figure 22B:
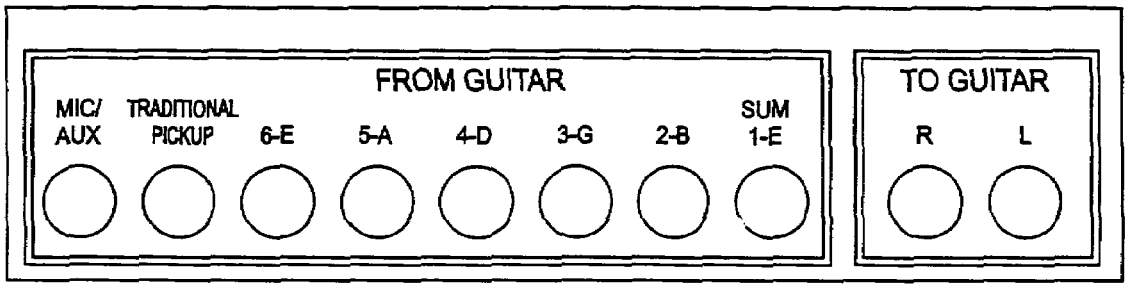

Looking at FIGS. 19 and 22A, the digital guitar interface device 102 includes a housing 212, an interface device digital input/output assembly 214, an interface device analog input/output assembly 216, and an interface device processing circuit 218. The housing 212 includes indicator lights that indicate when power is applied to the interface device and when audio signals are present on the inputs and outputs of the interface device. The housing 212 also provides support for the various input and output assemblies. Power is supplied to the breakout box 114 using a "line lump" style switching power supply and enters the unit using a DC style plug 215. The plug should be smaller than a standard AC adaptor to avoid under powering the unit by connecting other Original Equipment Manufacturer (OEM) AC adaptors. The power supplied is greater than or equal to 48 Volts DC and greater than or equal to 0.40 Amps. An alternative embodiment of the digital guitar interface device 102 is shown in FIG. 22B.

The interface device digital input/output assembly 214 is adapted to receive digital combined string, microphone, and control signals from, and output a pair of digital audio signals from an external audio device, such as a CD player, to the digital guitar 12. The interface device analog input/output assembly 216 is adapted to output six (6) analog combined string signals, one of the analog humbucker string signals selected using the guitar control assembly 118, and an analog microphone signal. The interface device analog input/output assembly 214 is also adapted to receive a pair of analog audio signals from the external audio device, i.e., the CD player, and the interface device processing circuit 218 is adapted to convert these analog signals into the pair of digital audio signals that are sent to the digital guitar 12.

Figure 20:
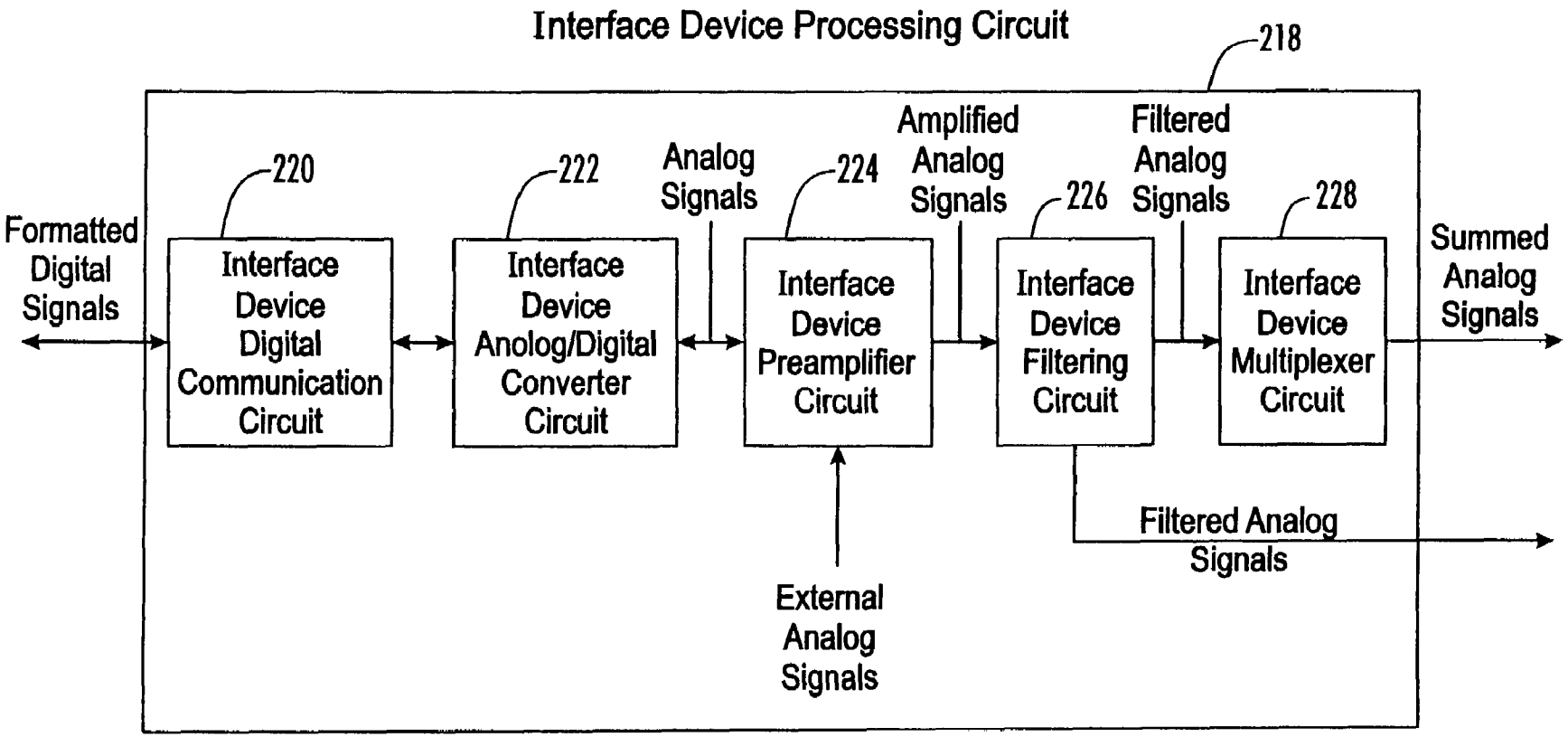
FIG. 20 is a block diagram showing one embodiment of the interface device processing circuit.

Moving to FIG. 20, the interface device processing circuit 218 is similar to the digital guitar processing circuit 112 and is adapted to convert received digital signals into analog signals and to convert received analog signals into digital signals. The interface device processing circuit 218 includes an interface device digital communication circuit 220, an interface device analog/digital converter circuit 222, an interface device preamplifier circuit 224, an interface device filtering circuit 226, and an interface device multiplexer circuit 228.

The interface device digital communication circuit 220 is operable to receive the digital combined string and microphone signals generated by the digital guitar and to pass those signals to the interface device analog/digital converter circuit 222 for conversion into analog signals. The communication circuit 220 also receives the digital control signals output by the digital guitar, but does not pass those signals to the converter circuit 222 for conversion into analog signals. Instead, the communication circuit 220 uses those control signals to control the analog outputs of the interface device 102. As was the case with the guitar digital communication circuit 162, the digital communication circuit 220 in the interface device includes a bi-directional audio interface 172, a bi-directional control interface 174, and an Ethernet interface 176 (see FIG. 12). For convenience, both the circuits have been shown in a single figure. In practice, however, these circuits would be physically located in two different devices, i.e., the digital guitar 12 and the interface device 102. As before, the bi-directional audio interface 172 is adapted to send and receive digital audio signals, such as the digital combined string and microphone signals, and the bi-directional control interface 174 is adapted to send and receive digital control signals. The Ethernet interface 176 is adapted to allow the digital communication circuit to interface with an Ethernet physical layer, which forms part of the MaGIC digital communication system discussed previously.

The interface device analog/digital converter circuit 222 converts the digital humbucker string signal, the digital microphone signal, and the digital combined string signals for each string into analog string signals. This produces six (6) analog combined string signals, one (1) analog humbucker string signal, and one (1) analog microphone signal. The analog/digital converter circuit 222 is further operable to convert the analog external audio signals into the digital external audio signals that are sent to the digital guitar 12.

The interface device preamplifier circuit 224 is adapted to amplify the analog combined string, humbucker string, and microphone signals generated by the interface device analog/digital converter circuit 222. The preamplifier circuit 224 is also adapted to amplify the analog external device audio signals prior to their conversion into digital signals by the interface device analog/digital converter device 222. The interface device filtering circuit 226 is adapted to filter out undesirable frequencies in the analog combined string, humbucker string, and microphone signals that may be generated during the digital to analog conversion process prior to their output. The interface device multiplexer 228 is adapted to output each of the combined analog string signals individually, combined into a single analog 6-string combined signal, and combined into a single analog 3-string combined signal, which includes the lower three (3) string signals.

Figure 23:
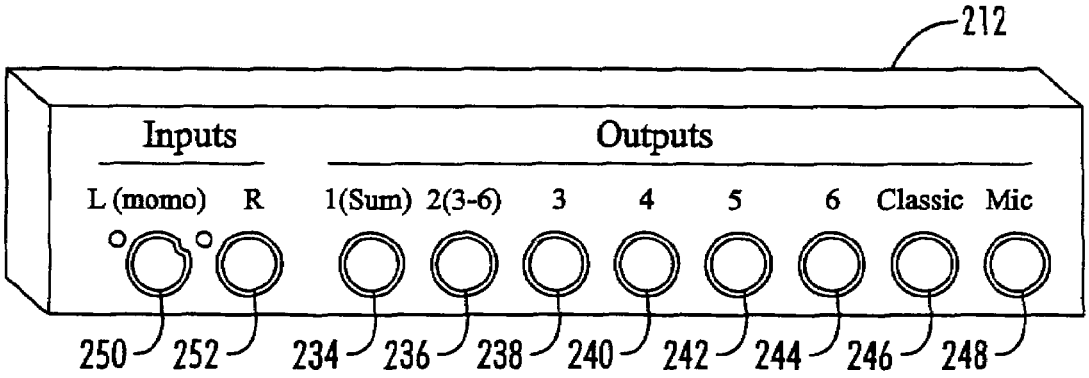
FIG. 23 shows the details of the connections to the breakout box.

Turning now to FIG. 23, there are 10¼" tip-ring-sleeve (TRS) connectors on one side of the breakout box 102. Eight of these connectors, 234, 236, 238, 240, 242, 244, 246, and 248 are outputs, and two are inputs, 250 and 252. There is also an RJ-45 input connector 216 (FIG. 22A) that can be used to connect the breakout box 102 to a MaGIC compatible device. In alterative embodiments, when the breakout box 102 is powered, it illuminates its top panel to indicate that power is on. When the unit is connected to a MaGIC output port, there is feedback to the user that a positive MaGIC link has been established.

Figure 24:
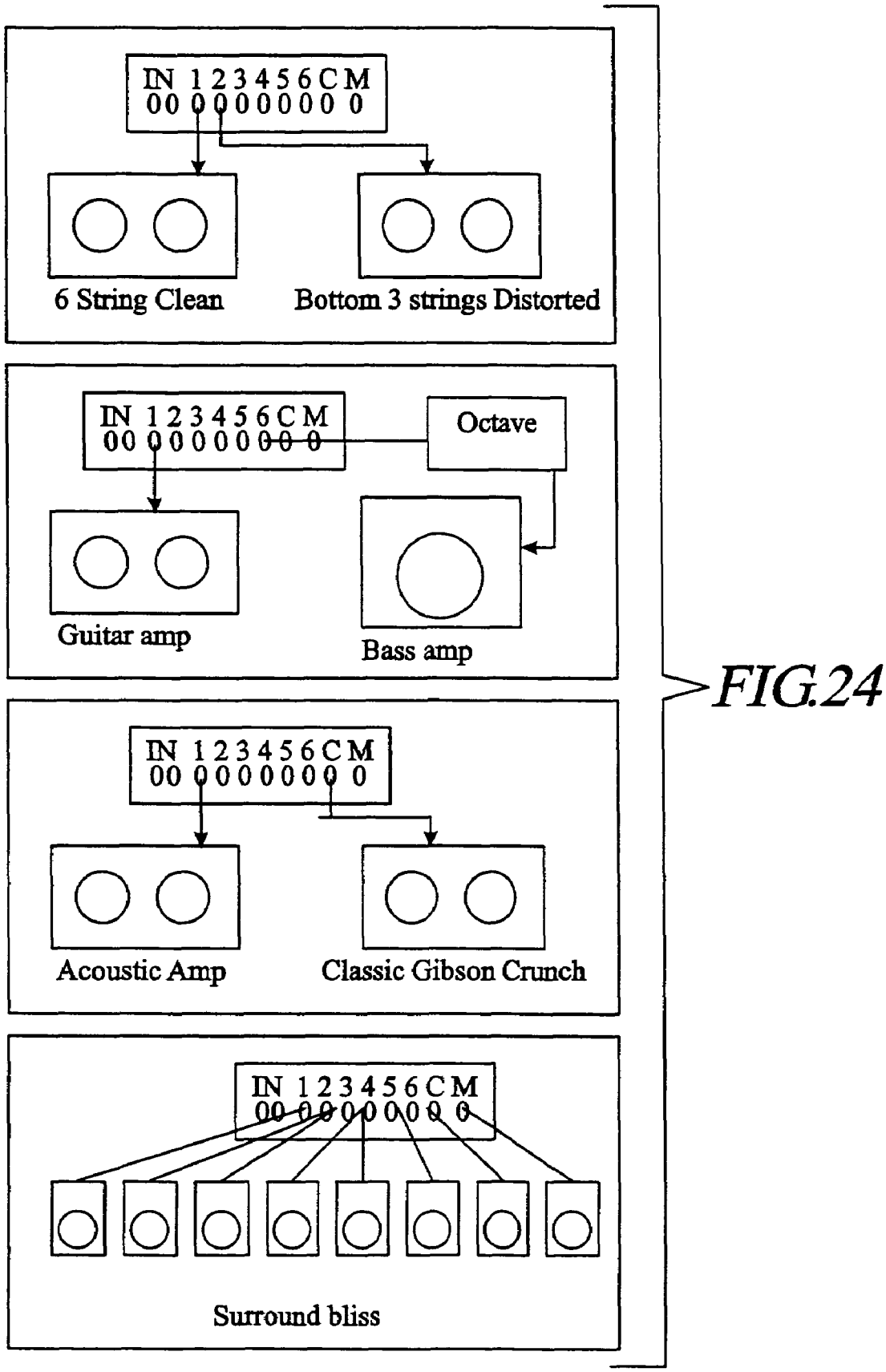
FIG. 24 illustrates schematically four alternative arrangements for connecting equipment to the breakout box.

Classic output, or humbucker output, 246 and microphone output 248 are always independent outputs from the humbuckers 120 and the microphone on the guitar 12, respectively. In other words, the classic output 246 is simply the output of one of the humbuckers 120 (as determined by the pickup selector switch 178) that has been converted into a digital signal, passed over the MaGIC data link, and then converted back into an analog signal. The microphone output 248 is processed in a similar manner. The hex pickup outputs, 234-244, operate in a different manner. When a single ¼" connector is connected to the #1(Sum) output 234, all 6 strings are filtered, summed, and output out of the #1 output 234. When output 234 and the #2(3-6) output 236 are connected to ¼" connectors, the sum of all 6 strings will come out of output 234 and the sum of the lowest 3 strings will come out of output 236. In either mode, outputs 240, 242, and 244, i.e., outputs 4, 5, and 6, respectively, output discretely their respective strings. When a ¼" connector is connected to output #3, 238, the outputs are discrete from each string, i.e., filtered but not summed. FIG. 24 shows four different possible output configurations for the breakout box 102.

All filtering referenced above takes place in the analog domain (although digital filtering may be used as well). This filtering is required because the sound captured by the hex pickup 122 is the raw string stimulus in both the X and Y-axis. While this provides flat and complete sound content, the sound is unlike traditional electric guitar sounds.

Also, since the purpose of the breakout box 102 is to interface into legacy amplification devices, the tone is shaped to provide a pleasing tone that is more pure than standard humbucker pickups. The user of the breakout box 102 can choose to output the standard humbucker, the summed hex, individual strings, or combinations of signals to provide the tone desired.

If none of the breakout box 102 outputs are connected to a ¼" connector, the summed output is looped back up the MaGIC cable 104 to the headphone output 232 on the guitar 12. The user of the breakout box 102 can choose to plug a CD player into the inputs, 250 and 252, on the breakout box 102 and play along in the headphone mix.

The breakout box 102 also includes the following programmed MaGIC components:

| Name | Type | Control Type | Address | Value | Default Links |
|---|---|---|---|---|---|
| Master Volume | Target | Scale | To be determined | 8-bit value between 0-255 | To be determined |

Figure 25:
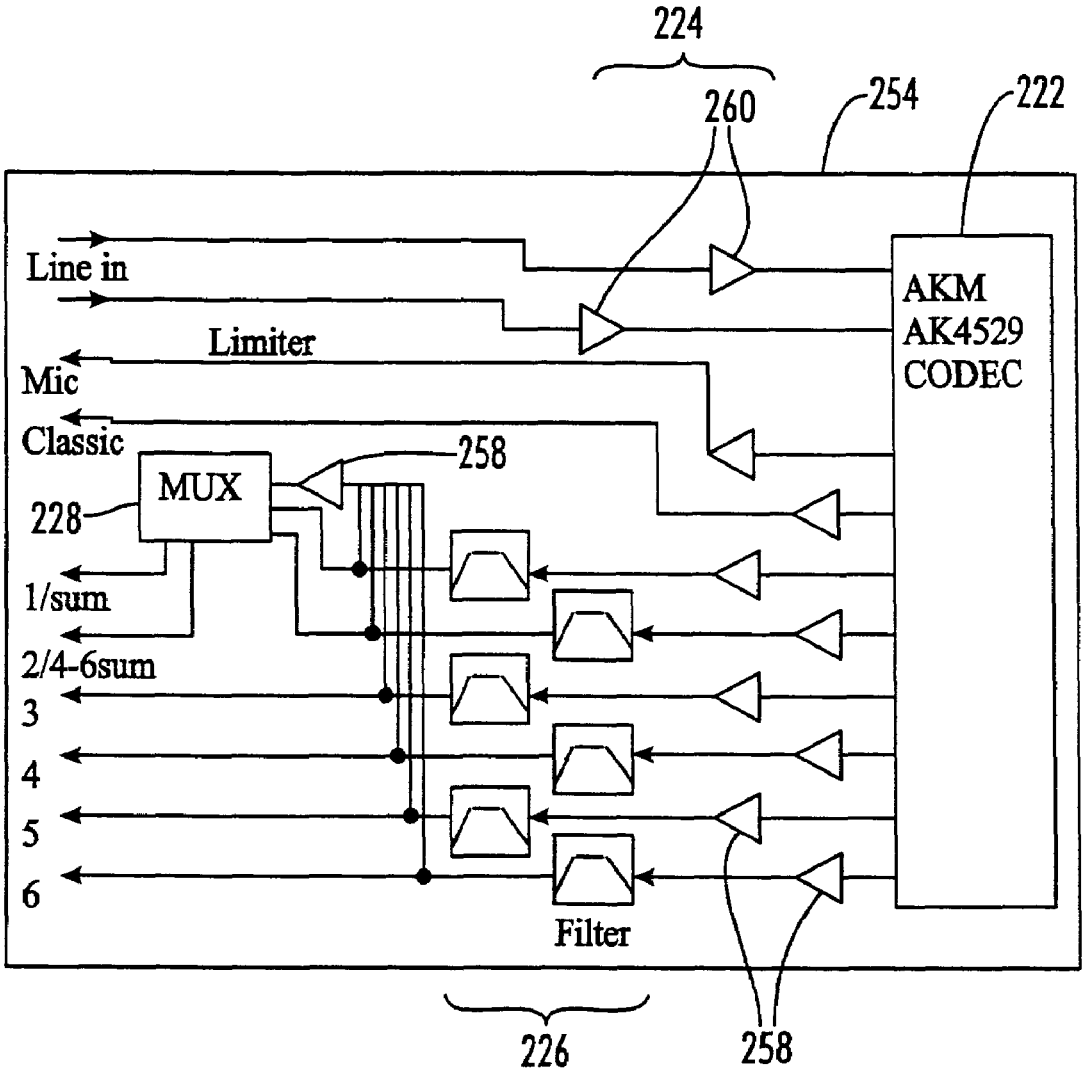
FIG. 25 is a schematic illustration of the analog section of the T2 module in the breakout box.
Figure 26:
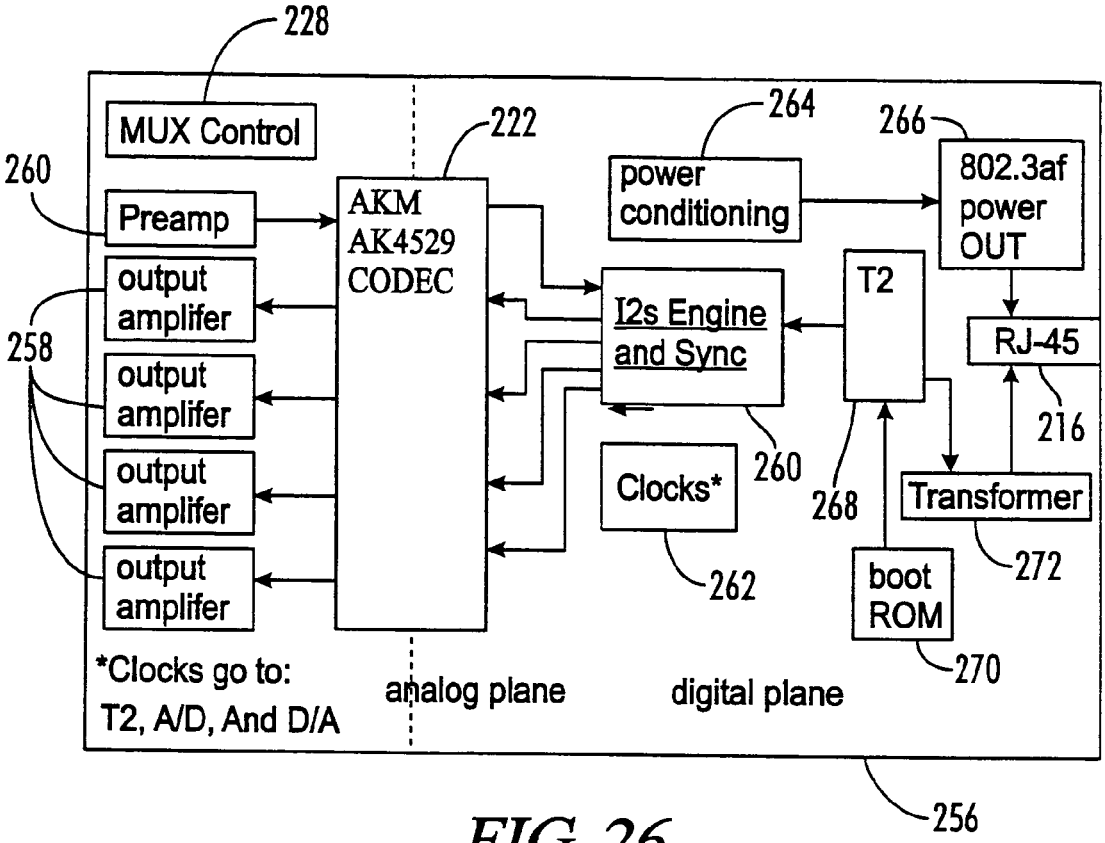
FIG. 26 is a schematic illustration of the digital section of the T2 module in the breakout box.

FIGS. 25 and 26 show one particular embodiment of the interface device processing circuit 218 (or T2 module) discussed previously. The processing circuit 218 includes an analog section 254 and a digital section 256. As shown in FIG. 25, the analog section 254 includes the interface device analog/digital converter circuit 222, which is a CODEC chip in FIG. 25 that includes a two channel analog to digital converter and an 8 channel digital to analog converter, a series of output amplifiers 258, a series of output filters 226 (i.e., interface device filtering circuit 226), the multiplexer circuit 228, and two input amplifiers 260. The output amplifiers 258 and input amplifiers 260 collectively form the interface device preamplifier circuit 224. The inputs of the CODEC 222 are connected to the outputs of the input amplifiers 260. The outputs of the CODEC 222 are connected to the output amplifiers 258 and the outputs of the output amplifiers 258 are connected to the output filters 226. Multiplexing control is provided by normalization switched on the TRS ¼" inputs and outputs. In one embodiment, the CODEC chip is an AK4529 chip.

The digital section 256 includes an I2s Engine and Sync 260, clocks 262, a power conditioning circuit 264, an 802.3af power controller 266, a T2 chip 268, boot ROM 270, a transformer 272, and the RJ-45 input port 216, all connected as shown in FIG. 26. These components are operable to communicate with the digital guitar 12 and to transmit and receive digital audio and control data from the digital guitar 12. The operation of these components is described in the MaGIC Engineering Specification and Patent referenced above and will not be repeated here.

Power is provided by the 48 Volt power supply and is regulated down to +12 Volts DC, +5 Volts DC, +3.3 Volts DC, +2.5 Volts DC, −12 Volts DC, and +48 Volt DC compliant with the 802.3af Power over Ethernet specification.

Referring back to FIGS. 14 and 15 (see also FIG. 28), traditional signals pass from the pickups 120 into a T2 chip located on the T2 module 112 in the guitar 12, from the pickups 120 to the volume/tone knobs 182, out to the pickup selector switch 178, back to the knobs 182 and filter caps (not shown), and then to the traditional ¼" output jack 186. The hex pickup 122 outputs all coils directly to the T2 module 112 in differential pairs (FIG. 16).

Figure 28:
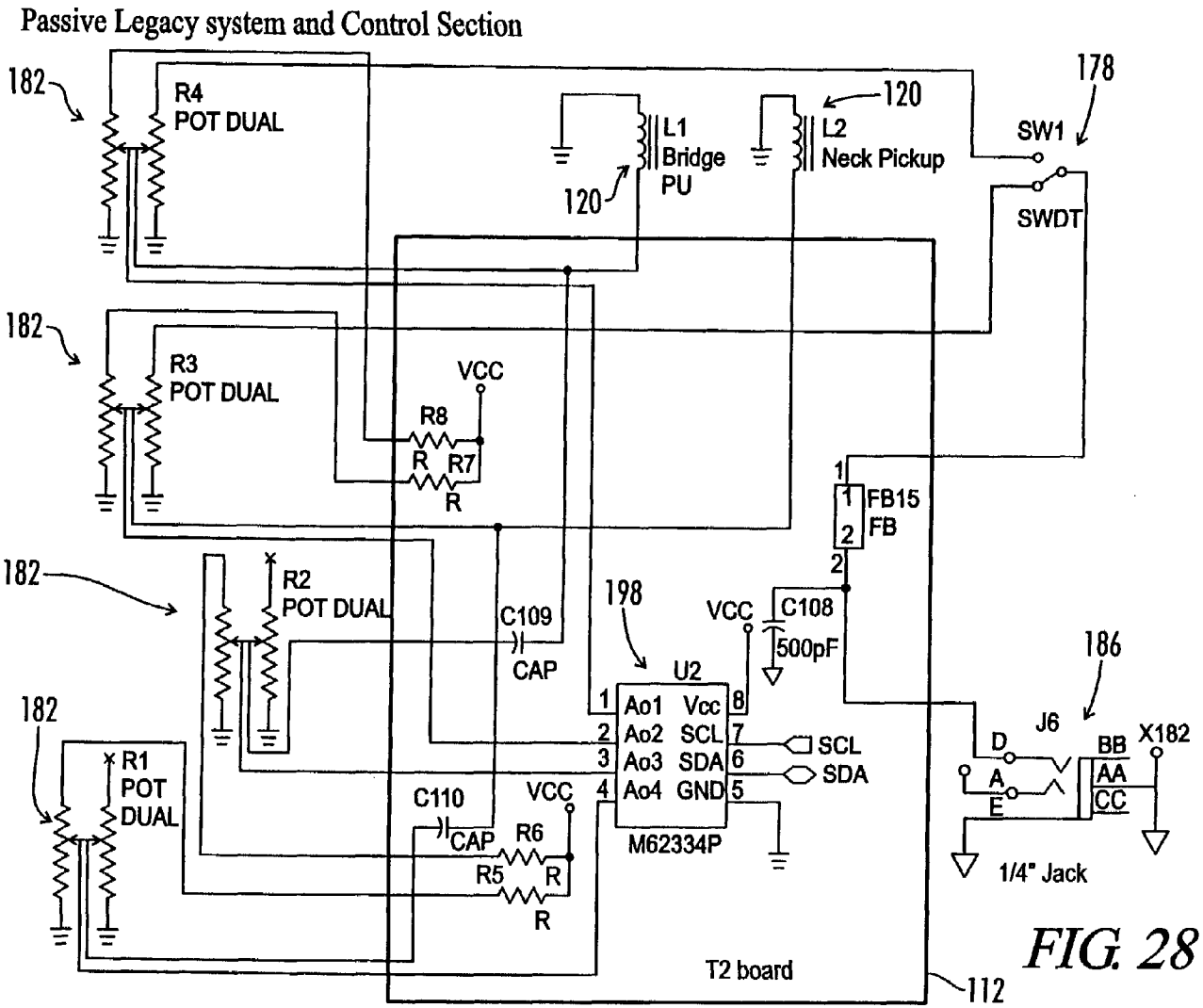
FIG. 28 is a block diagram of the passive legacy system and control section of the showing the volume and tone controls for the humbucker pickups on the digital guitar and the connection of these controls to the T2 board in the digital guitar.
Figure 29:
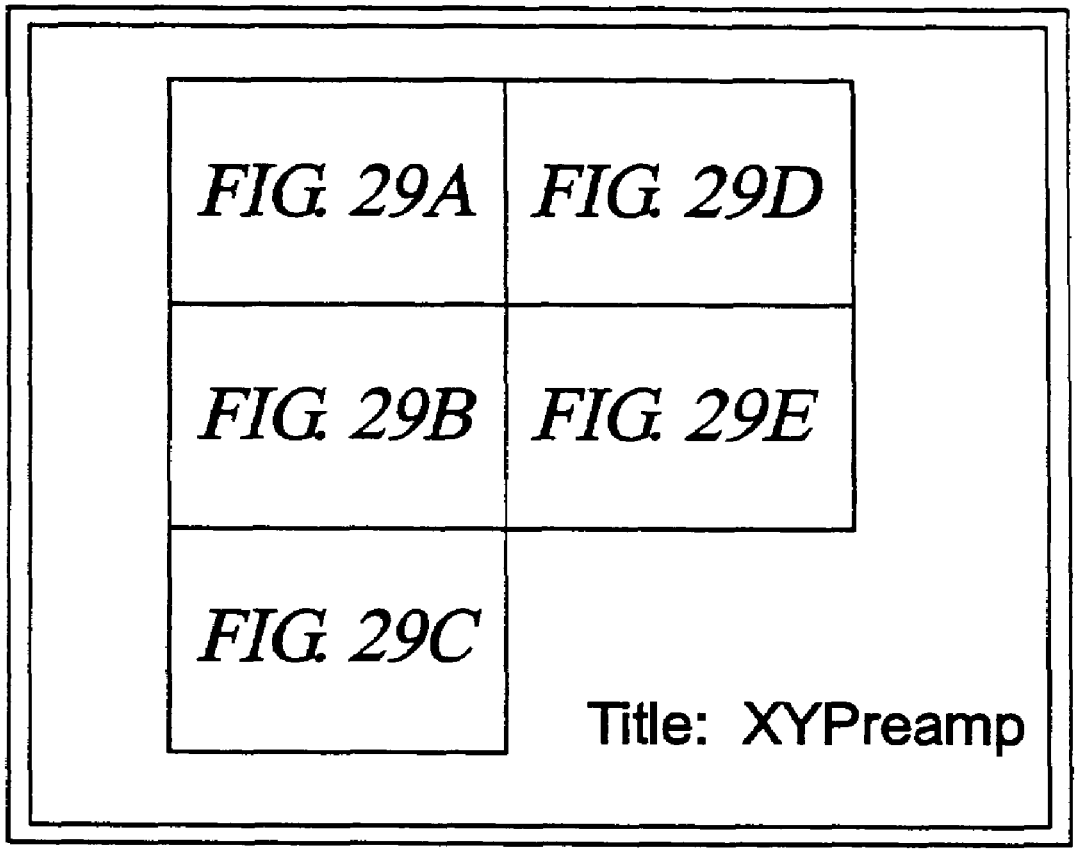
FIGS. 29-36 are schematic drawings showing one embodiment of the preamplifier and mixing circuits of the present invention.
Figure 29A:
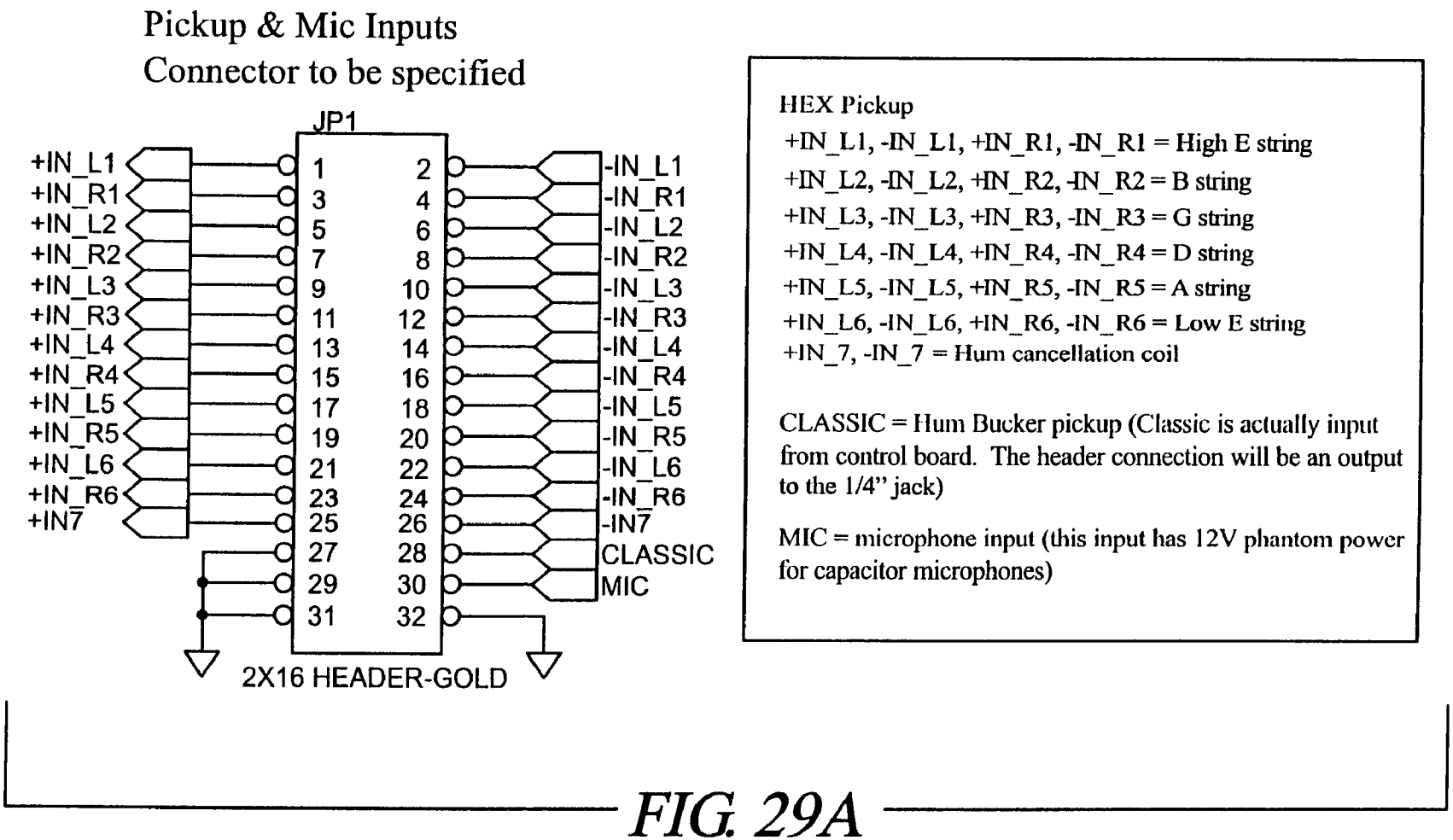
Figure 29B:
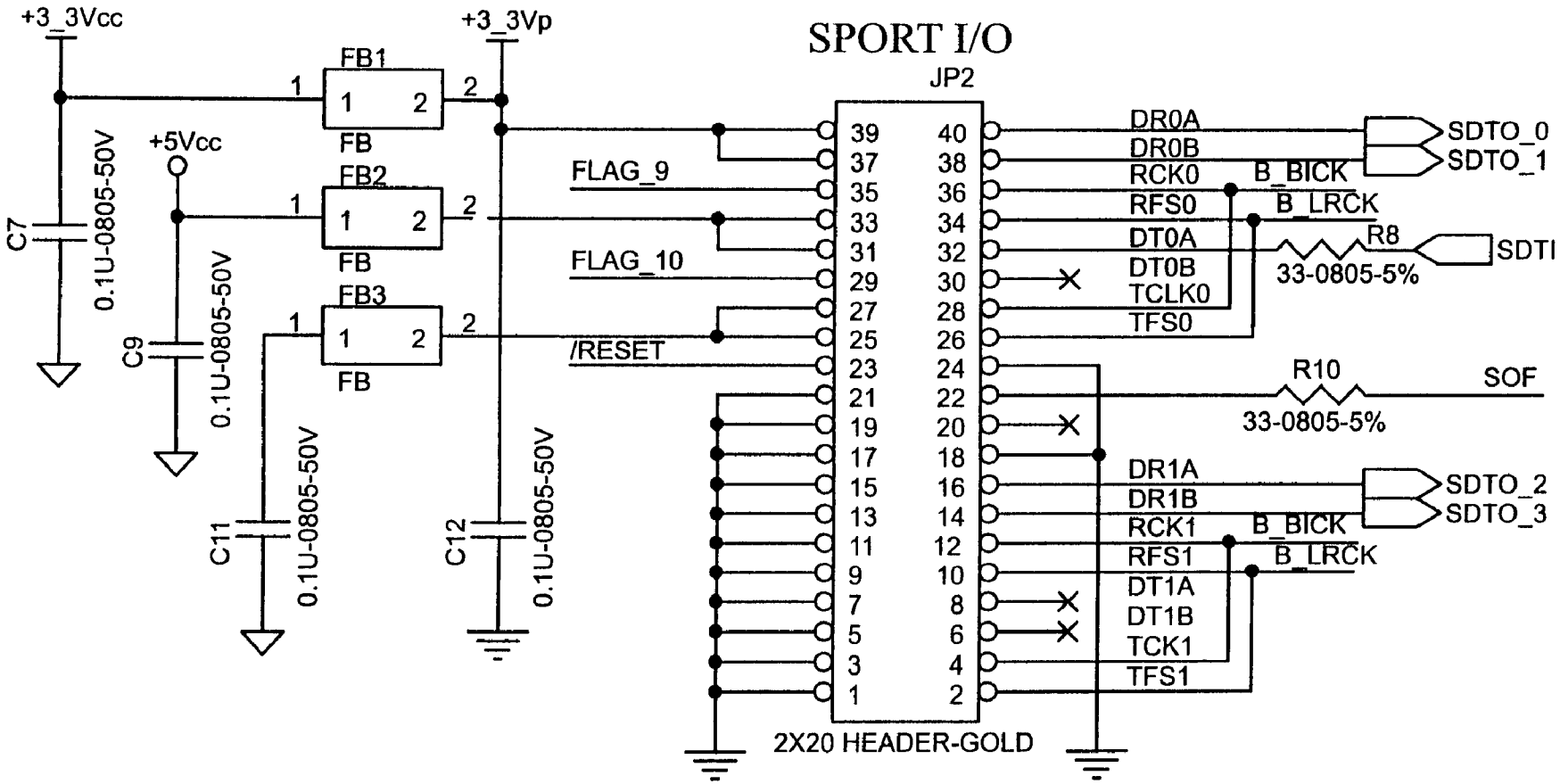
Figure 29C:
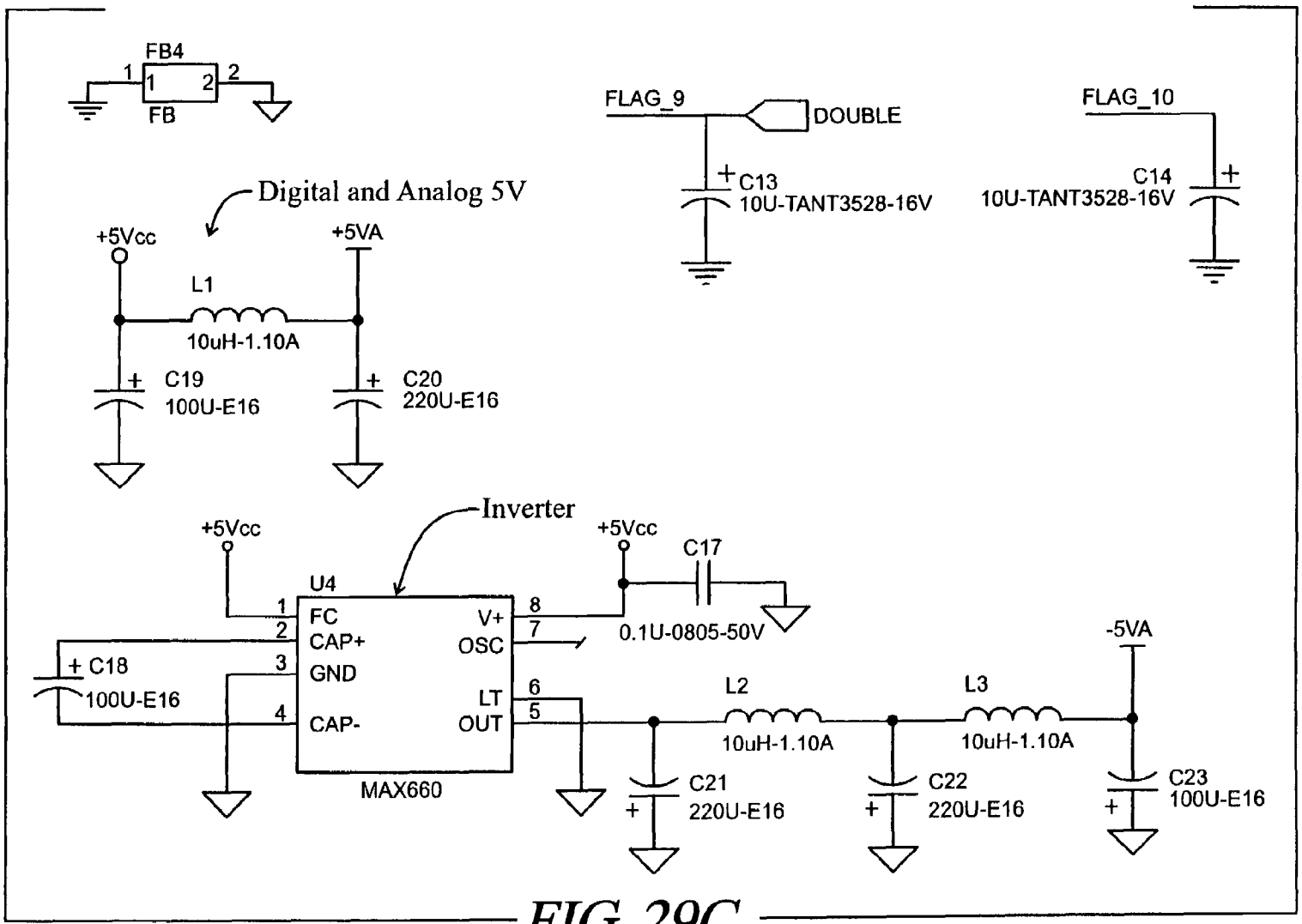
Figure 29D:
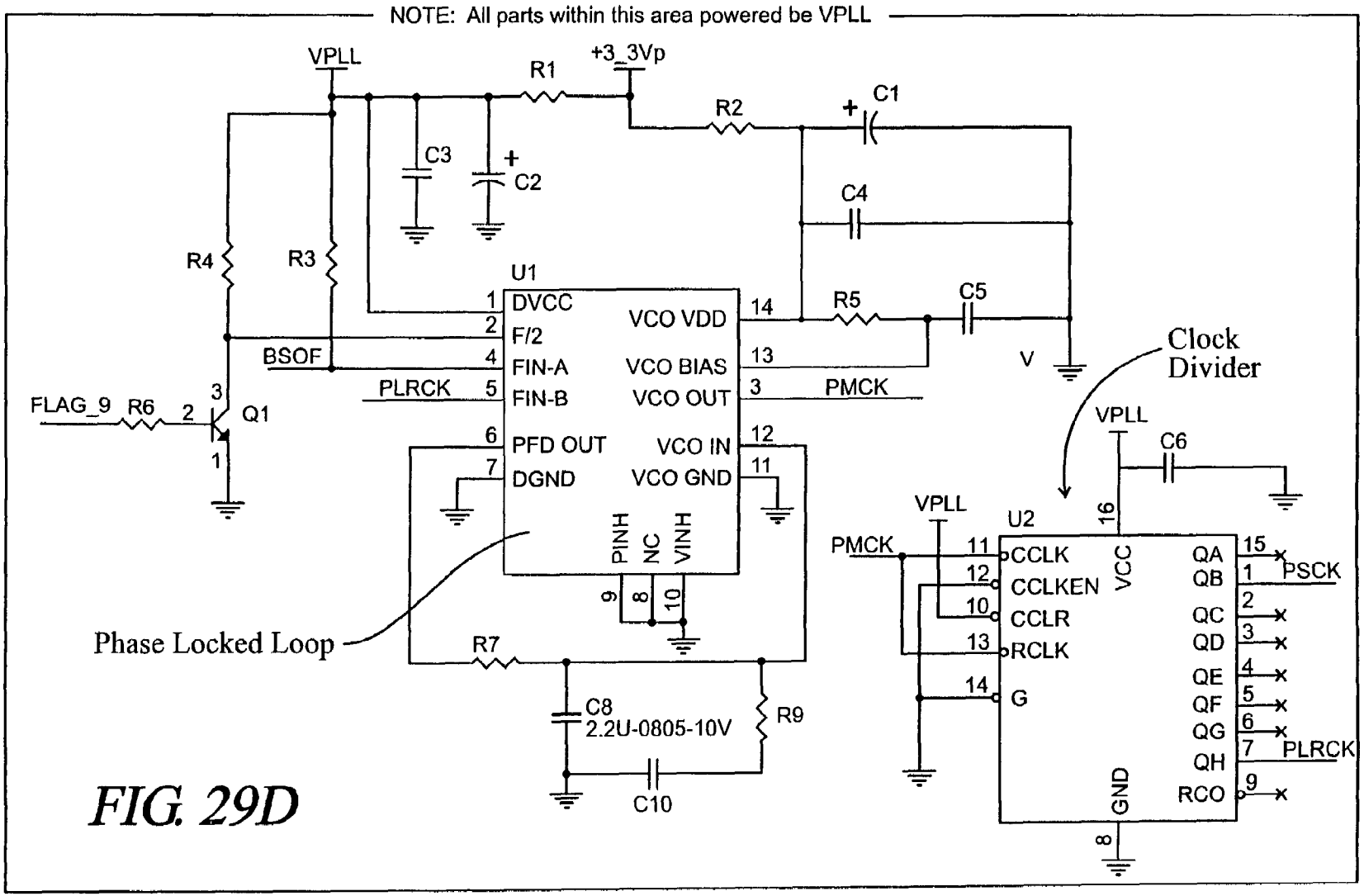
Figure 29E:
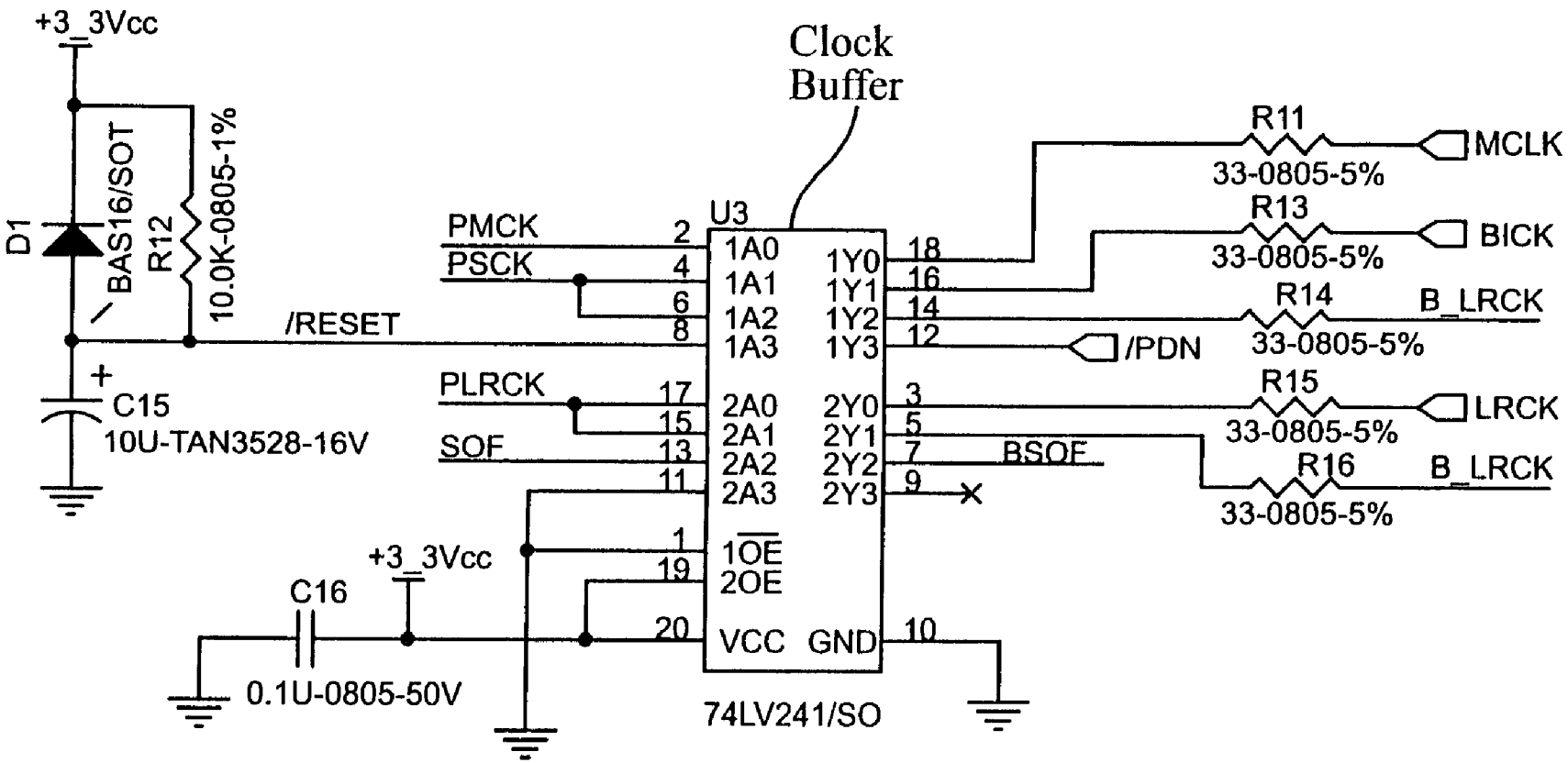
Figure 30:
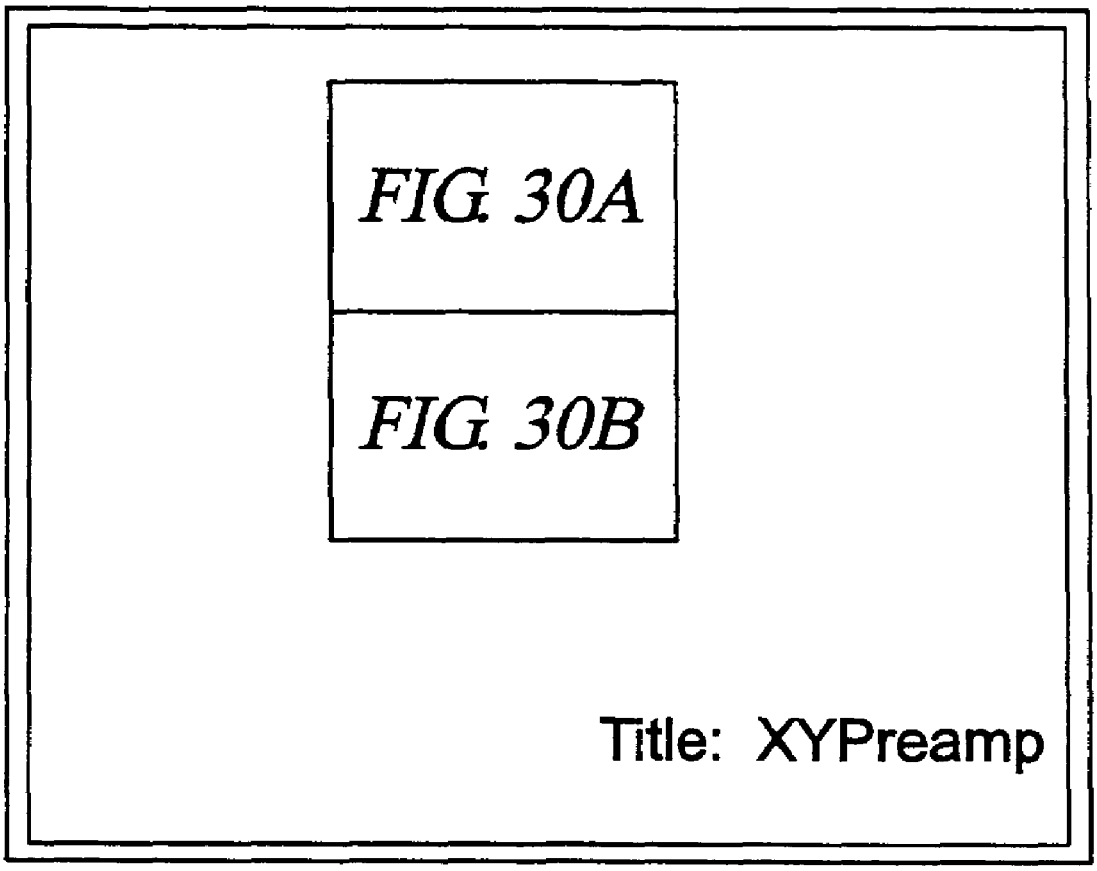
Figure 30A:
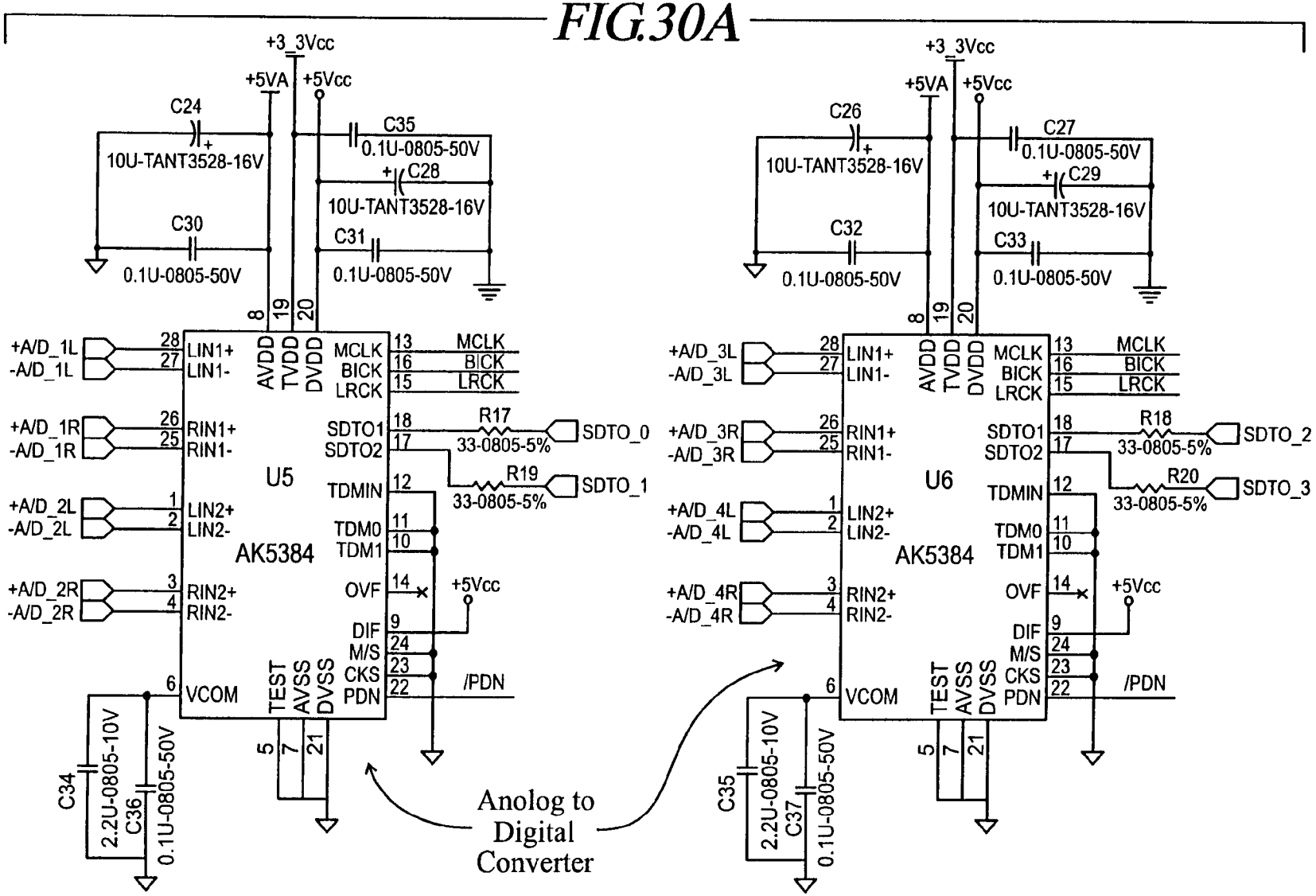
Figure 30B:
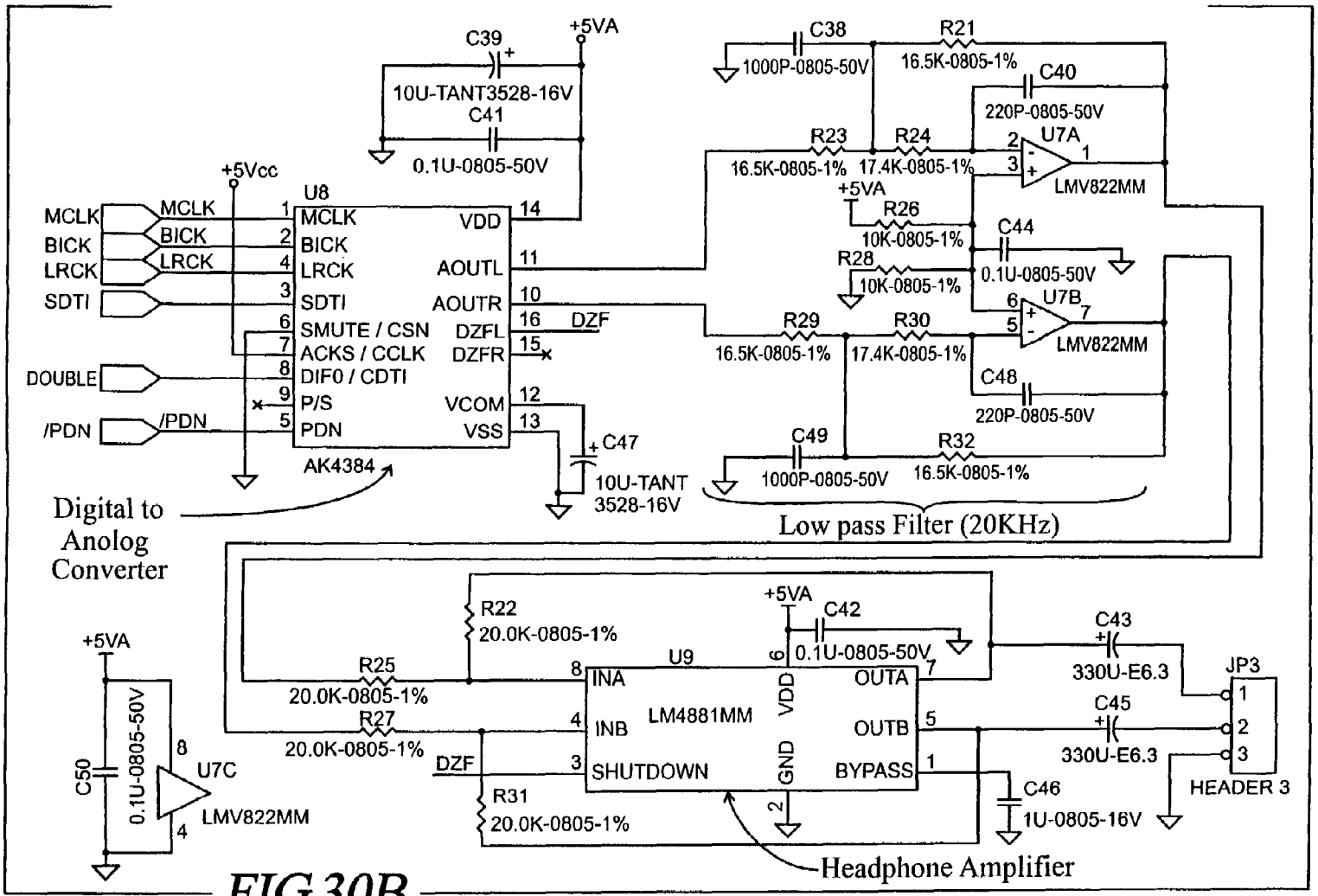
Figure 31:
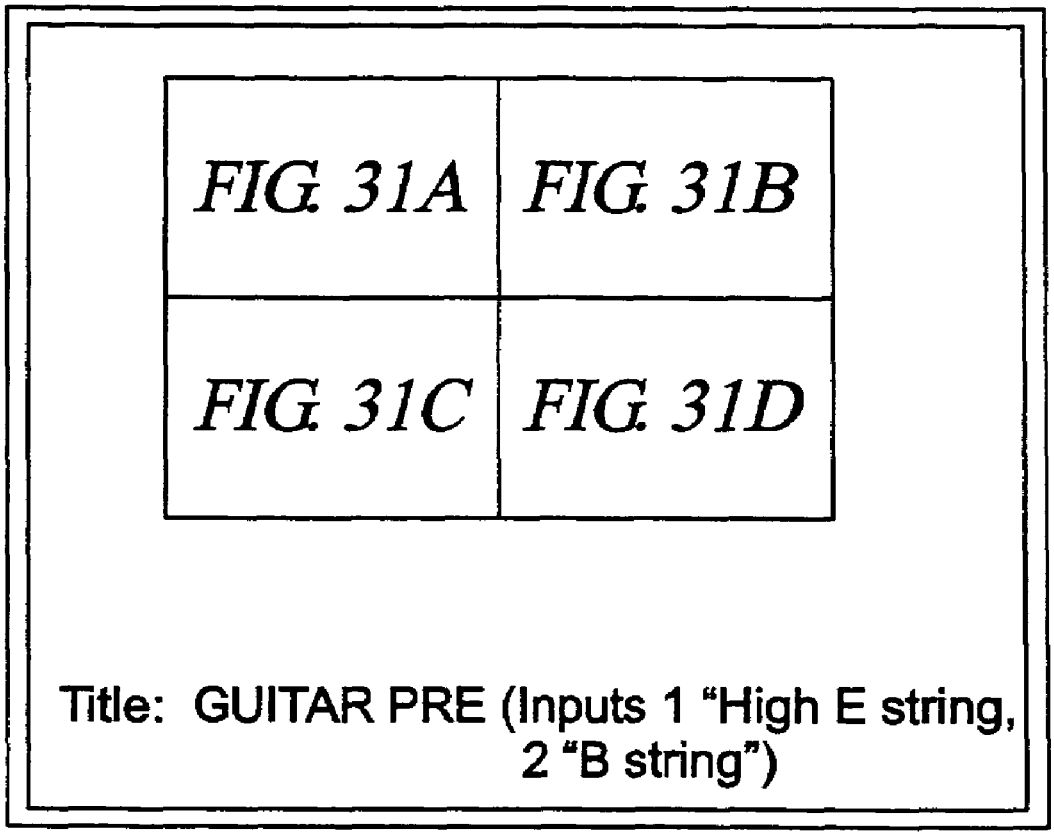
Figure 31A:
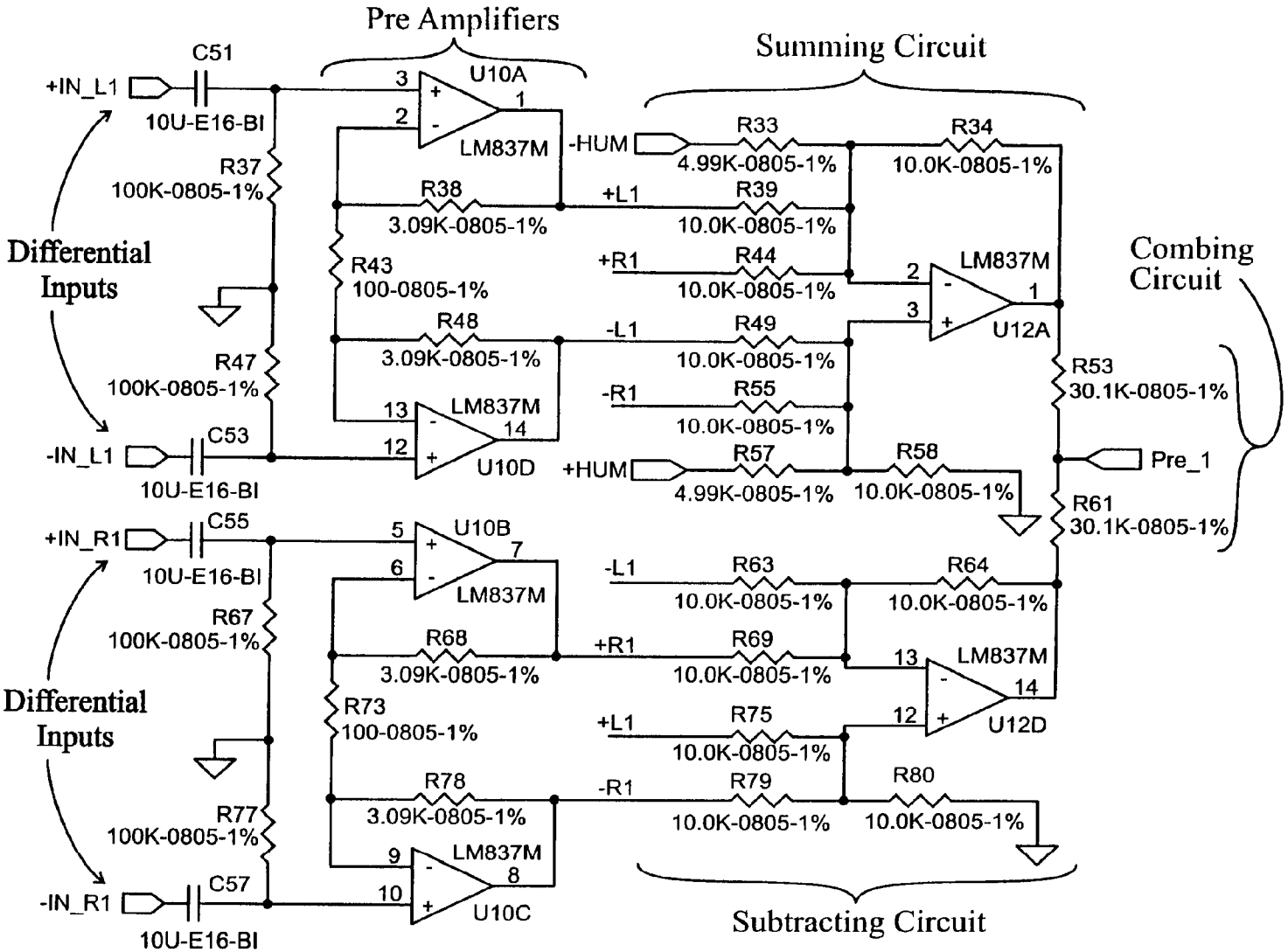
Figure 31B:
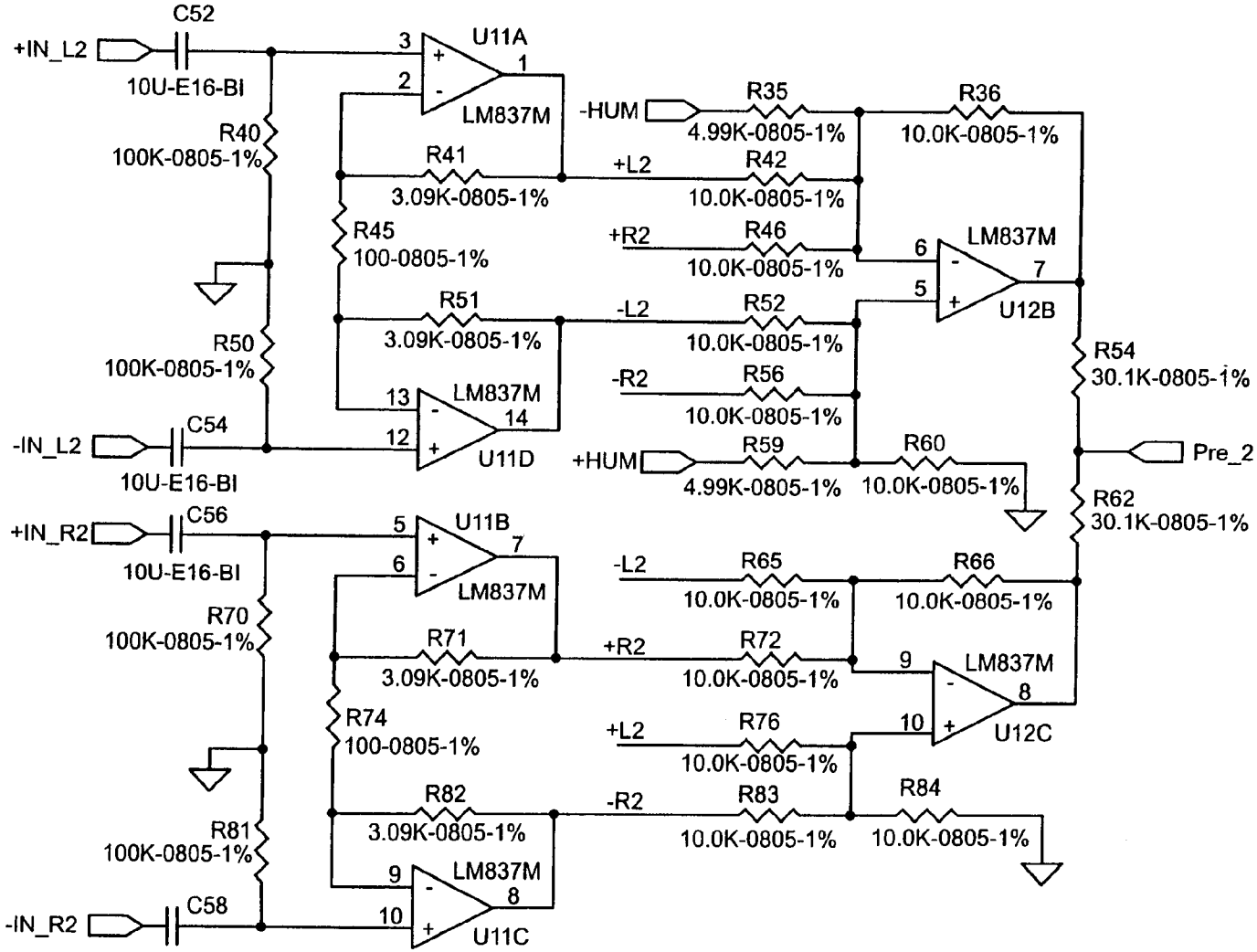
Figure 31C:
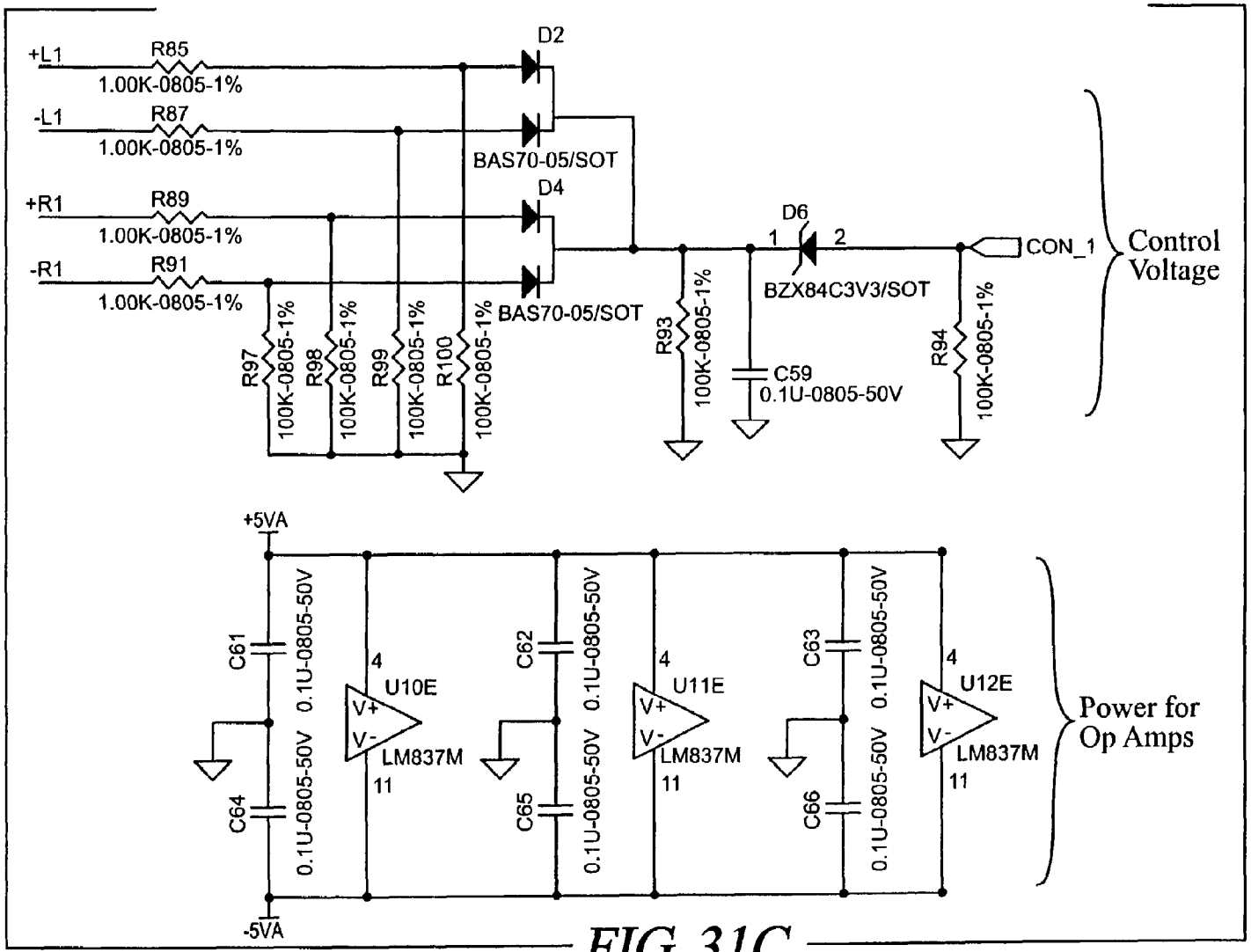
Figure 31D:
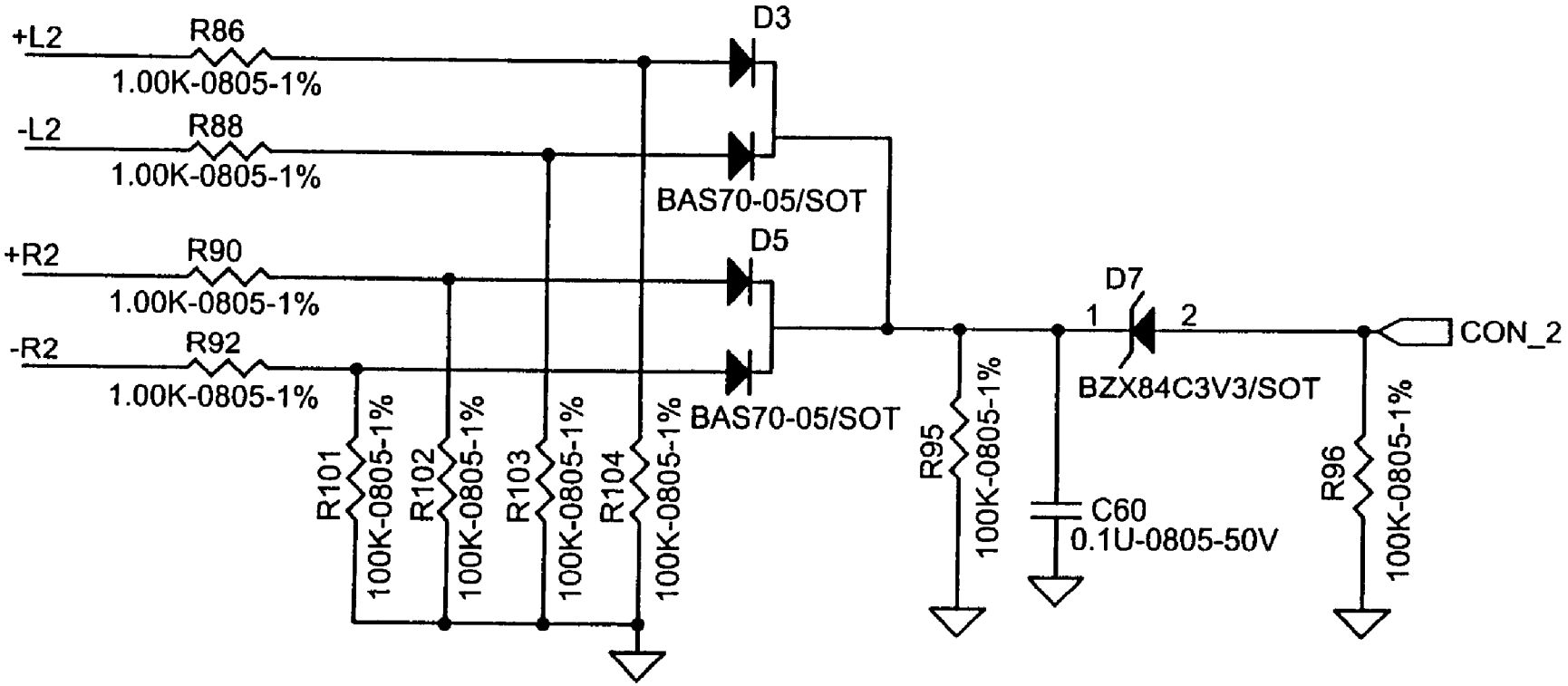
Figure 32:
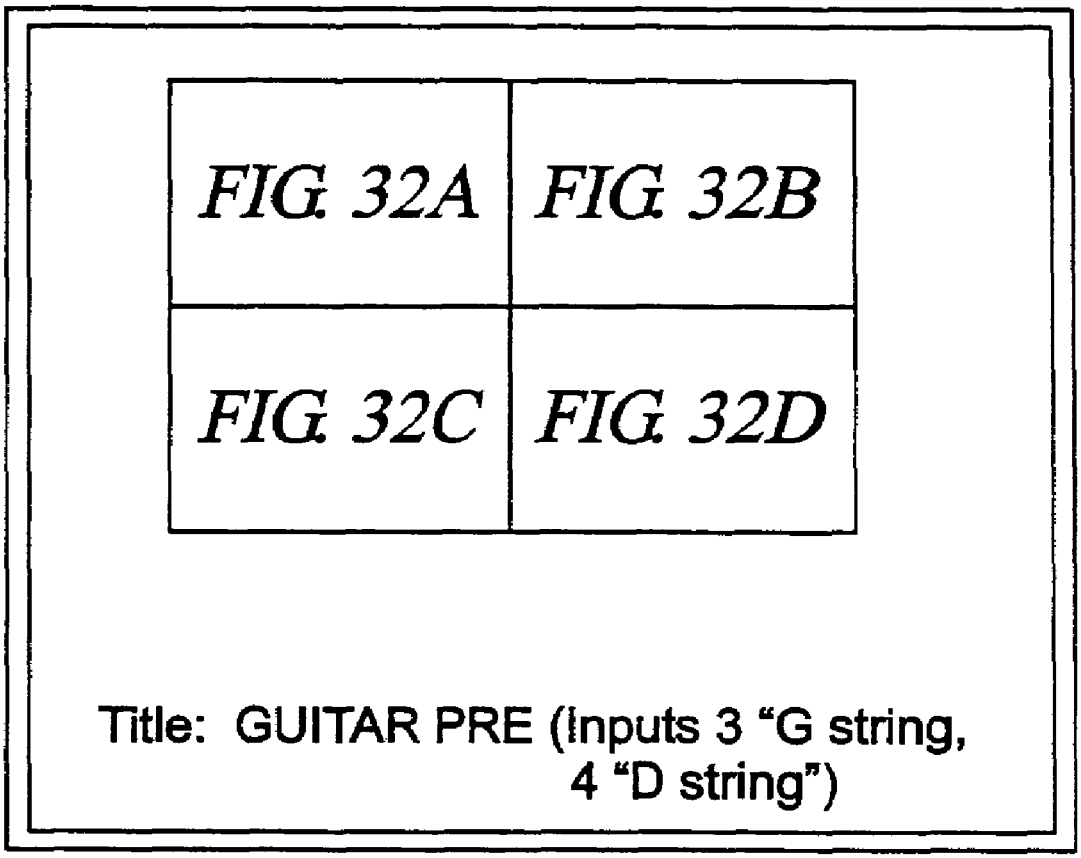
Figure 32A:
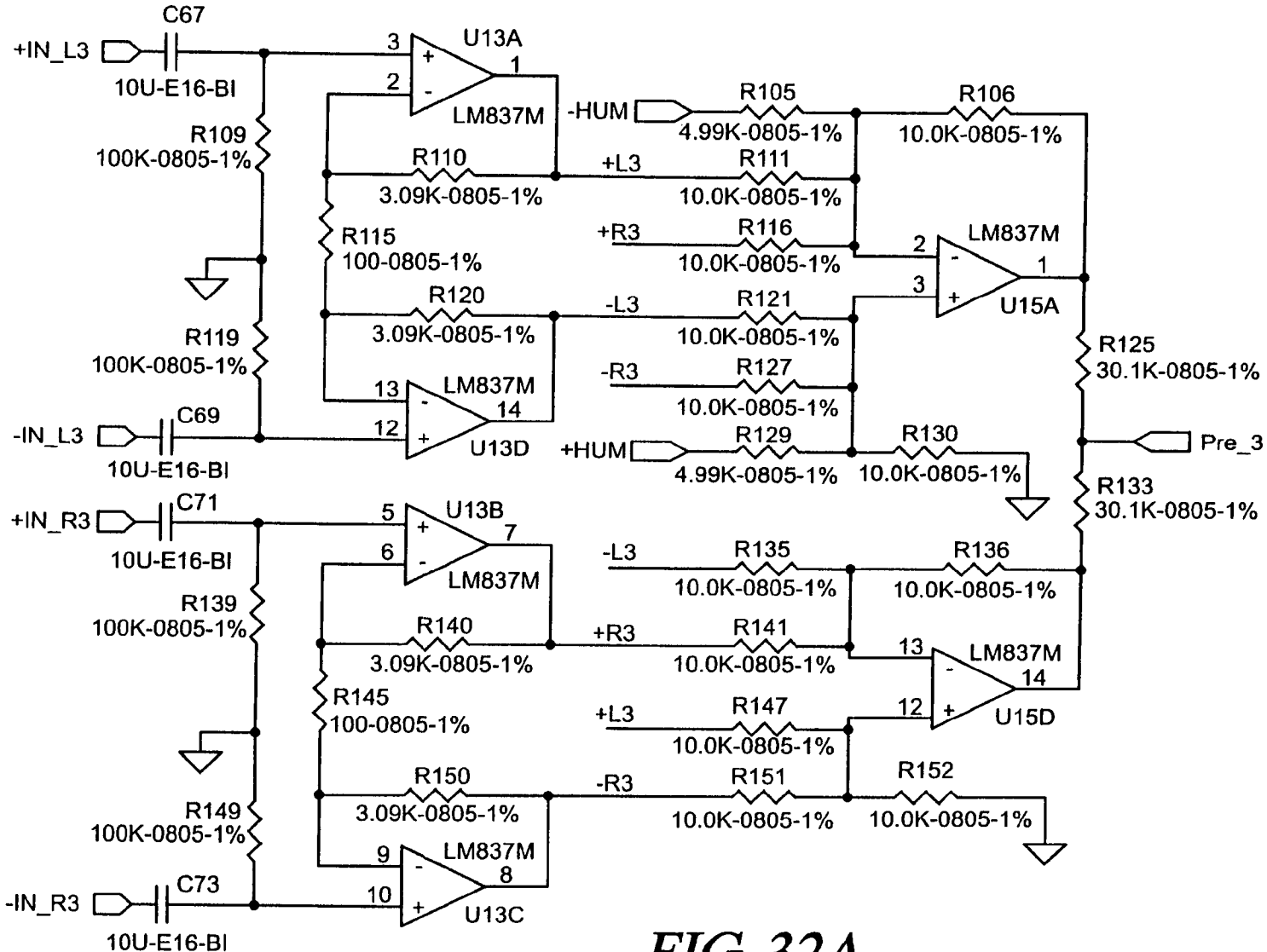
Figure 32B:
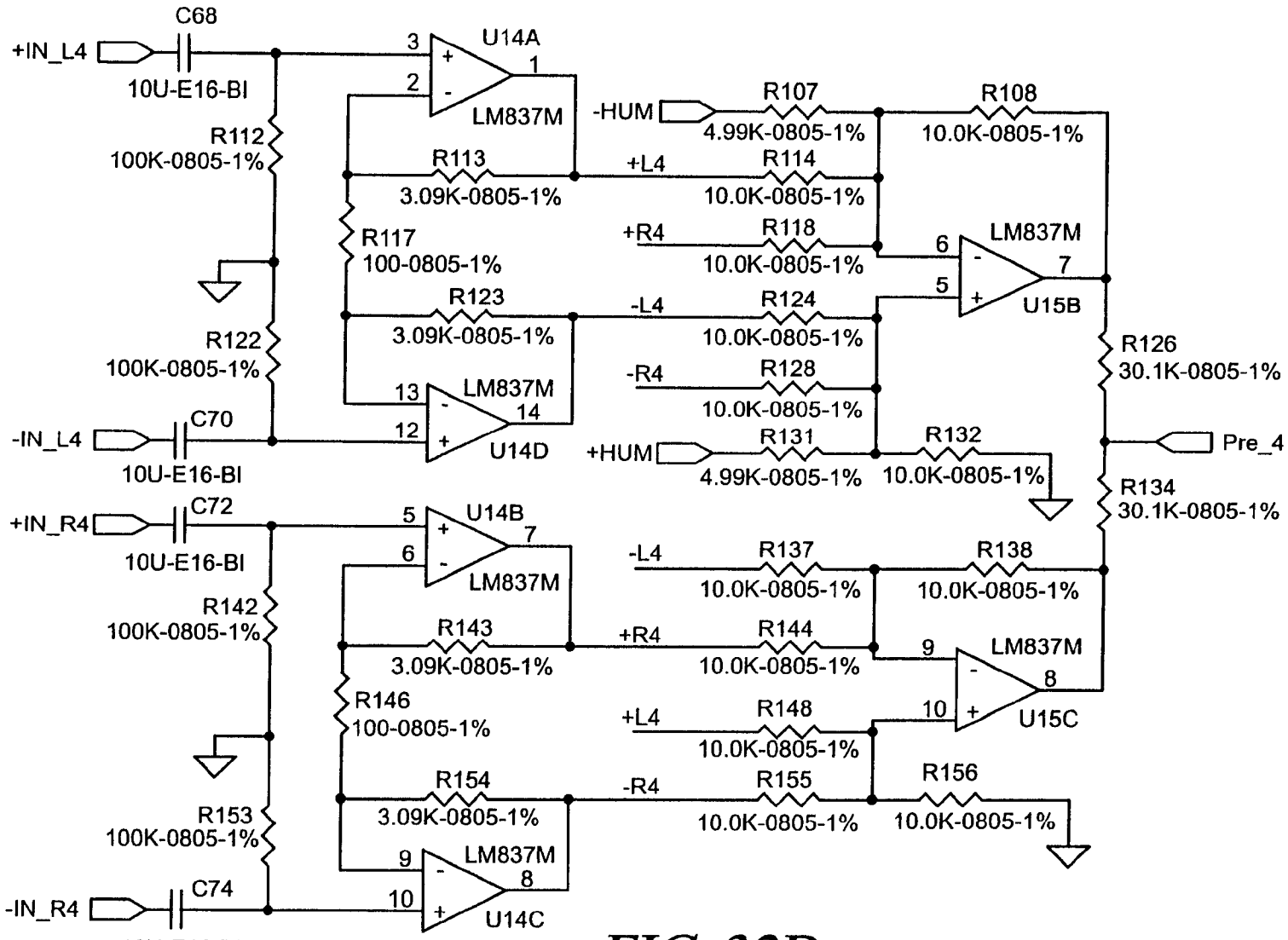
Figure 32C:
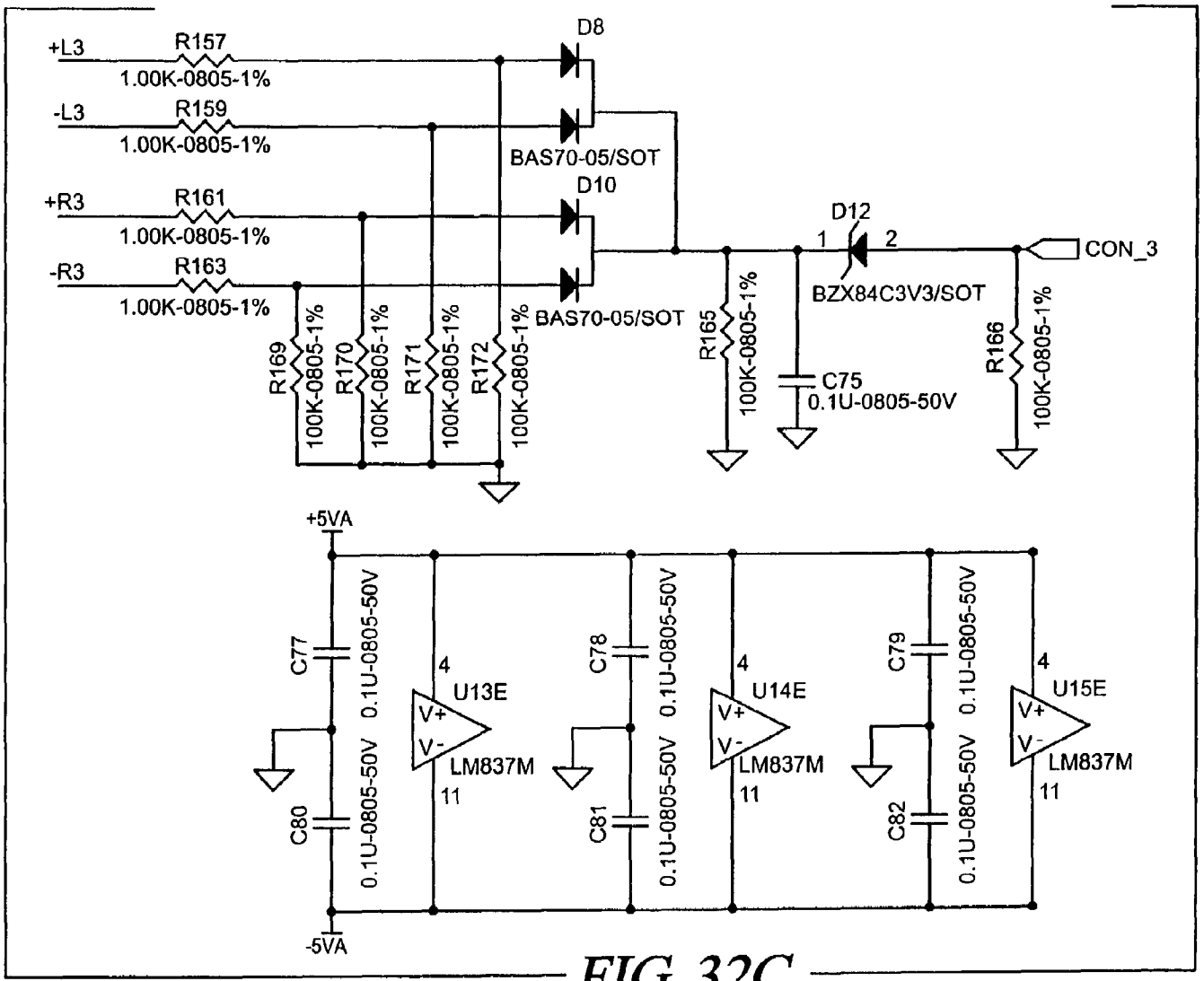
Figure 32D:
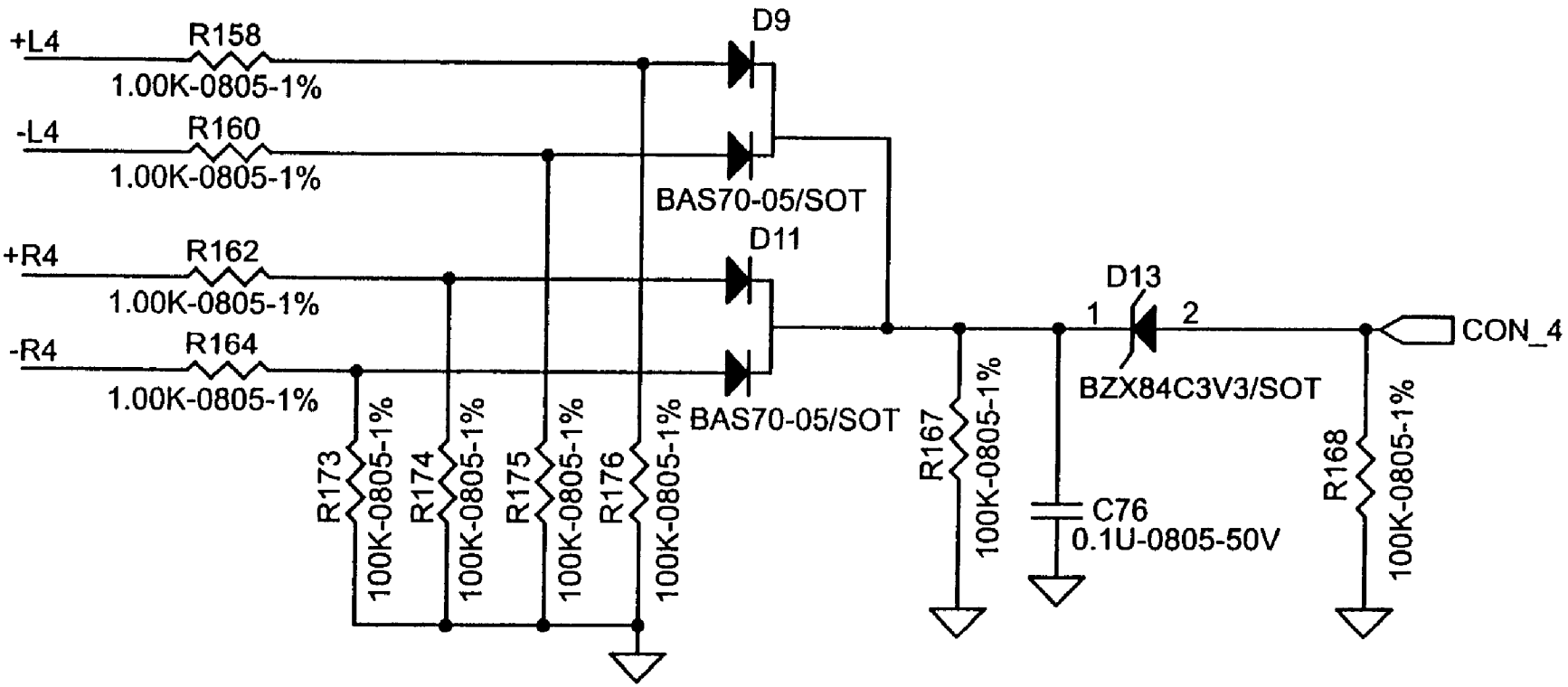
Figure 33A:
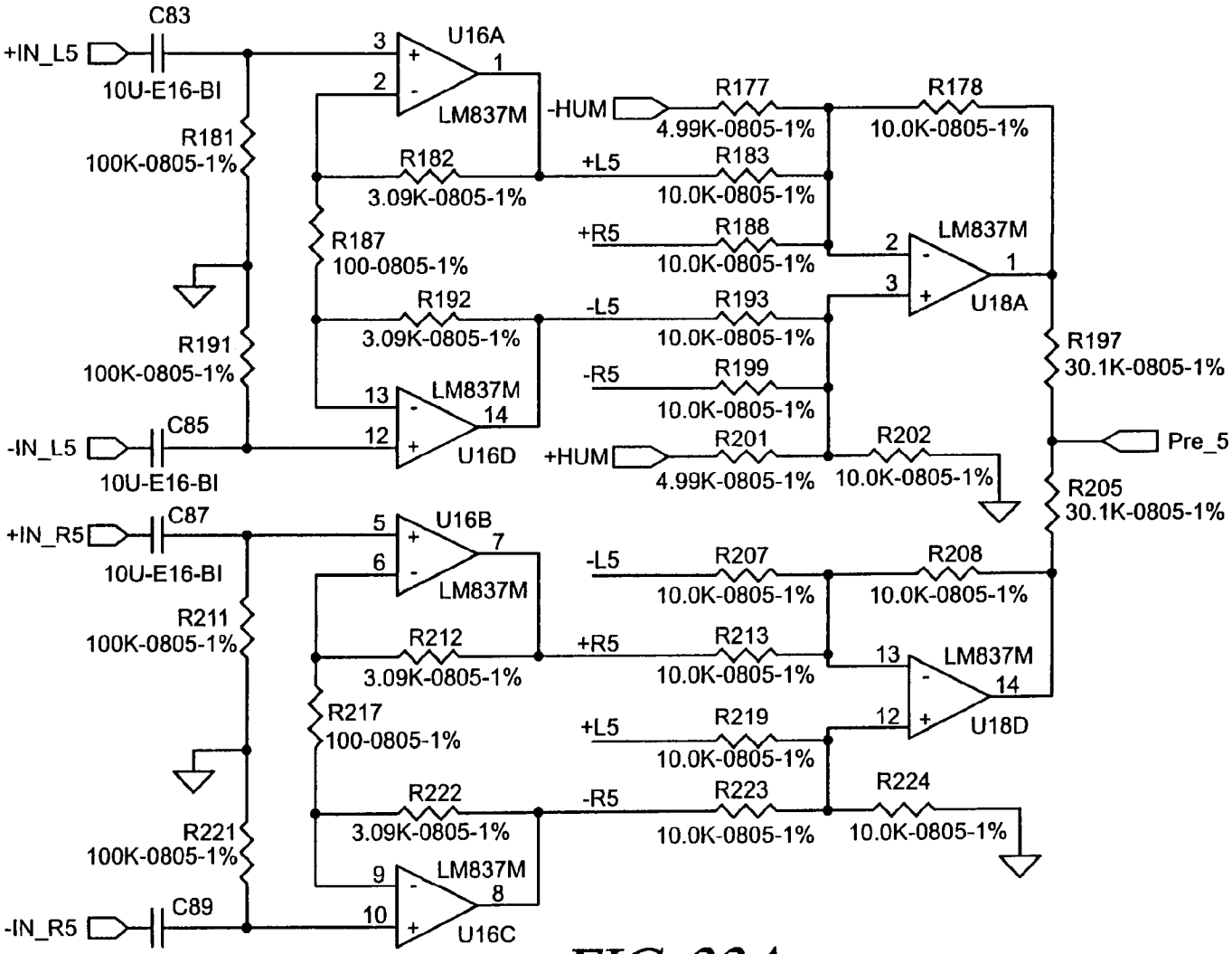
Figure 33B:
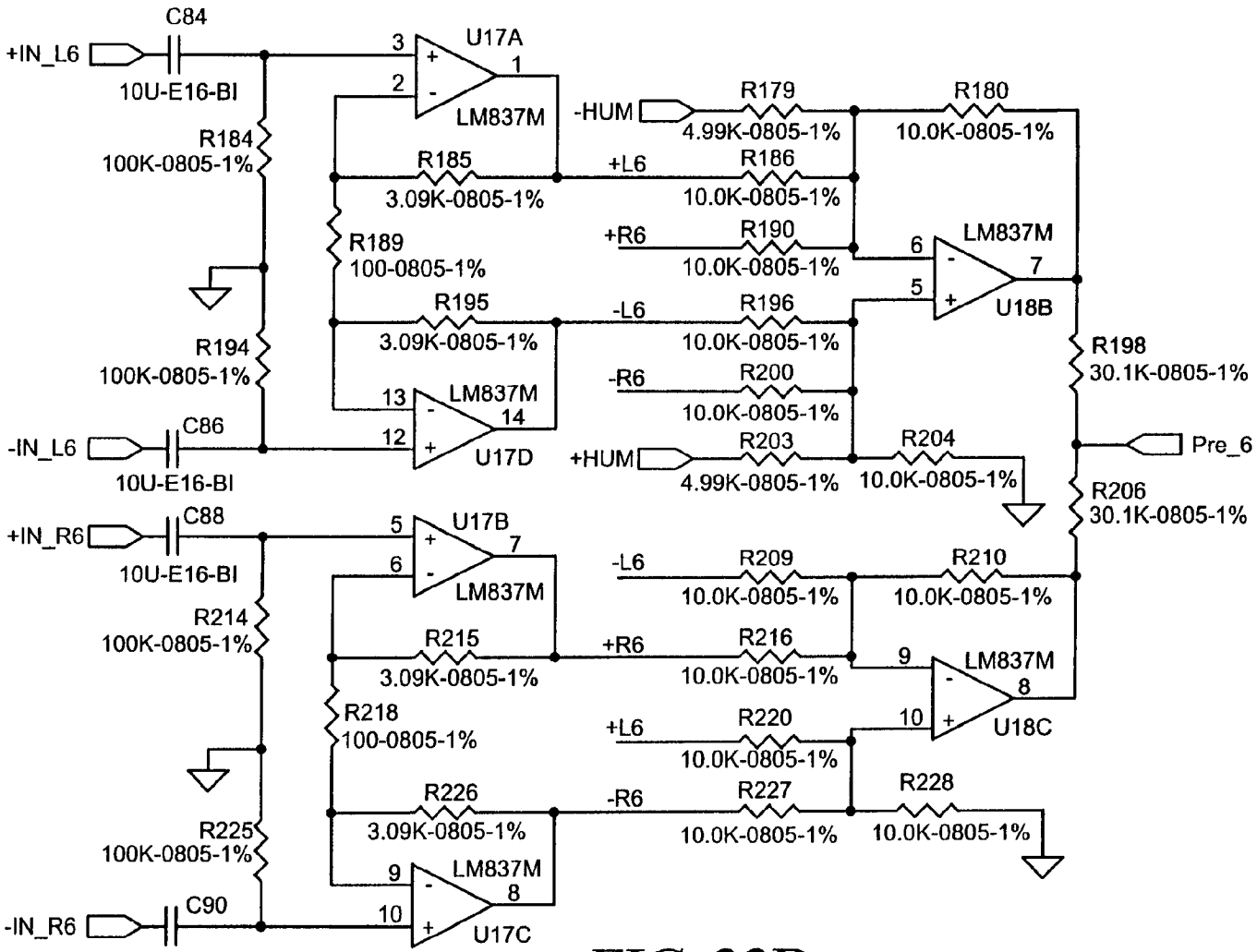
Figure 33C:
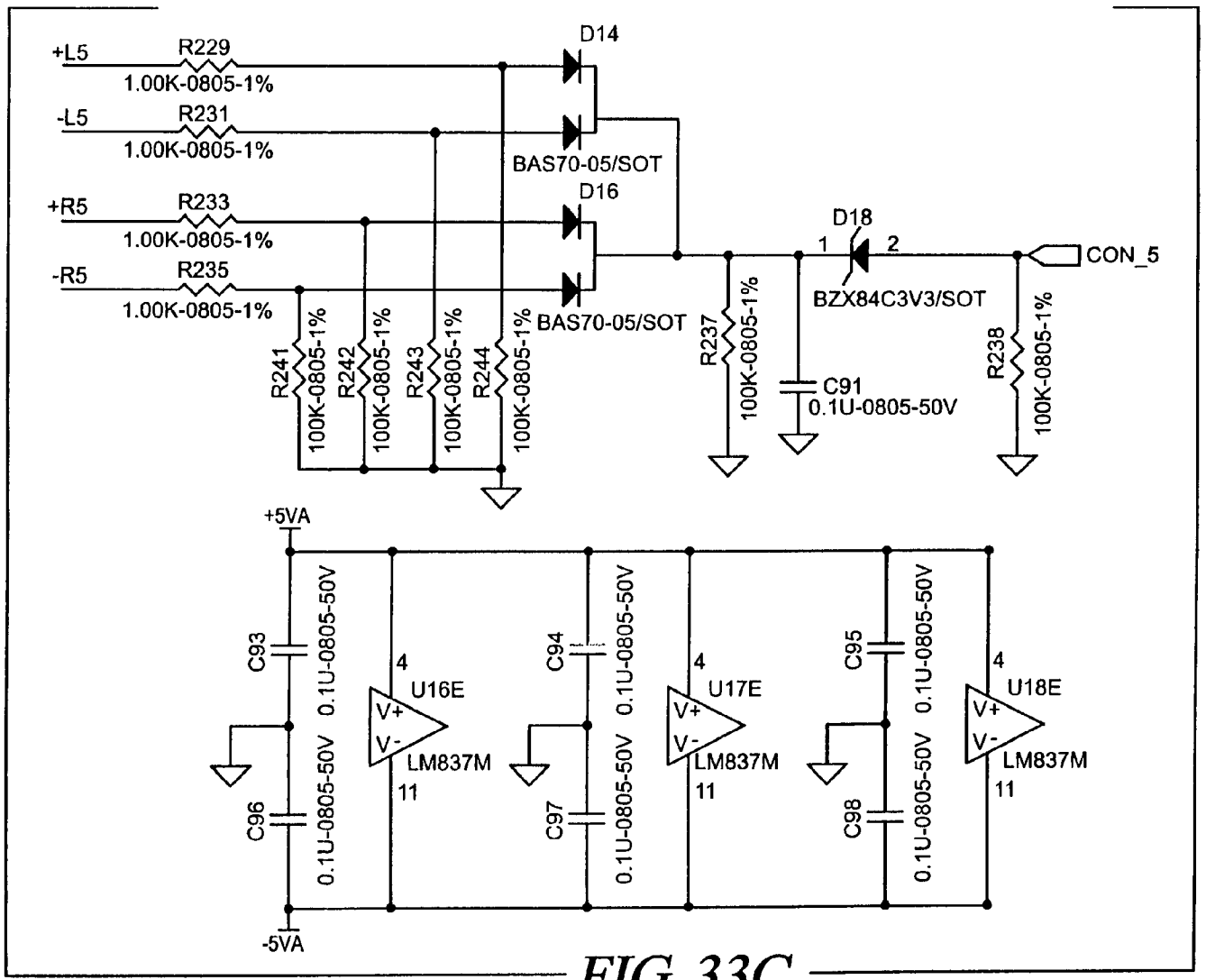
Figure 33D:
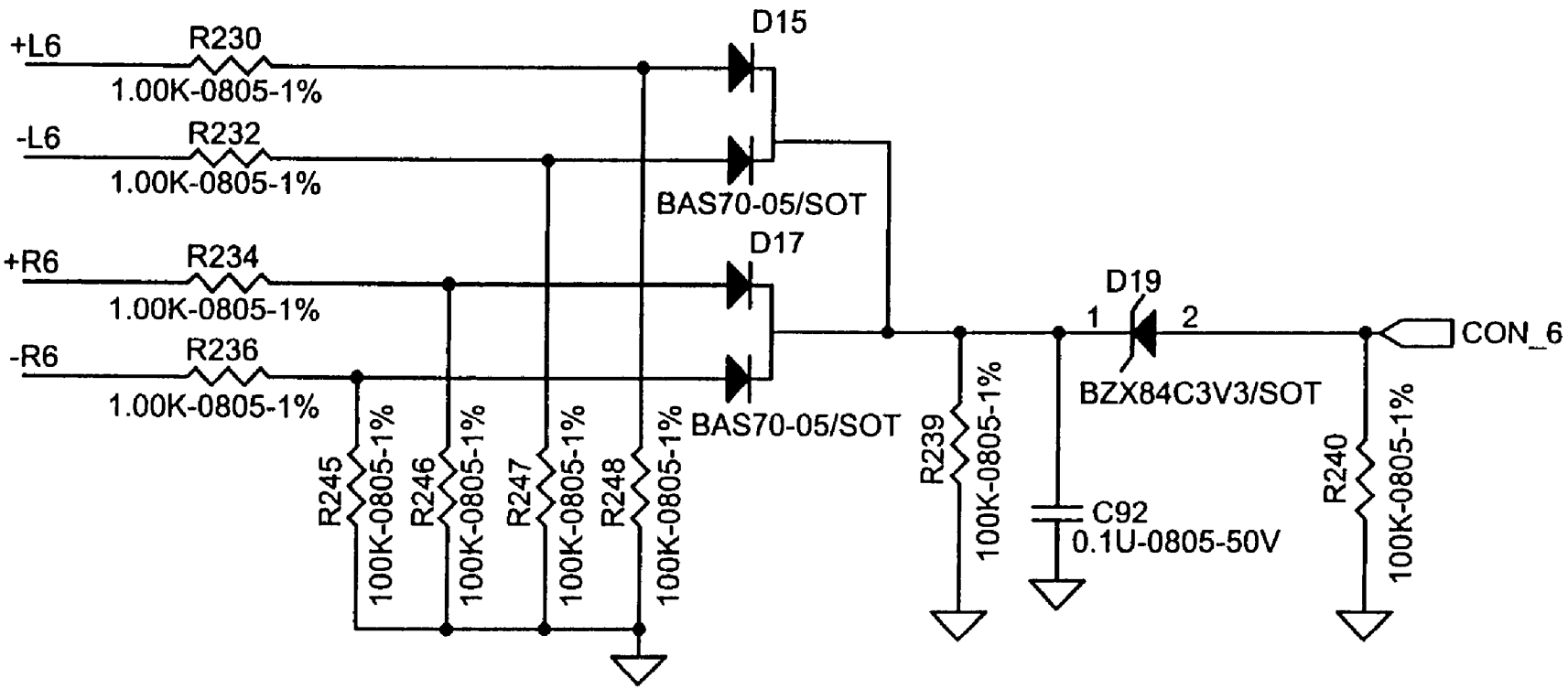
Figure 34:
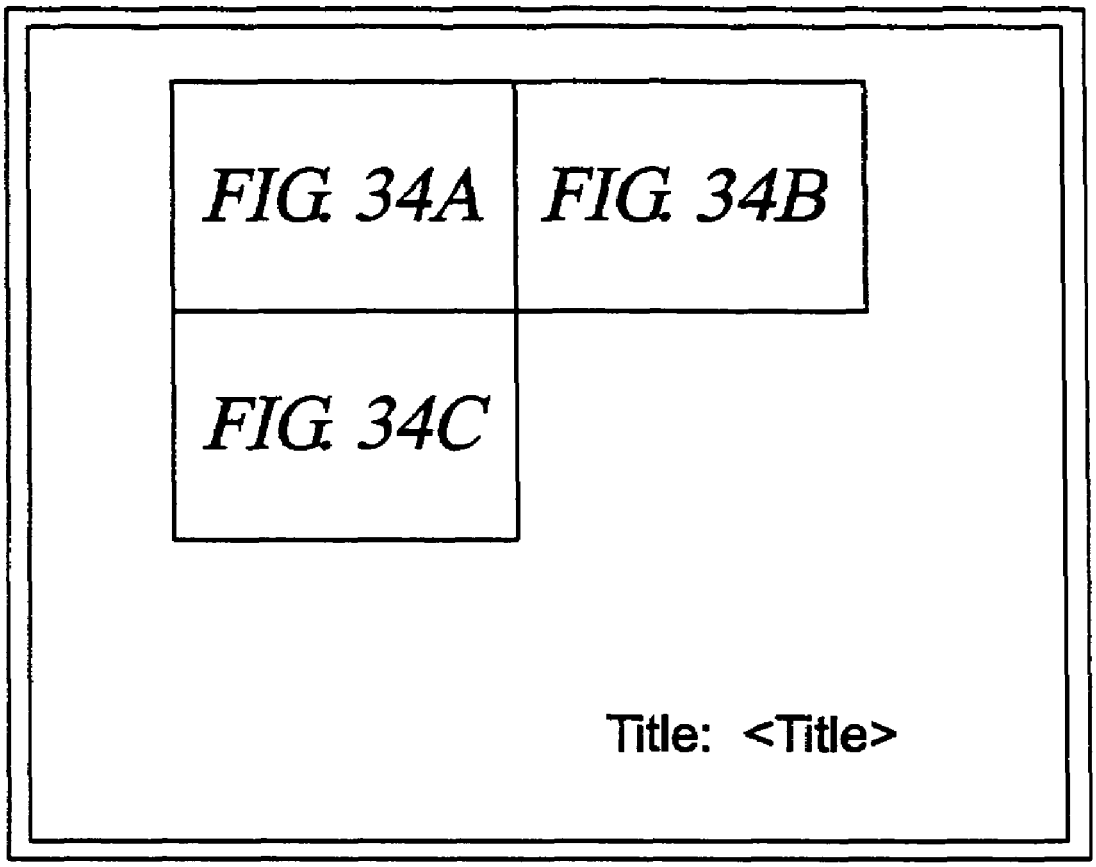
Figure 34A:
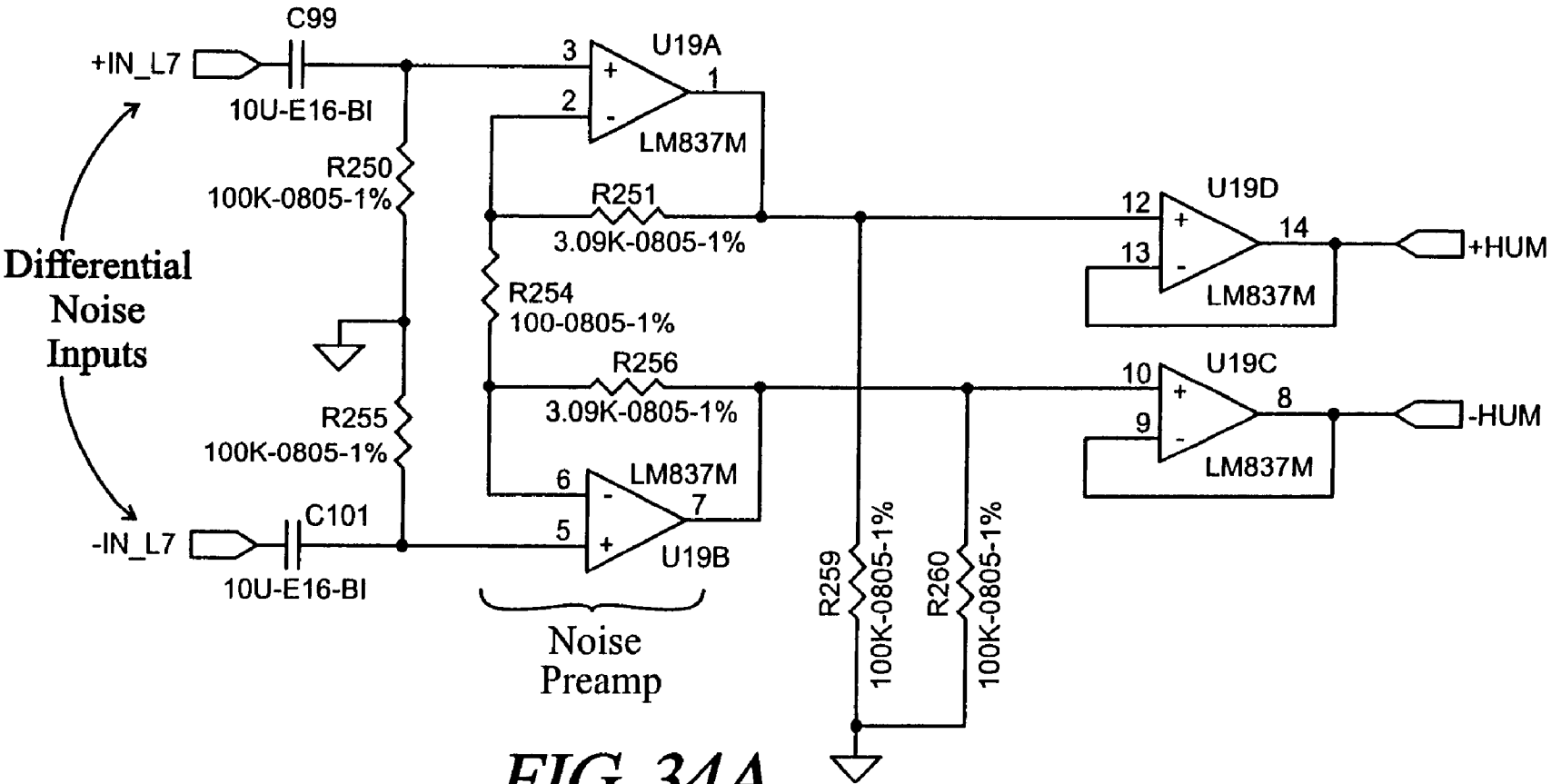
Figure 34B:
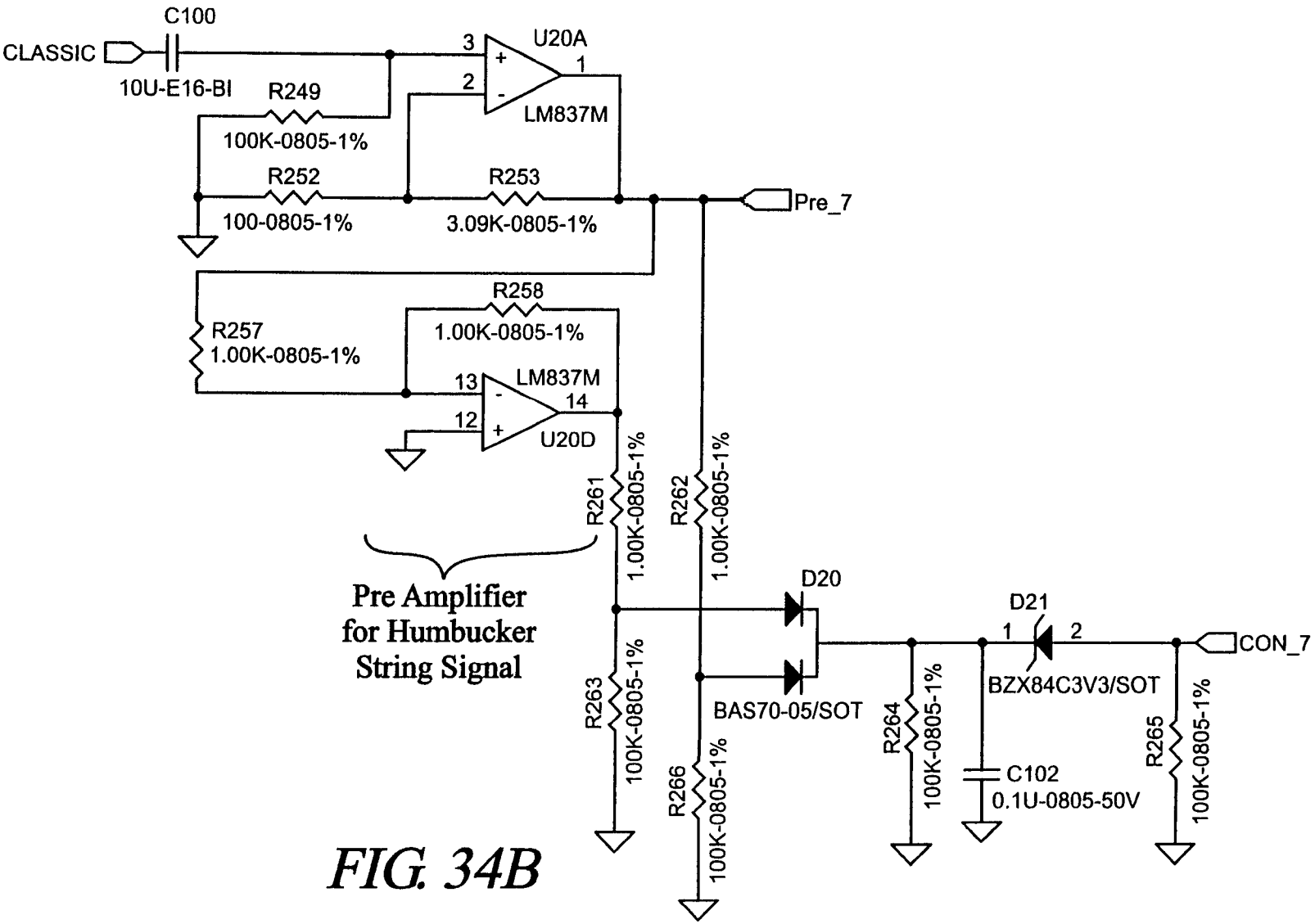
Figure 34C:
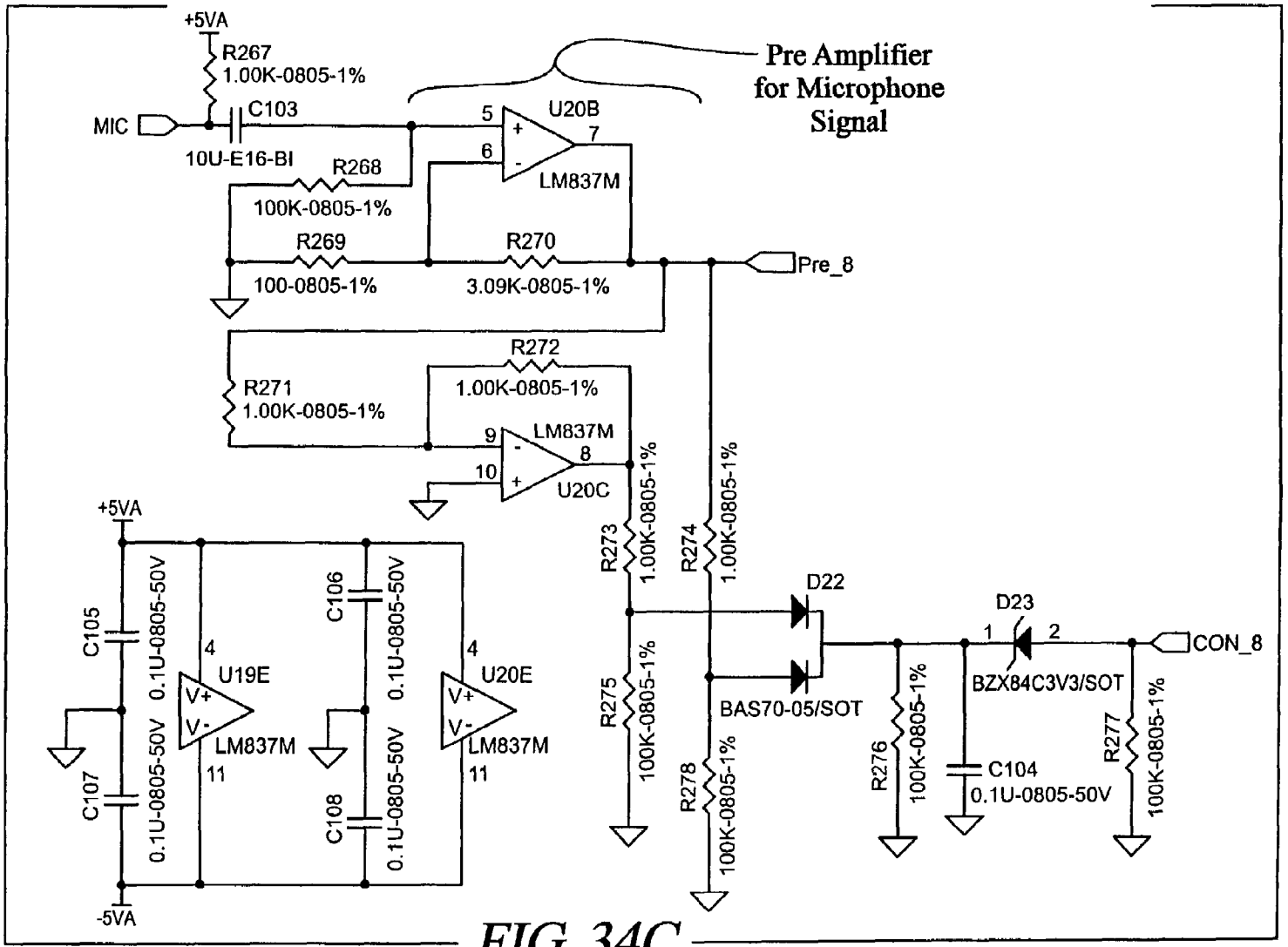
Figure 35:
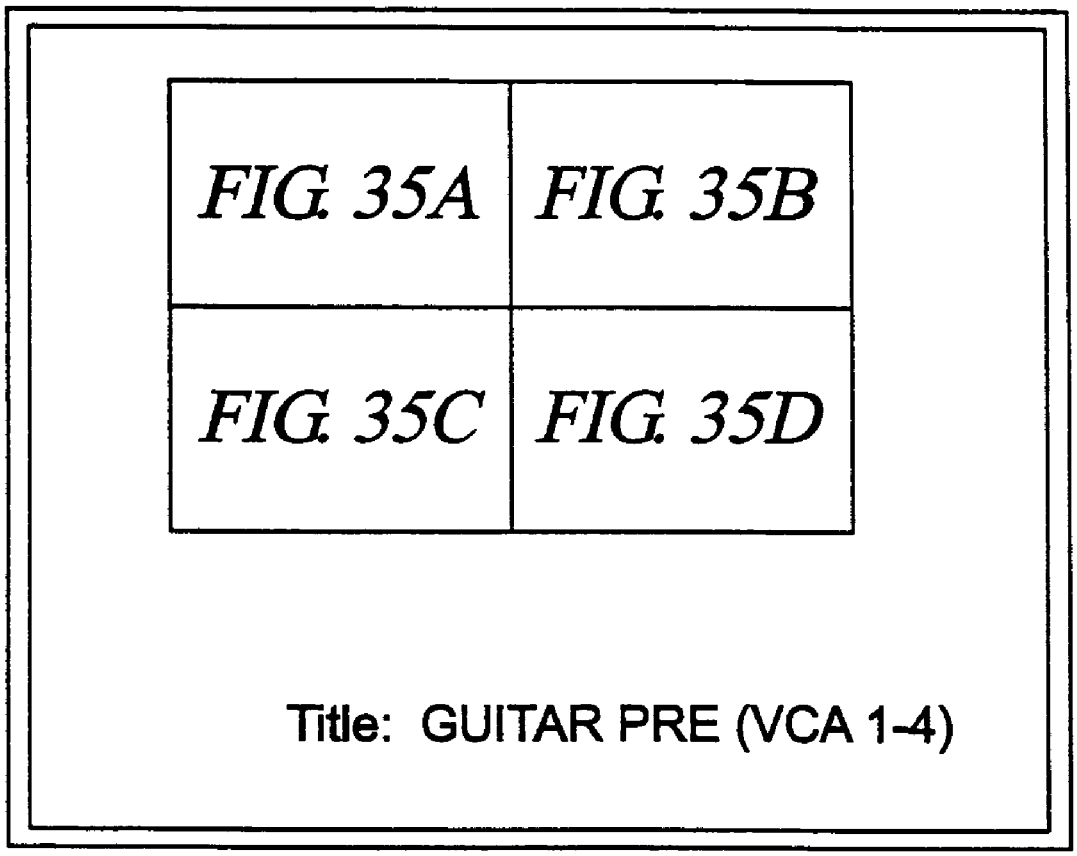
Figure 35A:
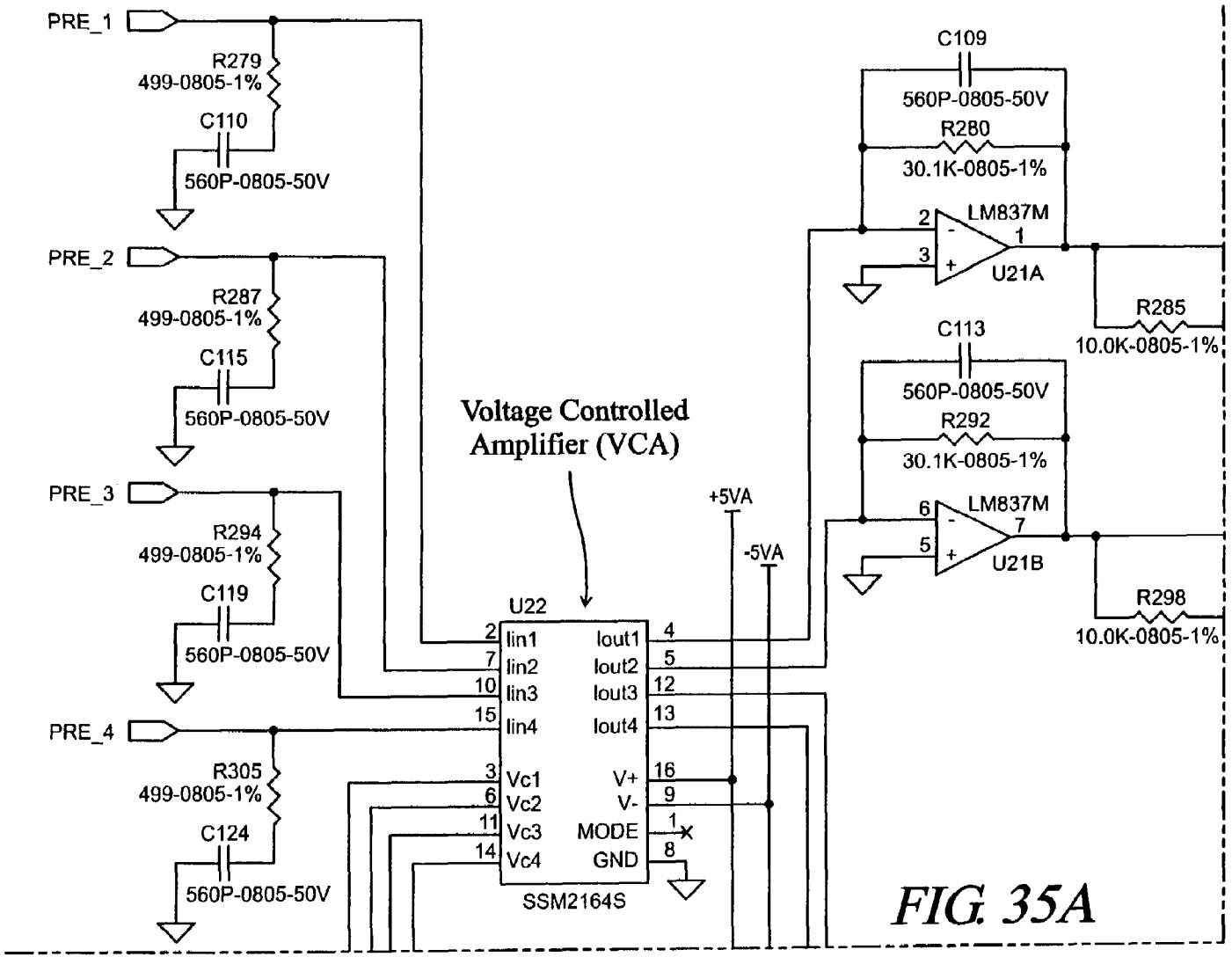
Figure 35B:
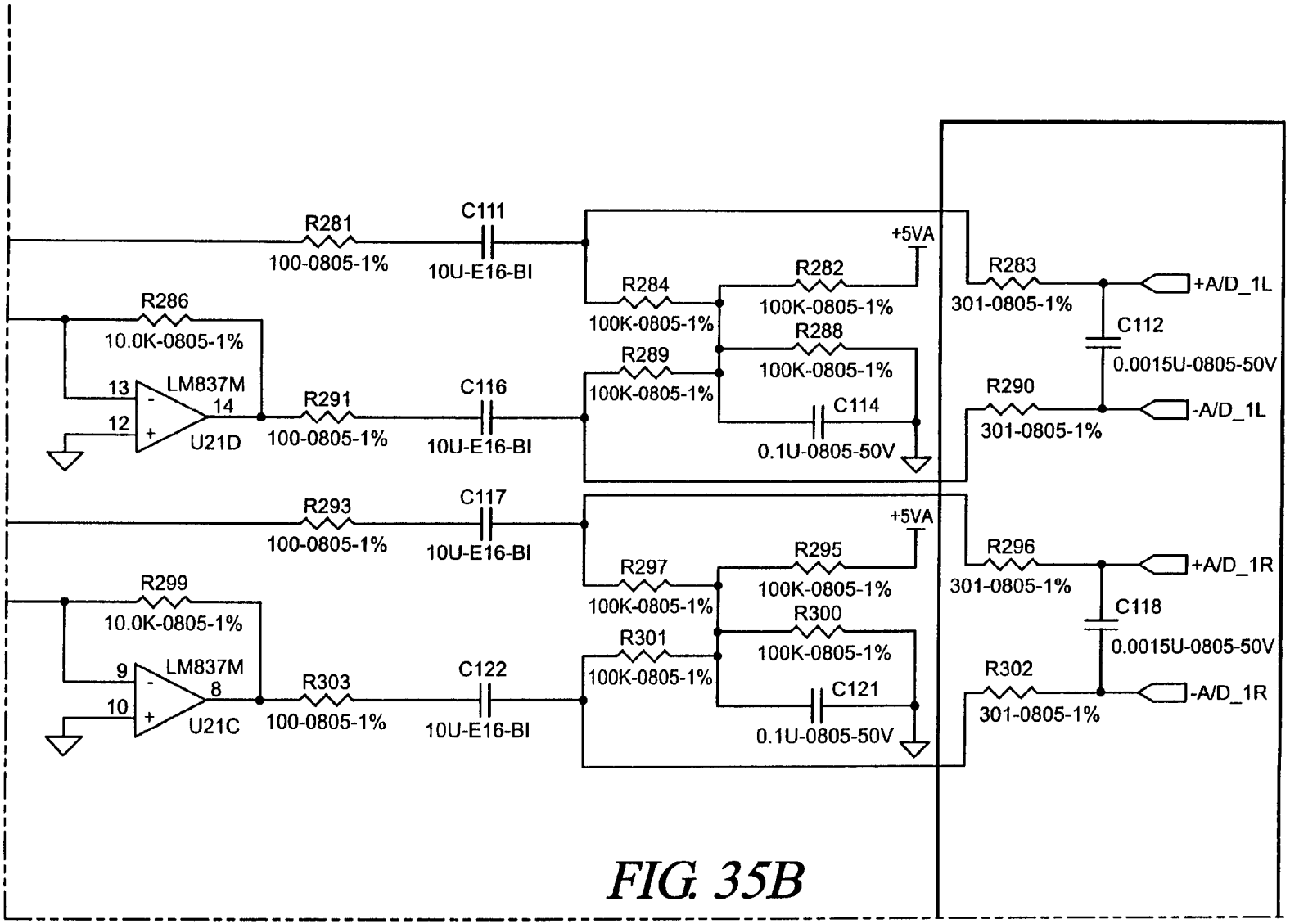
Figure 35C:
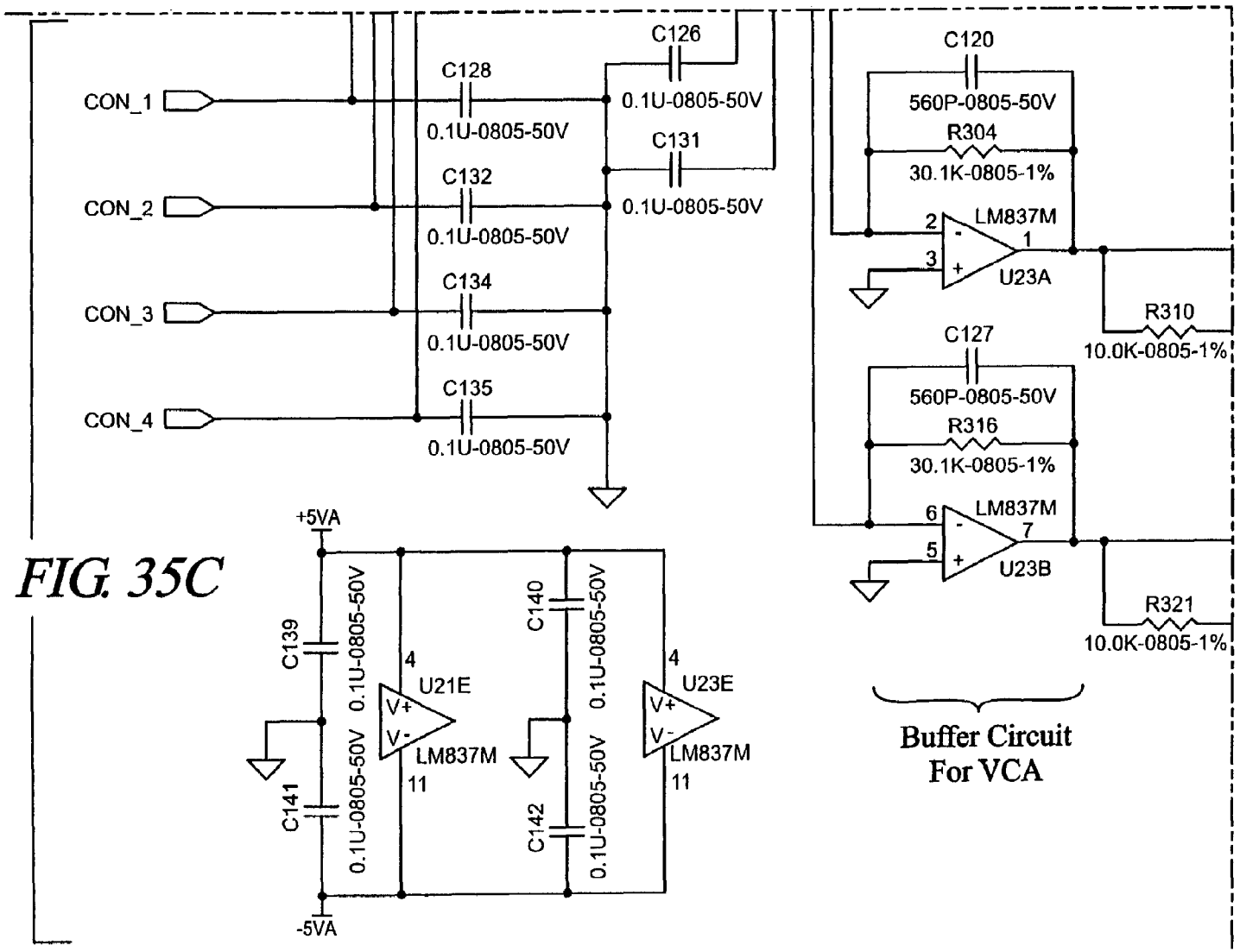
Figure 35D:
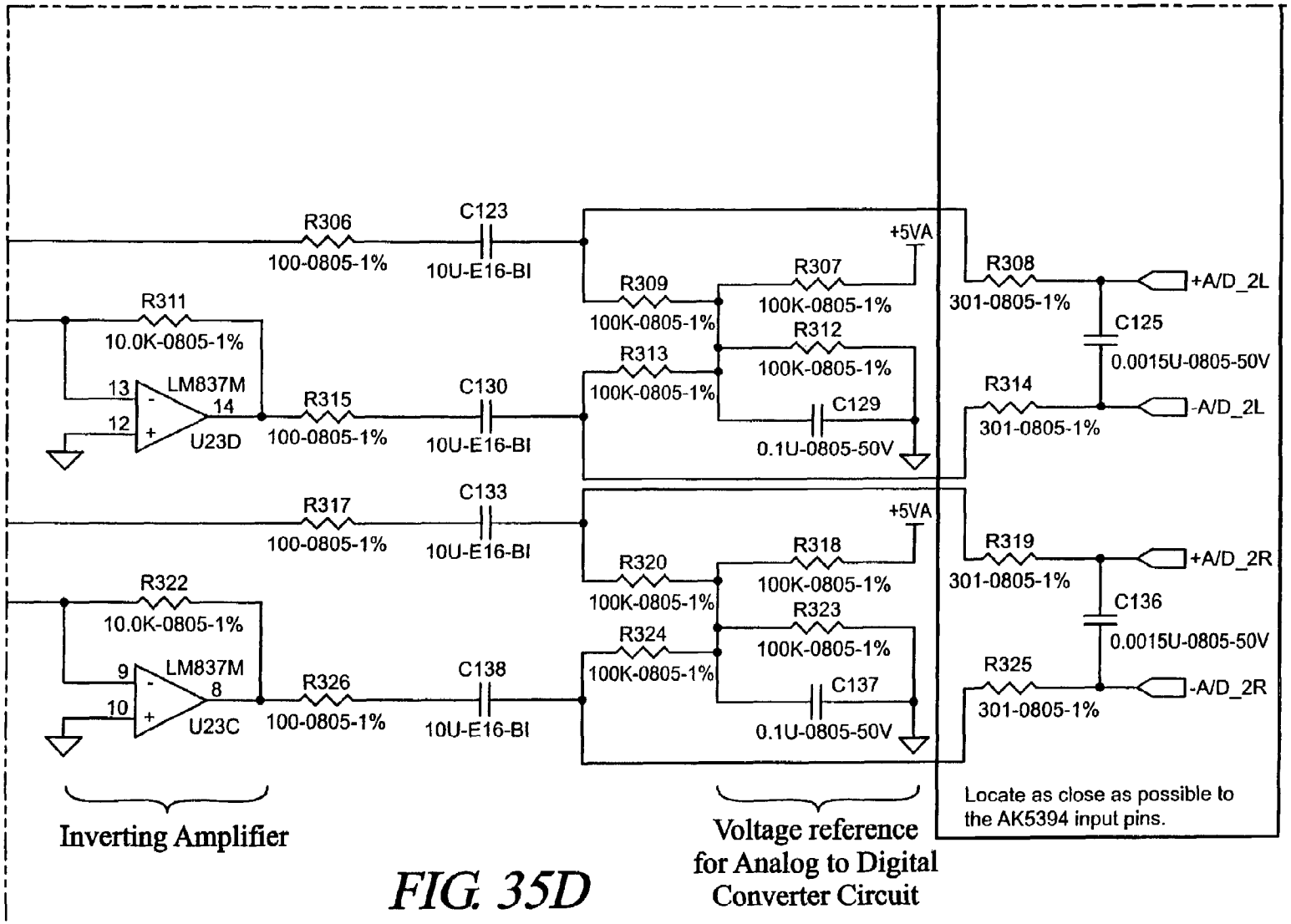
Figure 36:
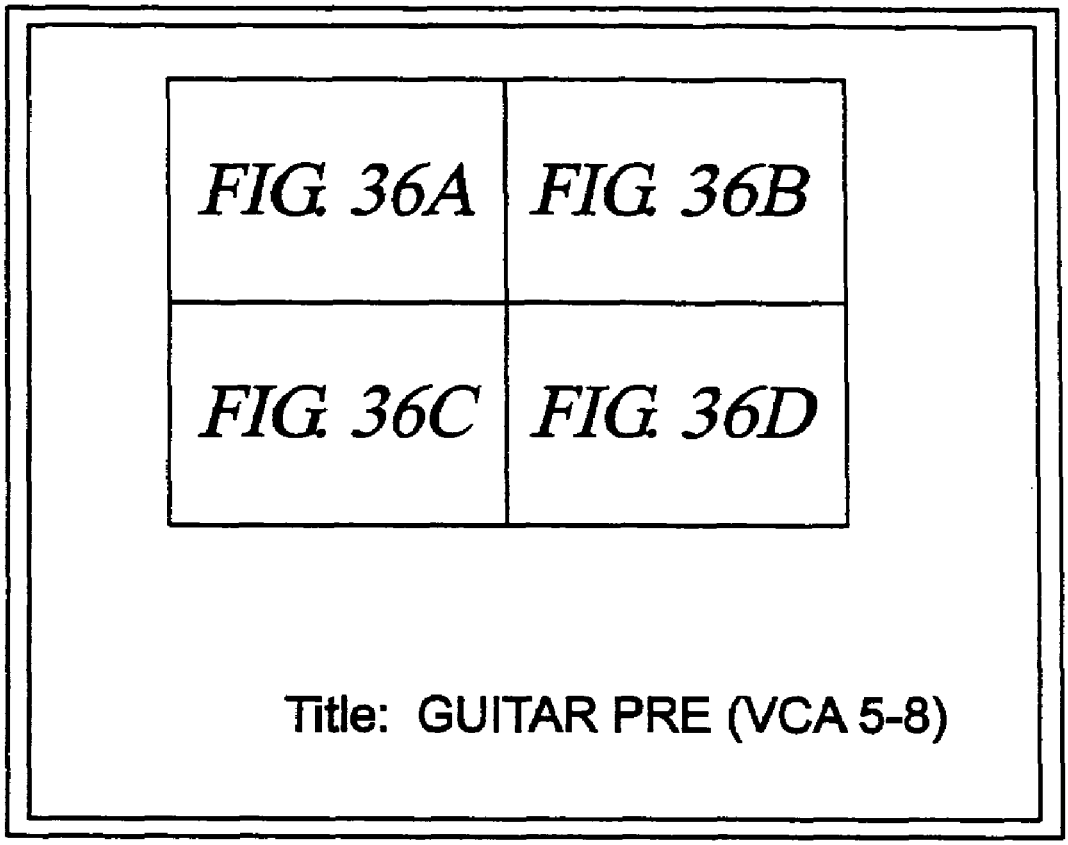
Figure 36A:
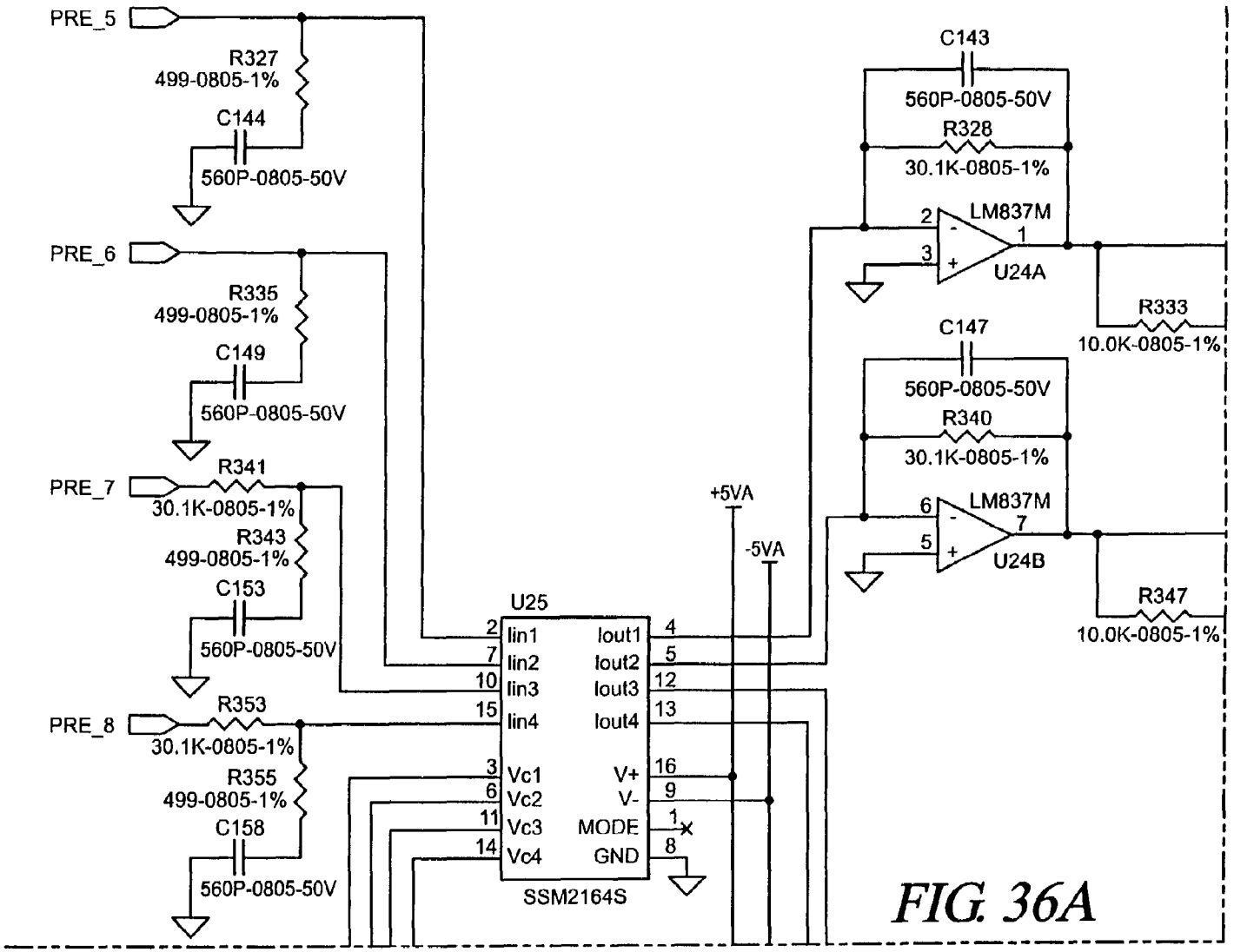
Figure 36B:
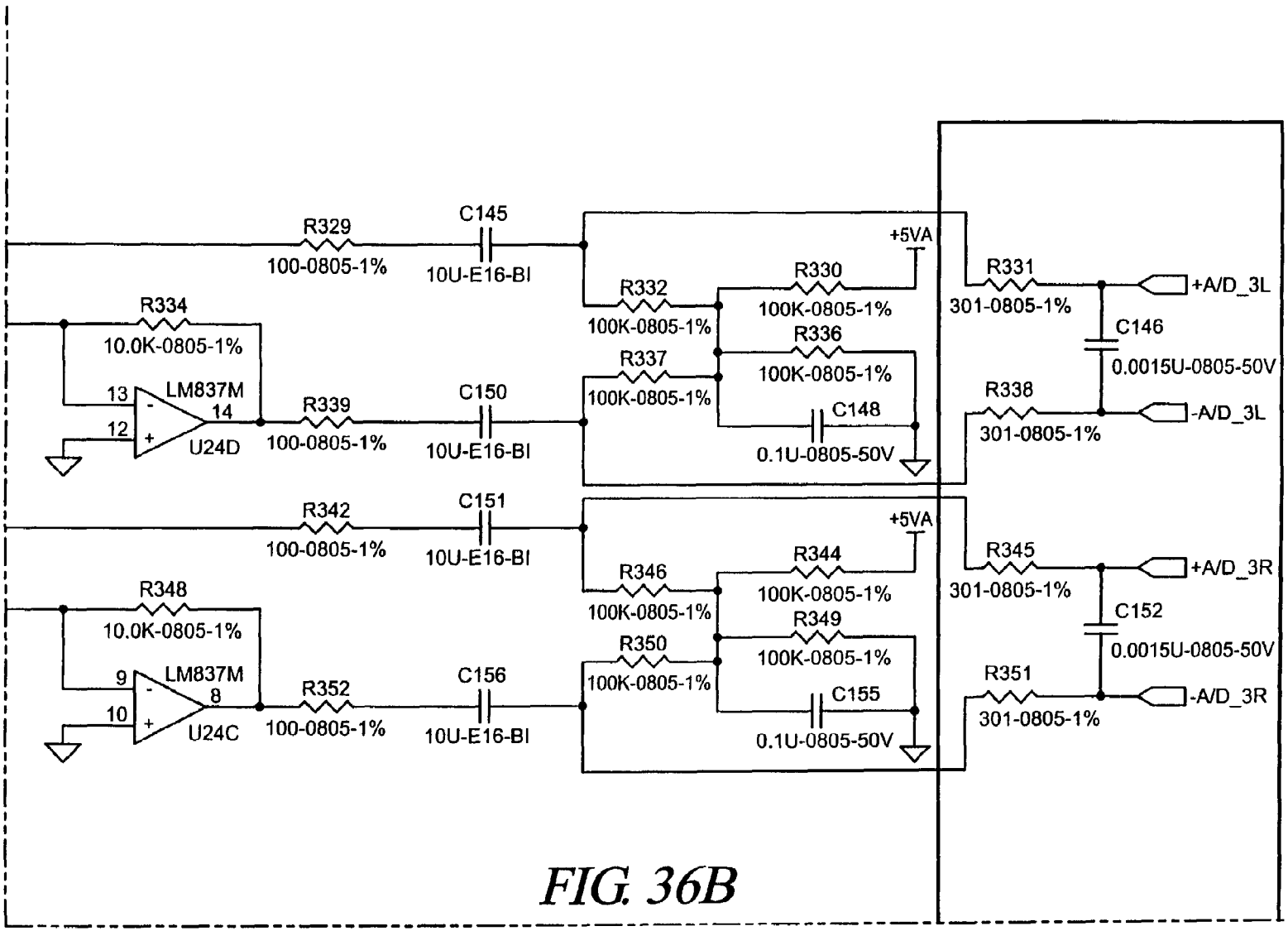
Figure 36C:
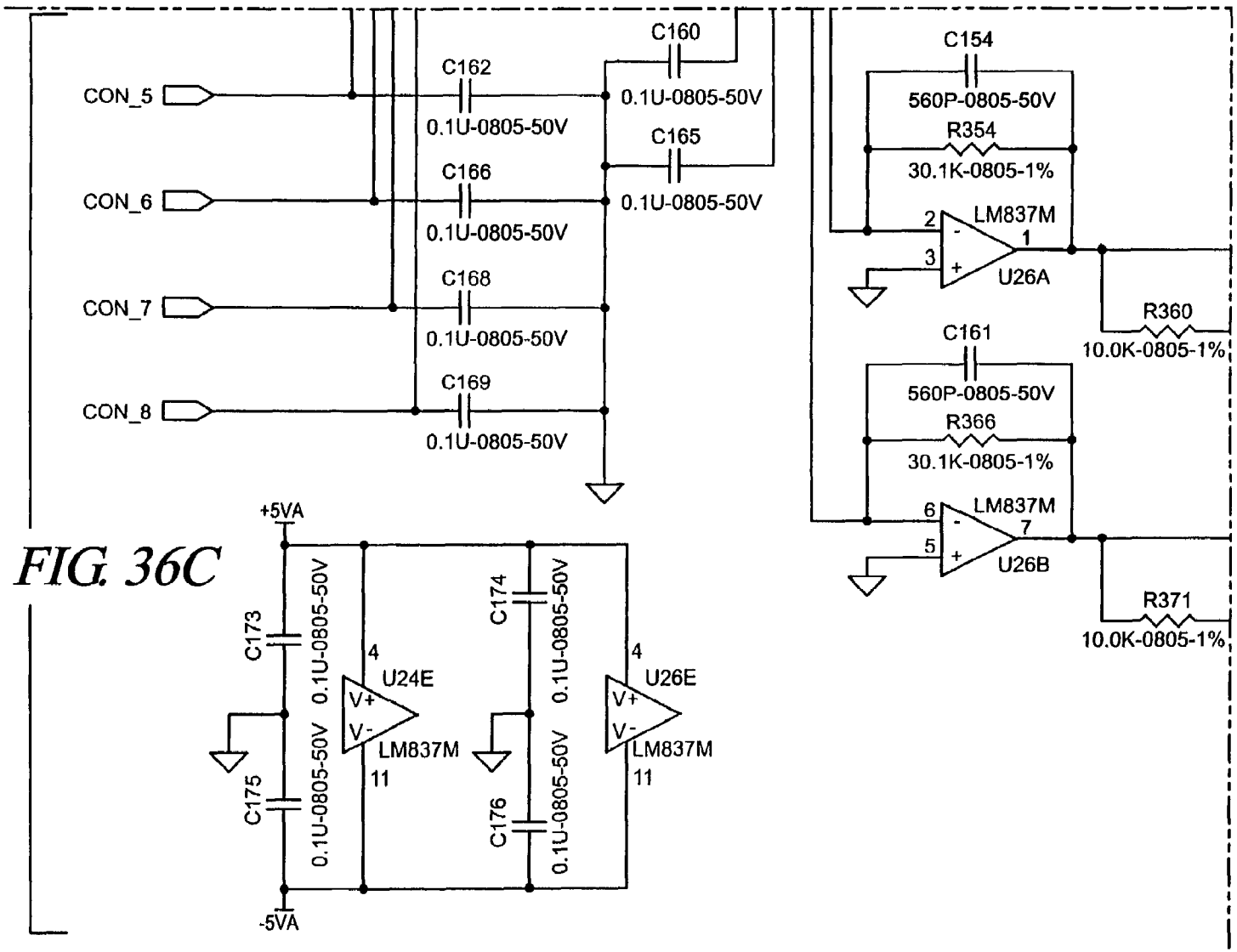
Figure 36D:
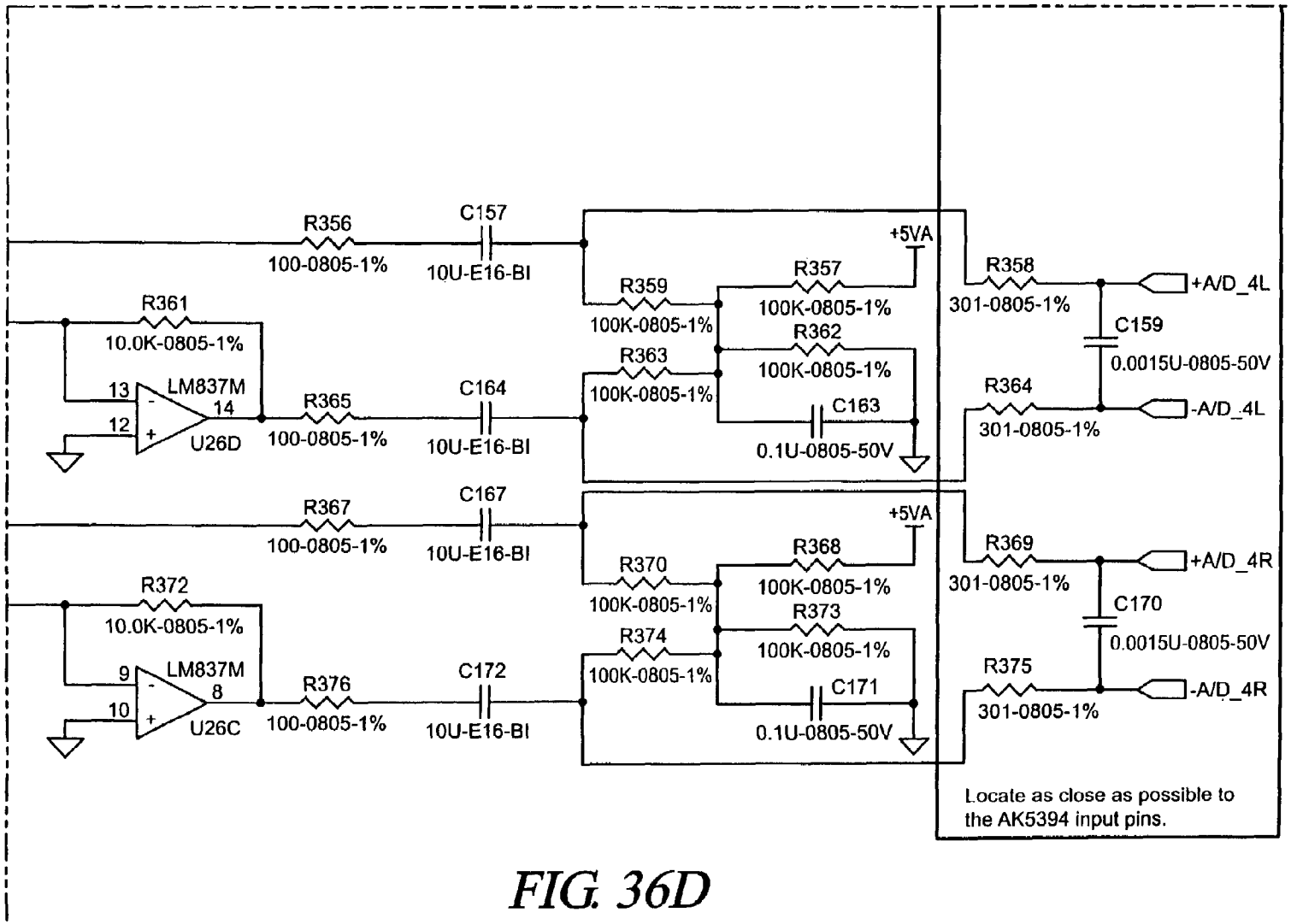

Referring to FIG. 28, one embodiment of the passive control system for the traditional electric guitar components is shown with the T2 module 112. This board is responsible for taking raw data from a data A/D sampling knob position and translating it into MaGIC control data. This board can be expanded to add other control elements as necessary. While different boards may be required for different guitars, the control in each must define and present a common interface to the digital board containing the MaGIC chip, which translates the serial data into MaGIC control information.

Figure 27:
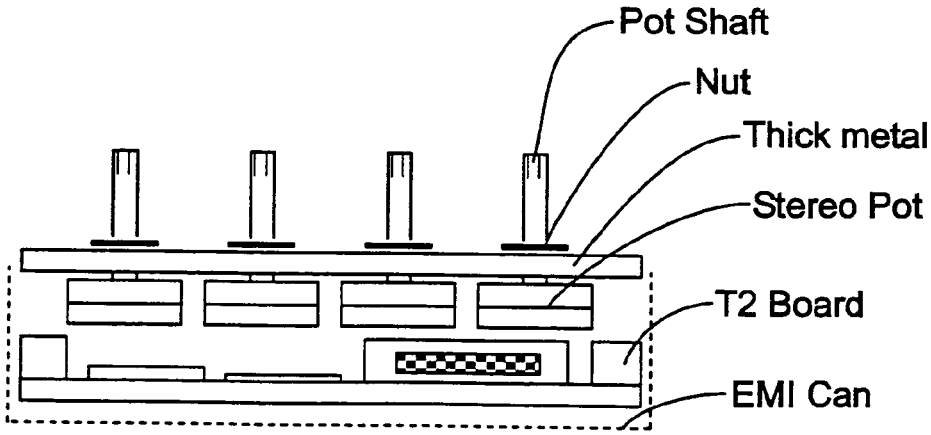
FIG. 27 is a cross-sectioned schematic view of the internal arrangement of the control knobs and the T2 board.

The T2 board (i.e., module) 112 is an 'A' port device. It is always a sync slave. It is powered by 802.3af Power over Ethernet. The T2 module 112 supplies 2 channels out and 8 channels in of audio, bit-banged in $I^2S$ format. It takes raw data from a data A/D sampling knob position and translates it to MaGIC control data. In one embodiment, the T2 module 112 is a single board, but may be separated into multiple boards if necessary. One embodiment of the physical subassembly in the digital guitar is shown in FIG. 27.

In one embodiment, the T2 module 112 includes 2 AK5384 chips, which are analog to digital converters for audio with 4 channels each, an analog to digital M62334, 4 channel multiplexer (mux) chip from Mitsubishi connected to the guitar knobs, and an AK4380 digital to analog chip for the headphone output.

The guitar 12 includes the following programmed MaGIC components:

| T2 Module connectors | # of pins minimum |
|---|---|
| Humbucker pickups | 3 |
| Hex Pickups | 27 |
| Selector switch | 4 |
| To RJ-45 | 9 |
| To I/O plate | 4 (more if we want LEDs) |
| To ¼" jack | 2 |

Existing hard-sleeved network cables are not robust enough to sustain the repeated twisting, turning, and mechanical stress commonly experienced in live audio environments. As a result, custom soft-sleeved cables that are reliable enough to sustain repeated mechanical stress and can provide adequate shielding against nearby high voltage/current cables are strongly recommended. Also, all environments except permanent installations should use stranded instead of solid wire cables to further increase reliability under mechanical stress.

The present invention also includes a retrofit method that can be used to convert conventional analog guitar into a digital guitar. The method includes the steps (in any order) of removing a conventional analog output assembly from a conventional analog guitar, inserting and mounting the digital guitar processing circuit 112 inside the conventional analog guitar, connecting the digital guitar processing circuit 112 to a guitar pickup assembly 110 mounted on the conventional analog guitar and a digital input/output assembly 114, and mounting the digital input/output assembly 114 on the conventional analog guitar.

Alternatively, the retrofit method can leave the existing analog output assembly in place, and add the new features by inserting and mounting the digital guitar processing circuit 112 inside the conventional analog guitar, connecting the digital guitar processing circuit 112 to a guitar pickup assembly 110 mounted on the conventional analog guitar and a digital input/output assembly 114, and mounting the digital input/output assembly 114 on the conventional analog guitar.

| Name | Type | Control Type | Address | Value | Default Links |
|---|---|---|---|---|---|
| Guitar knob 1 | Source | Scale | To be determined | 8-bit value between 0-255 | To be determined |
| Guitar knob 2 | Source | Scale | To be determined | 8-bit value between 0-255 | To be determined |
| Guitar knob 3 | Source | Scale | To be determined | 8-bit value between 0-255 | To be determined |
| Guitar knob 4 | Source | Scale | To be determined | 8-bit value between 0-255 | To be determined |
| Guitar switch 1 | Source | Toggle | To be determined | 0 or 1 | To be determined |
| Guitar switch 2 | Source | Toggle | To be determined | 0 or 1 | To be determined |
| Guitar switch 3 | Source | Toggle | To be determined | 0 or 1 | To be determined |

The MaGIC component addresses, device classes, and default control links can be determined and assigned as necessary.

For increased reliability, robust Neutrik EtherCon series connectors can be used. Both the male cable carriers and female receptacles in this series contain robust die cast shell with a secure latching feature. These devices are pre-assembled RJ-45 plugs.

Thus it is seen that the apparatus and methods of the present invention readily achieve the ends and advantages mentioned as well as those inherent therein. While certain preferred embodiments of the invention have been illustrated and described for the purposes of the present disclosure, numerous changes in the construction and steps thereof may be made by those skilled in the art, which changes are encompassed within the scope and spirit of the appended claims.

What is claimed is:

1. A digital guitar, comprising:

a guitar body;

guitar strings mounted on the guitar body;

a guitar pickup assembly mounted on the guitar body adjacent to the guitar strings for generating analog string signals;

a digital guitar processing circuit connected to the guitar pickup assembly for processing digital string audio signals, said digital string audio signals being arrived at by conversion of the analog string signals to digital form; and a guitar digital output assembly connected to the digital guitar processing circuit for outputting the digital string audio signals.

2. The digital guitar of claim 1, wherein the guitar pickup assembly includes a monophonic guitar pickup.

3. The digital guitar of claim 2, wherein the monophonic guitar pickup is a humbucker guitar pickup.

4. The digital guitar of claim 1, wherein the guitar pickup assembly includes a multi-signal guitar pickup.

5. The digital guitar of claim 4, wherein the multi-signal guitar pickup is a polyphonic multi-signal guitar pickup.

6. The digital guitar of claim 5, wherein the polyphonic multi-signal guitar pickup is a hexaphonic multi-signal guitar pickup.

7. The digital guitar of claim 1, wherein the guitar pickup assembly includes multiple guitar pickups.

8. The digital guitar of claim 7, wherein the guitar pickup assembly includes two or more different types of guitar pickups.

9. The digital guitar of claim 8, wherein the guitar pickup assembly includes a monophonic and a multi-signal guitar pickup.

10. The digital guitar of claim 1, wherein the digital guitar processing circuit includes a guitar analog/digital converter circuit connected to the guitar pickup assembly and the guitar digital output assembly.

11. The digital guitar of claim 10, wherein the digital guitar processing circuit includes a guitar digital communication circuit connected between the guitar analog/digital converter circuit and the guitar digital output assembly.

12. The digital guitar of claim 11, wherein the digital guitar processing circuit includes a guitar mixing circuit connected between the guitar analog/digital converter circuit and the guitar pickup assembly.

13. The digital guitar of claim 12, wherein the digital guitar processing circuit includes a guitar amplifier circuit connected between the guitar mixing circuit and the guitar pickup assembly.

14. The digital guitar of claim 1, further comprising a guitar digital input assembly connected to the digital guitar processing circuit.

15. The digital guitar of claim 1, further including a guitar control assembly.

16. A digital guitar, comprising:

a guitar body;

guitar strings mounted on the guitar body;

a guitar pickup assembly mounted on the guitar body adjacent to the guitar strings;

a digital guitar processing circuit connected to the guitar pickup assembly;

a guitar digital output assembly connected to the digital guitar processing circuit for outputting digital string signals;

wherein the digital guitar processing circuit includes a guitar analog/digital converter circuit connected to the guitar pickup assembly and the guitar digital output assembly;

wherein the digital guitar processing circuit includes a guitar digital communication circuit connected between the guitar analog/digital converter circuit and the guitar digital output assembly; and wherein the guitar digital communication circuit includes a bi-directional interface circuit.

17. The digital guitar of claim 16, wherein the bi-directional interface circuit includes a bi-directional audio interface.

18. The digital guitar of claim 16, wherein the bi-directional interface circuit includes a bi-directional control interface.

19. A guitar, comprising:

a guitar body;

a plurality of guitar strings mounted on the guitar body;

a pickup mounted on the body under the strings, the pickup generating at least one analog electrical string audio signal corresponding to vibration of the strings;

an analog to digital converter circuit mounted on the guitar, and operably associated with the pickup, for converting the analog electrical string audio signal to a digital electrical string audio signal; and a digital output connector, mounted on the guitar, for outputting the digital electrical string audio signal.

20. The guitar of claim 19, further comprising:

an analog output connector, mounted on the guitar, for outputting the analog electrical string audio signal.

21. The guitar of claim 20, further comprising:

a volume control and a tone control, operatively associated with the analog to digital converter circuit, so that both the analog and digital electrical string audio signals output by the guitar can be modified by the volume control and the tone control.

22. The guitar of claim 19, in combination with:

a breakout box including:

an input for receiving the digital electrical guitar audio signal from the guitar;

a digital to analog converter circuit for converting the digital electrical guitar audio signal to an analog breakout box signal; and a breakout box output for outputting the analog breakout box signal, so that the digital guitar may be used with a conventional analog amplifier and speakers.

* * * * *